US005826315A

United States Patent [19]

Kuroyanagi

[11] Patent Number: 5,826,315

[45] Date of Patent: Oct. 27, 1998

[54] FLAT HEALD/DROPPER-DRAWING/ SEPARATING METHOD AND APPARATUS

[75] Inventor: Kazunori Kuroyanagi, Inasa-gun, Japan

[73] Assignee: Hamamatsu Photonics K.K., Hamamatsu, Japan

[21] Appl. No.: 848,404

[22] Filed: May 8, 1997

[30] Foreign Application Priority Data

May 8, 1996 [JP] Japan ..... 8-113791
May 8, 1996 [JP] Japan ..... 8-113809

[51] Int. Cl.[6] ..... D03J 1/14

[52] U.S. Cl. ..... 28/206; 271/90; 271/102; 221/211; 221/212

[58] Field of Search ..... 28/201, 202, 203.1, 28/205, 206, 207; 221/40, 107, 111, 312 A, 212, 278; 271/283, 901, 18.1, 99, 102, 132, 141

[56] References Cited

U.S. PATENT DOCUMENTS 3,777,339 12/1973 Fleishcher et al. ..... 28/46
4,520,539 6/1985 John et al. ..... 28/206
4,543,696 10/1985 John et al. ..... 28/206
5,148,585 9/1992 Jaeger et al. ..... 28/201
5,295,675 3/1994 Hain ..... 271/12

FOREIGN PATENT DOCUMENTS 47-31387 8/1972 Japan .
60-22097 5/1985 Japan .
6-57596 3/1994 Japan .

*Primary Examiner*—Andy Falik
*Attorney, Agent, or Firm*—Pillsbury Madison & Sutro LLP

[57] ABSTRACT

A flat heald drawing method and apparatus that draws an arbitrary flat heald out of a number of stacked flat healds. To the method a drawing pin of a magnetic head is inserted into a guide hole of a front-side ring portion of the lowermost flat heald while the flat healds are vertically stacked. The front-side ring portion of the lowermost flat heald is magnetically attracted to a tip end portion of the magnetic head. The magnetic head is moved horizontally, drawing the lowermost flat heald while hooking the flat heald on the drawing pin. The apparatus includes a magnetic head is located below a guide hole of a front-side ring portion of the lowermost flat heald and a drawing pin which is extended from a tip end face of the magnetic head. The draw pin is inserted into the guide hole of the front-side ring portion of the lowermost flat heald. A driving device holds the magnetic head and moves the magnetic head horizontally.

20 Claims, 43 Drawing Sheets

10
122
92
140
144
142
141
143
A
110
93a
93
130
91
113
110b
114
115
91A
111

FLAT HEALD/DROPPER-DRAWING/ SEPARATING METHOD AND APPARATUS

BACKGROUND OF THE INVENTION

1. Field of the Invention

The present invention relates to a method and apparatus for processing small members such as a flat heald and a dropper which are used in a loom machine. In particular, the method and apparatus are flat heald drawing method and apparatus for drawing a flat heald at the lowermost position out of a heald group constituted by many flat healds juxtaposed. In addition, the present invention relates to a flat heald separating method and mechanism which are used to separate a flat heald at the lowermost position out of a heald group constituted by many flat healds juxtaposed. The present invention also relates to a dropper drawing method and apparatus for drawing a dropper at the lowermost position out of a dropper group constituted by many droppers juxtaposed.

Furthermore, the present invention relates to a dropper separating method and mechanism which are used to separate a dropper at the lowermost position from a heald group constituted by many droppers juxtaposed.

2. Related Background Art

A conventional flat heald drawing apparatus is disclosed in Japanese Patent Publication No. 60-22097. The heald drawing apparatus disclosed in this bulletin shows the technique of pressing a suction nozzle equipped with a magnet against the rod portion of the outermost heald of a heald group held by upper and lower guide rails extending horizontally, and conveying the outermost flat heald to a predetermined place while separating the rod portion from the heald group by the magnetic force and suction force of the suction nozzle. A conventional flat heald separating mechanism is also disclosed in Japanese Patent Laid-Open No. 6-57596. The flat heald separating mechanism disclosed in this bulletin is designed to separate the middle portion of an outermost flat heald A (see FIG. 12) of a flat heald group held by upper and lower guide rails extending horizontally, and insert a separating claw between the outermost flat heald A and the next flat heald A, thereby slightly separating the outermost flat heald A from the remaining flat healds A.

A conventional dropper drawing apparatus is disclosed in Japanese Patent Publication No. 47-31387. The dropper drawing apparatus disclosed in this bulletin is designed to cause a dropper located at an end of a dropper group held in a suspended state by upper and lower guide rails extending horizontally to repel each other by magnetic induction caused by a separating magnet, magnetically attract the upper or lower end of the outermost dropper (See FIG. 44) to an attracting electromagnet, and move the electromagnet horizontally, thereby properly separating the outermost dropper C from the next dropper C. drawing the outermost dropper along the guide rails.

A conventional dropper separating mechanism is disclosed in Japanese Patent Publication No. 47-31387. The dropper separating mechanism disclosed in this bulletin is designed to magnetically attract a dropper C (see FIG. 44) at an end of a dropper group held in a suspended state by guide rails extending horizontally to an electromagnet, and move the electromagnet horizontally, thereby properly separating the outermost dropper C from the next dropper C.

According to a conventional flat heald drawing apparatus, the substantially middle portion of the rod portion of the outermost flat heald on one side which is suspended from guide rails is pulled horizontally with a magnetic force and a suction force to drawn the outermost flat heald from a heald group. In this case, if flat healds are stacked on each other with a machine oil adhering them, the flat healds stick to each other with the oil. When a portion near the middle of the outermost flat heald in the suspended state is pulled, a force acts to forcibly separate the outermost flat heald from the next flat heald. As a result, a large force is required to draw the flat heald. In some case, when only the outermost flat heald is to be drawn, two or three flat healds may be drawn while they stick to each other. Consider the separating operation of the flat heald separating mechanism. Since the outermost flat heald A suspended vertically is drawn out while its middle portion is sucked by an air suction unit, if, for example, the flat healds A are stacked on each other with a machine oil or the like adhering them, the flat healds A stick to each other. When the flat heald A is separated in this state while its middle portion is sucked while being warped, it is inevitable that the outermost flat heald A is forcibly separated from the next flat heald A. That is, a large suction force is required to separate the flat heald A. In some case, when only the outermost flat heald A is to be separated, two or three flat healds may be separated while they stick to each other.

The above dropper drawing apparatus is designed to draw the suspended outermost dropper by using only the magnetic attraction of the electromagnet. For this reason, if droppers are stacked on each other while a machine oil or the like adhering them, the weight of a plurality of droppers drawn becomes large. In addition, these droppers are drawn in contact with the guide rails. Therefore, the resistance to draw the droppers increases, and the droppers may drop off from the attracting electromagnet. In addition, the separating magnet and the attracting magnet must be properly balanced.

Since the above dropper drawing apparatus is designed to draw the suspended outermost dropper by using only the magnetic attraction of the electromagnet, if droppers are stacked on each other with a machine oil or the like adhering them, the weight of a plurality of droppers drawn becomes large. In addition, since these droppers are drawn in contact with the guide rails, the resistance to draw the droppers increases. Therefore, the droppers may drop off from the electromagnet. Furthermore, the separating magnet and the attracting magnet must be properly balanced.

The above dropper separating mechanism is designed to separate the outermost dropper C in a suspended state while the dropper is magnetically attracted to the electromagnet and pulled out. If, for example, the droppers C are stacked on each other with a machine oil or the like adhering them, the droppers C stick to each other with the oil machine. When the dropper C is pulled out while its upper end is magnetically attracted, two or three droppers may be separated while they stick to each other, because the lower ends of droppers are free.

SUMMARY OF THE INVENTION

The present invention has been made to solve the above problems, and has as its object to provide a flat heald drawing method and apparatus which can reliably draw the lowermost flat heald out of a group of flat healds stacked vertically. The present invention has been made to solve the above problems, and has as its object to provide a dropper drawing method and apparatus which reliably draw the lowermost dropper out of a group of droppers stacked vertically.

The present invention has been made to solve the above problems, and has as its object to provide a dropper separating mechanism and method which reliably separate the lowermost dropper from a group of droppers.

According to the present invention, there is provided a flat heald drawing method of drawing an arbitrary flat heald out of a number of juxtaposed magnetic flat healds, comprising inserting a drawing pin of a magnetic head into a guide hole of a front-side ring portion of the lowermost flat heald while the flat healds are stacked vertically and maintained, magnetically attracting the front-side ring portion of the lowermost flat heald to a tip end portion of the magnetic head, moving the magnetic head horizontally, and drawing the lowermost flat heald while hooking the flat heald on the drawing pin.

In this drawing method, after the drawing pin is inserted into the front-side guide hole of the lowermost flat heald while many magnetic flat healds stacked vertically, the excitation current is supplied to the coil wound on the magnetic head to magnetically attract the front-side ring portion of the lowermost flat heald to the tip end face of the magnetic head, thereby fixing the front-side ring portion to the magnetic head. Thereafter, the magnetic head is moved horizontally to smoothly draw the lowermost flat heald while hooking the front-side ring portion of the lowermost flat heald to the drawing pin.

In this case, a damped alternating current for degaussing is preferably supplied to a coil wound on the magnetic head to degauss the ring portion magnetized by the magnetic head while the ring portion of the flat heald is magnetically attracted to the magnetic head after the lowermost flat heald is completely drawn out, thereby releasing the ring portion from the magnetic head.

According to the present invention, there is provided a flat heald drawing apparatus for drawing an arbitrary flat heald out of a number of juxtaposed magnetic flat healds, comprising a magnetic head located below a guide hole of a front-side ring portion of the lowermost flat heald and constituted by an iron core of an electromagnet, a drawing pin which extends from a tip end face of the magnetic head and is to be inserted into the guide hole of the front-side ring portion of the lowermost flat heald, and driving means which holds the magnetic head thereon and moves the magnetic head horizontally.

In this drawing apparatus, after the drawing pin is inserted into the guide hole of the front-side ring portion of the lowermost flat heald while many magnetic flat healds are stacked vertically, the excitation current is supplied to the coil wound on the magnetic head to magnetically attract the front-side ring portion of the lowermost flat heald to the tip end face of the magnetic head, thereby fixing the front-side ring portion to the magnetic head. Thereafter, the magnetic head is moved horizontally by the driving means to smoothly draw the lowermost flat heald while hooking the front-side ring portion of the lowermost flat heald to the drawing pin.

In this case, if flat healds in a substantially horizontal state are stacked vertically in the housing, the lowermost flat heald can be drawn out by the magnetic head more properly.

According to the present invention, there is provided a flat heald separating method of separating an arbitrary flat heald out of a number of juxtaposed flat healds, comprising vacuum-chucking a front end of a rod portion of the lowermost flat heald, positioned in front of a front end of the heald support surface, downward while the flat healds in a substantially horizontal state are stacked vertically on a heald support surface, thereby warping the lowermost flat heald in a cantilevered state downward and separating the lowermost flat heald from the next flat heald, with the front end of the heald support surface serving as a fulcrum.

In this flat heald separating method, when flat healds in a substantially horizontal state are stacked vertically on the heald support surface, the lowermost flat heald is cantilevered on the heald support surface. The portion of the lowermost flat heald which is located on the front side relative to the front end of the heald support surface is free without being support from below. When this free portion, i.e., the front end portion of the rod portion, is vacuum-chucked downward, the lowermost flat heald is warped downward in a cantilevered state and separated from the next flat heald, with the front end of the heald support surface serving as a fulcrum. At this time, the lowermost flat heald is gradually peeled off and separated from the next flat heald from the front end. Even if, therefore, flat healds stick to each other with a machine oil or the like, since the lowermost flat heald is separated from the next flat heald from the front end, the flat healds can be easily separated from each other with a slight force.

In this case, flat healds are preferably stacked vertically in the housing having the substantially horizontal heald support surface.

According to the present invention, there is provided a flat heald separating mechanism for separating an arbitrary flat heald out of a number of juxtaposed flat healds, comprising a suction head which is located below a front end of a rod portion of the lowermost flat heald positioned in front of a front end of the heald support surface, while the flat healds in a substantially horizontal state are stacked vertically on the heald support surface, and moves vertically, a suction port provided as an aperture at a tip end face of the suction head and opposed to a flat surface of the rod portion of the lowermost flat heald, and a vacuum source for sucking air through the suction portion.

In this flat heald separating mechanism, when flat healds in a substantially horizontal state are stacked vertically on the heald support surface, the lowermost flat heald is cantilevered on the heald support surface. The portion of the lowermost flat heald which is located on the front side relative to the front end of the heald support surface is free without being supported from below. In this state, the suction head is moved upward to bring the suction port close to or into contact with the flat surface of the rod portion of the lowermost flat heald. The vacuum source is then actuated to perform evacuation through the suction port to attach the flat surface of the rod portion of the lowermost flat heald to the tip end face of the suction head. When the suction head is lowered in this state, the lowermost flat heald is warped downward in a cantilevered state and separated from the next flat heald, with the front end of the heald support surface serving as a fulcrum. At this time, the lowermost flat heald is gradually peeled off and separated from the next flat heald from the front end. Even if, therefore, flat healds stick to each other with a machine oil or the like, since the lowermost flat heald is separated from the next flat heald from the front end, the flat healds can be easily separated from each other with a slight force. The power of the vacuum source can be reduced by increasing the distance between the front end of the heald support surface, serving as a fulcrum, and the suction port of the suction head according to the principle of the lever. Note that after the vacuum source is actuated to move the suction head upward so as to attach the flat surface of the rod portion of the lowermost flat heald to the tip end face of the suction head, the suction head may be lowered to separate the lowermost flat heald.

In this case, flat healds are preferably stacked vertically in the housing having the substantially horizontal heald support surface.

According to the present invention, there is provided a dropper drawing method of drawing an arbitrary dropper out of a number of juxtaposed magnetic dropper, comprising inserting a drawing pin of a magnetic head into a guide hole of the lowermost dropper while the droppers are stacked vertically, magnetically attracting the guide hole of the lowermost dropper to an attracting surface of the magnetic head, and moving the magnetic head horizontally, thereby drawing the lowermost dropper while hooking the dropper on the drawing pin.

In this drawing method, after the drawing pin is inserted into the guide hole of the lowermost dropper while a number of magnetic droppers are stacked vertically, the excitation current is supplied to the coil wound on the magnetic head to magnetically attract the guide hole peripheral portion of the lowermost dropper to the attracting surface of the magnetic head, thereby fixing the guide hole peripheral portion to the attracting surface of the magnetic head. Thereafter, the magnetic head is moved horizontally to smoothly draw the lowermost dropper while hooking the guide hole peripheral portion of the lowermost dropper to the drawing pin.

In this case, an excitation current flowing in a coil wound on the magnetic head is preferably switched to a damped alternating current for degaussing to degauss the guide hole peripheral portion magnetized by the magnetic head after the lowermost dropper is completely drawn out, thereby releasing the guide hole peripheral portion from the magnetic head.

According to the present invention, there is provided a dropper drawing apparatus for drawing an arbitrary dropper out of many magnetic droppers juxtaposed, comprising a magnetic head located below a guide hole of the lowermost dropper and constituted by an iron core of an electromagnet, a drawing pin which extends from a tip end face of the magnetic head and is to be inserted into the guide hole of the lowermost dropper, and driving means which holds the magnetic head thereon and moves the magnetic head horizontally.

In this drawing apparatus, after the drawing pin is inserted into the guide hole of the lowermost dropper while many magnetic droppers are stacked vertically, the excitation current is supplied to the coil wound on the magnetic head to magnetically attract the guide hole peripheral portion of the lowermost dropper to the tip end face of the magnetic head, thereby fixing the guide hole peripheral portion of the dropper to the magnetic head. Thereafter, the magnetic head is moved horizontally by the driving means to smoothly draw the lowermost dropper while hooking the guide hole peripheral portion of the lowermost dropper to the drawing pin.

In this case, the lowermost dropper can be stably drawn out while it is hooked on the drawing pin by elongating the drawing pin in the direction of matching with the guide hole of the dropper.

In addition, by forming a pair of guide projections on the tip end face of the magnetic head at positions where they sandwich the drawing pin, the lowermost dropper can be stably drawn out while it is hooked on the drawing pin.

Furthermore, if droppers in a substantially horizontal state are stacked vertically in the housing, the lowermost dropper can be properly drawn out by the magnetic head.

According to the present invention, there is provided a dropper separating method of separating an arbitrary dropper out of a number of juxtaposed droppers, comprising vacuum-chucking a front portion of a dropper main body of the lowermost dropper, positioned in front of a front end of the dropper support surface, downward while the droppers in a substantially horizontal state are stacked vertically on a dropper support surface, thereby warping the lowermost dropper in a cantilevered state downward and separating the lowermost dropper from the next dropper, with the front end of the dropper support surface serving as a fulcrum.

In this dropper separating method, when droppers in a substantially horizontal state are stacked vertically on the dropper support surface, the lowermost dropper is cantilevered on the dropper support surface. The portion of the lowermost dropper which is located on the front side relative to the front end of the dropper support surface is free without being supported from below. When this free portion, i.e., the front portion of the dropper main body, is vacuum-chucked downward, the lowermost dropper is warped downward in a cantilevered state and separated from the next dropper, with the front end of the dropper support surface serving as a fulcrum. At this time, the lowermost dropper is gradually peeled off and separated from the next dropper from the front end. Even if, therefore, droppers stick to each other with a machine oil or the like, since the lowermost dropper is separated from the next dropper from the front end, the droppers can be easily separated from each other with a slight force.

In this case, droppers are preferably stacked vertically in the housing having the substantially horizontal dropper support surface.

According to the present invention, there is provided a dropper separating mechanism for separating an arbitrary dropper out of a number of juxtaposed droppers, comprising a suction head which is located below a front portion of a dropper main body of the lowermost dropper positioned in front of a front end of the dropper support surface, while the droppers in a substantially horizontal state are stacked vertically on the dropper support surface, and moves vertically, a suction port provided as an aperture at a tip end face of the suction head and opposed to a flat surface of the dropper main body the lowermost dropper, and a vacuum source for sucking air through the suction portion.

In this dropper separating mechanism, when droppers in a substantially horizontal state are stacked vertically on the dropper support surface, the lowermost dropper is cantilevered on the dropper support surface. The portion of the lowermost dropper which is located on the front side relative to the front end of the dropper support surface is free without being supported from below. In this state, the suction head is moved upward to bring the suction port close to or into contact with the flat surface of the dropper main body of the lowermost dropper. The vacuum source is then actuated to perform evacuation through the suction port to attach the flat surface of the dropper main body of the lowermost dropper to the tip end face of the suction head. When the suction head is lowered in this state, the lowermost dropper is warped downward in a cantilevered state and separated from the next dropper, with the front end of the dropper support surface serving as a fulcrum. At this time, the lowermost dropper is gradually peeled off and separated from the next dropper from the front end. Even if, therefore, droppers stick to each other with a machine oil or the like, since the lowermost dropper is separated from the next dropper from the front end, the droppers can be easily separated from each other with a slight force. The power of the vacuum source can be reduced by increasing the distance between the front end of the dropper support surface, serving as a fulcrum, and the suction port of the suction head according to the principle of the lever. Note that while the vacuum source is actuated, the suction head may be moved upward to attach the flat surface of the dropper main body of the lowermost dropper to the tip end face of the suction head.

In this case, the tip end face of the suction head is preferably inclined forward. With this structure, when the lowermost dropper is drawn and bent, the tip end face of the suction head can be reliably brought into contact with the flat surface of the dropper.

A pair of right and left guide projections are preferably formed on the tip end face of the suction head at positions where the guide projections sandwich the suction port. With this structure, since the dropper can be clamped between the pair of guide projections, the lowermost dropper can be stably separated without any skid.

In this case, dropper are preferably stacked vertically in the housing having a substantially horizontal dropper support surface.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DETAILED DESCRIPTION OF THE PREFERRED EMBODIMENTS

Figure 24:
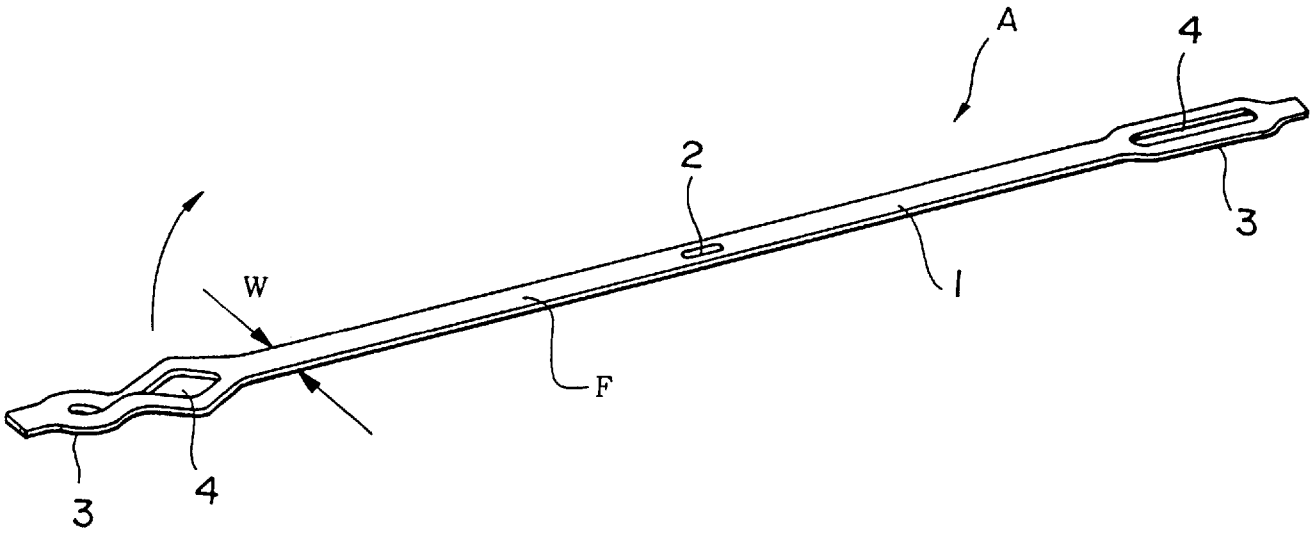
FIG. 24 is a perspective view showing an example of the flat heald.

The preferred embodiments of the flat heald drawing method and apparatus according to the present invention will be described in detail below with reference to the accompanying drawings. A flat heald A for which the present invention is to be used is integrally made of SUS 420 or the like having a spring property and, as shown in FIG. 24, has a flat, elongated rod portion 1 with a rectangular cross-section. A mail 2 is formed in the middle of this rod portion 1. Ring portions 3 are provided at the both ends of the rod portion 1. An elongated guide hole 4 is formed in each ring portion 3. This flat heald A bends easily in the direction of an arrow, but is resistant to torsion and deformation.

Figure 1:
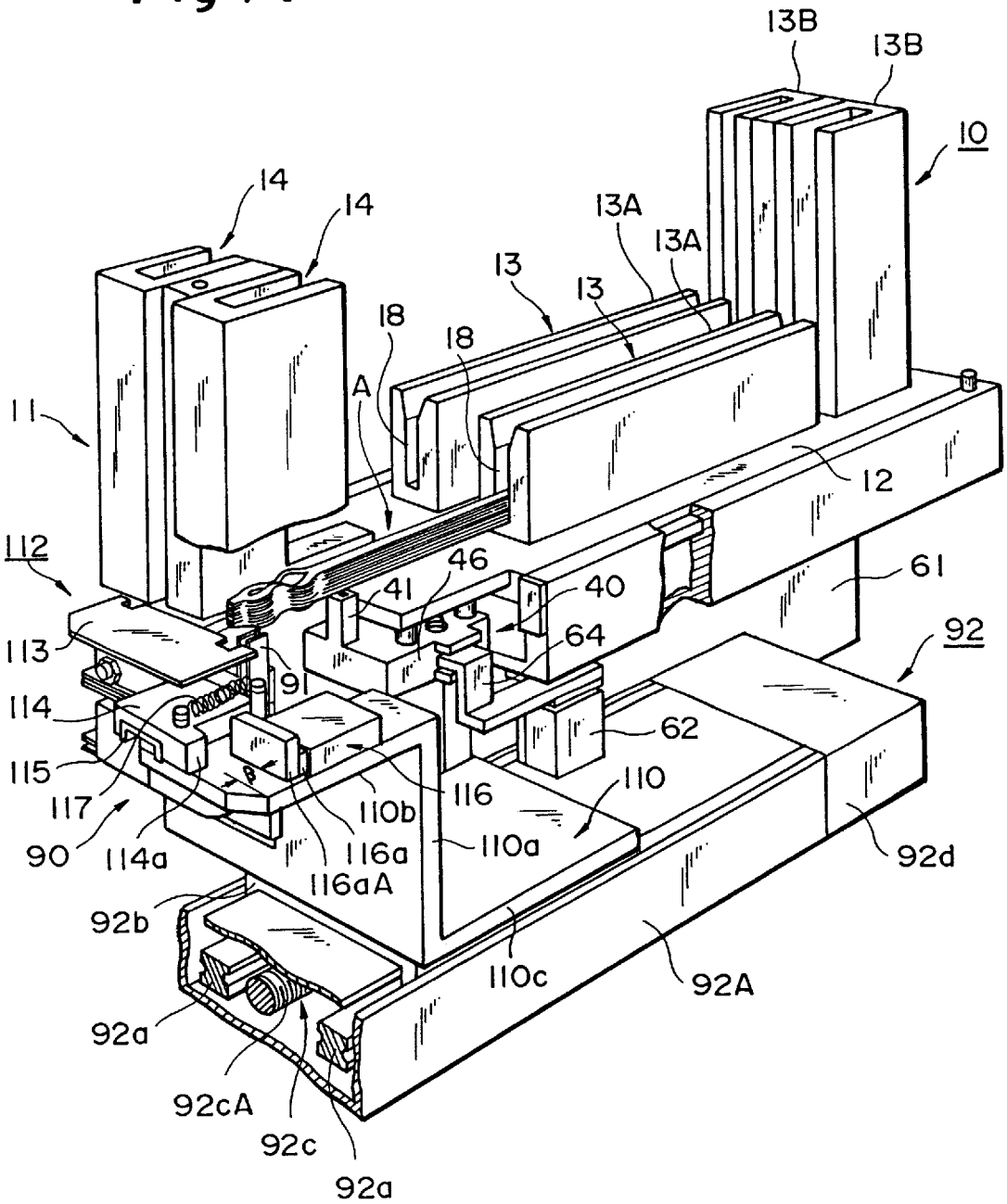
FIG. 1 is a perspective view showing an embodiment of the flat heald stocker to which the flat heald drawing apparatus according to the present invention is applied.
Figure 2:
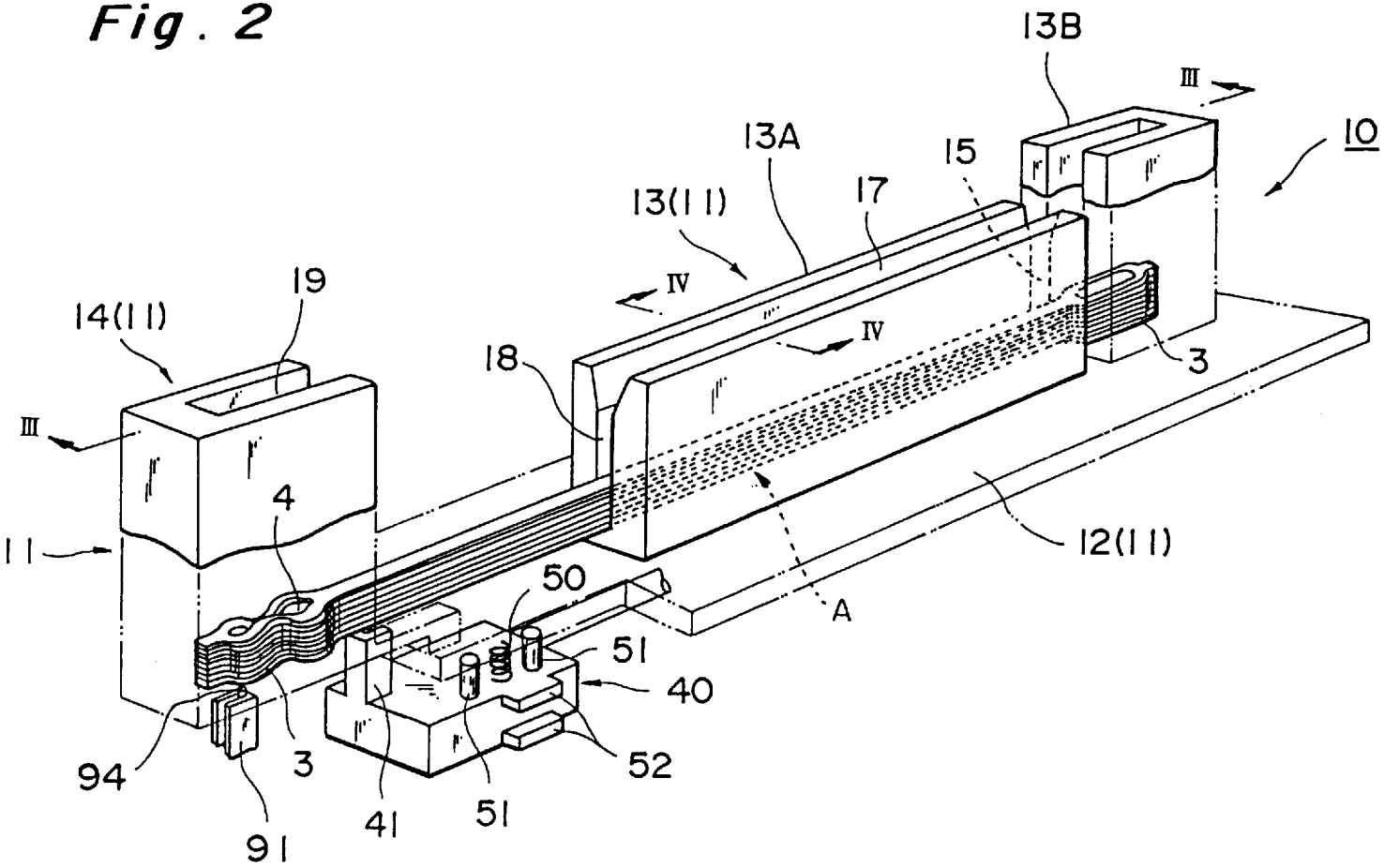
FIG. 2 is a perspective view representatively showing one stocker of the twin stockers shown in FIG. 1.
Figure 3:
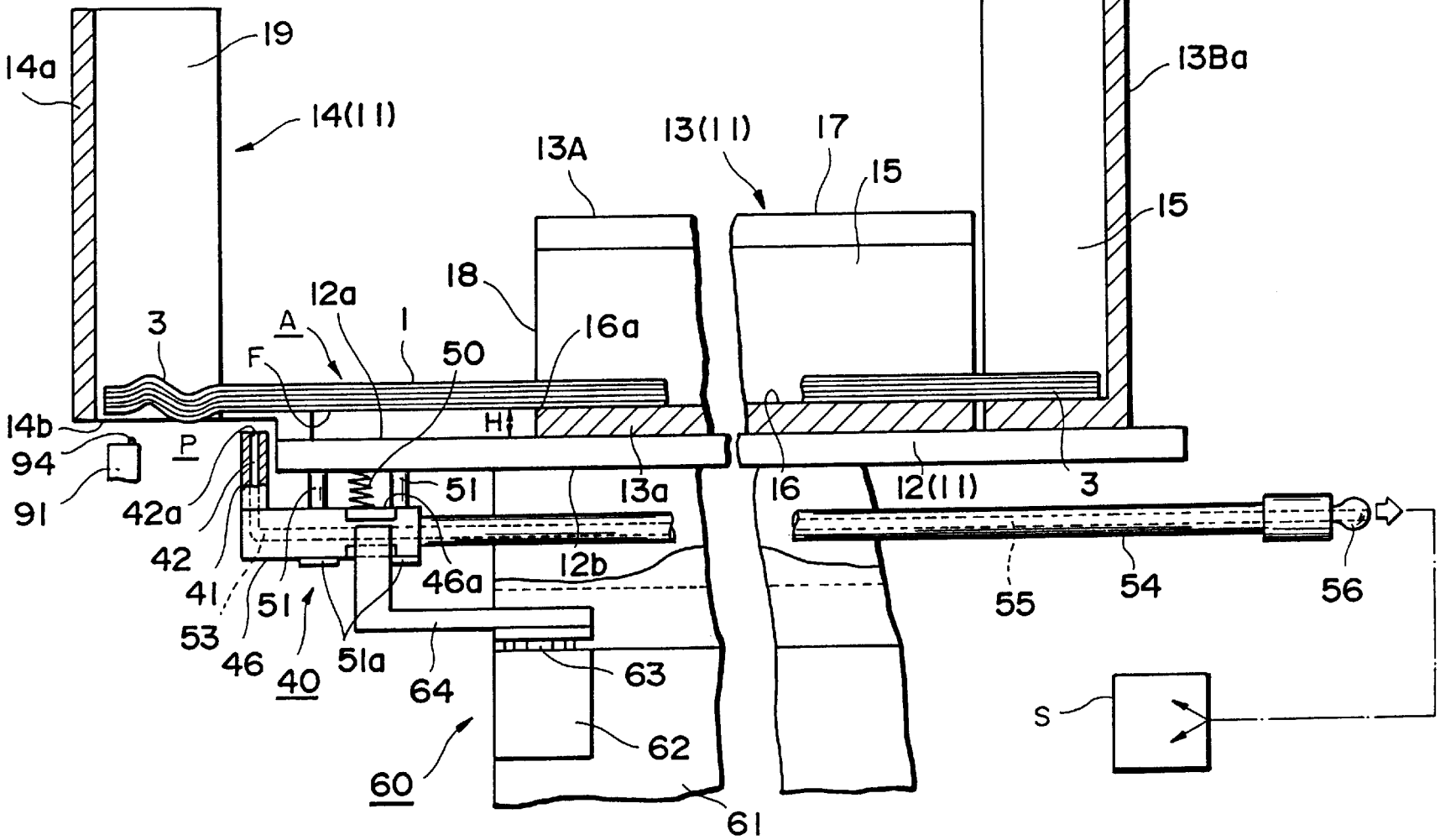
FIG. 3 is a sectional view taken along a line III—III in FIG. 2.

FIG. 1 is a perspective view showing a flat heald drawing apparatus applied to flat placement type twin stockers for flat healds. FIG. 2 is a perspective view representatively showing one stocker out of the twin stockers shown in FIG. 1. FIG. 3 is a sectional view taken along a line III—III in FIG. 2. As shown in FIGS. 1 and 2, a flat heald stocker 10 has a housing 11 for keeping flat healds A horizontal in a vertical stack. This housing 11 is formed in an elongated shape matching with the elongated shape of the flat healds A and is provided with a flat base 12, a frame 13 standing/fixed on this base 12, and a ring receiving frame 14 standing/fixed on the front portion of the flat base 12 and designed to store the front-side ring portions 3.

Figure 4:
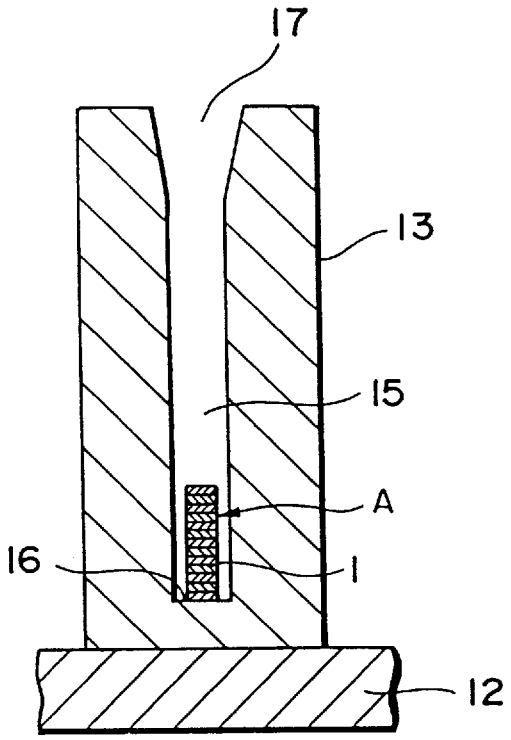
FIG. 4 is a sectional view taken along a line IV—IV in FIG. 2.

The frame 13 has a heald receiving slit 15 for stacking the flat healds A vertically. The heald receiving slit 15 extends vertically and has a heald support surface (to be referred to as a "heald receiving bottom surface" hereinafter) 16 extending horizontally (see FIG. 4). The frame 13 stores a portion of the flat heald A which is longer than ½ the length thereof, but does not support the front portion of flat heald A. When the centers of gravity of the flat healds A are positioned within the frame 13, the flat healds A can be stacked vertically in the frame 13 while they are cantilevered. The upper portion of the frame 13 is expanded in a funnel shape to form a heald refilling aperture 17 at this tip end, thereby allowing the flat heald A to be easily inserted through the aperture 17 while being kept in a horizontal position. In addition, an elongated heald drawing aperture 18 is formed in the front end of the frame 13. The heald drawing aperture 18 is the front end of the heald receiving slit 15.

A ring receiving slit 19 extending vertically is formed in the above ring receiving frame 14 to store the front-side ring portions 3. The upper, lower, and rear ends of the ring receiving slit 19 are open. The upper end of the ring receiving frame 14 is open to allow the front-side ring portion 3 to be inserted from above. The lower end of the ring receiving frame 14 is open to allow the lowermost flat heald A to be drawn from below. The rear end of the ring receiving frame 14 is opposed to the heald drawing aperture 18 and open to allow the flat heald A to be stored by cooperation between the ring receiving frame 14 and the frame 13.

As shown in FIG. 3, a predetermined spacing is secured between the heald receiving bottom surface 16 of the heald receiving slit 15 and an upper surface 12*a* of the flat base 12. With this structure, the flat heald A can be made to properly extend from the heald drawing aperture 18 of the frame 13. In addition, even when the front portion of the flat heald A is positioned above the flat base 12, the front portion of the flat heald A is not in contact with the base 12; the front portion of the flat heald A can be set in a floating state relative to the base 12.

Such a state is realized by a thickness H of a bottom surface 13*a* of the frame 13. By increasing/decreasing the thickness H of the bottom surface 13*a*, the floating amount of the flat heald A can be adjusted. The front portion of the flat heald A floats relative to the base 12 to prevent the front end portion of the lowermost flat heald A from touching the front end portion of the flat heald A located thereabove so as to reliably draw the lowermost flat heald A when the front end portion of the lowermost flat heald A is forcibly drawn downward by a vacuum suction means or the like to separate the lowermost flat heald A from the remaining flat healds A.

As shown in FIGS. 2 and 3, the frame 13 having the heald receiving slit 15 comprises a rod receiving portion 13A for storing the rod portion 1 of the flat heald A, and a ring receiving portion 13B for storing the rear-side ring portion 3. Note that the rod receiving portion 13A and the ring receiving portion 13B may be integrally formed. The ring receiving portion 13B of the frame 13 and the ring receiving frame 14 for storing the front-side ring portion 3 are positioned to hold a mirror-image relationship. In addition, since a bottom surface 14*b* of a front wall 14*a* formed on the ring receiving frame 14 is set to be lower than the heald receiving bottom surface 16, the flat healds A stacked in the housing 11 can be prevented from slipping off from the front wall 14*a*. Furthermore, since the front wall 14*a* of the ring receiving frame 14 is opposed to a rear wall 13Ba of the ring receiving portion 13B through the flat heald A, the flat heald A can be prevented from slipping off horizontally from the housing 11.

(Flat Heald Separating Mechanism)

As shown in FIGS. 1 to 3 and 5, the flat heald stocker 10 has a flat heald separating mechanism 40 for drawing the lowermost flat heald A more reliably. The flat heald separating mechanism 40 has a suction head 41 provided at the front portion of the housing 11 and designed to suck the rod portion 1 of the lowermost flat heald A from below. The suction head 41 moves vertically to forcibly attach the lowermost ring portion 3 to a magnetic head 91 to be described later. In addition, the suction head 41 is disposed between the magnetic head 91 and the front end of the base 12 at a position before a front end 16*a* of the heald receiving bottom surface (heald support surface) 16, and also positioned immediately below the rod portion 1 near the front-side ring portion 3.

A suction hole 42 extending vertically is formed in the suction head 41. A suction port 42*a* is formed in the tip end face of the suction hole 42 to be exposed toward the rod portion 1. This suction port 42*a* is a circular opening, has a diameter smaller than a width W (see FIG. 24) of a flat surface F of the rod portion 1, and is positioned to oppose the flat surface F. With this structure, when the flat surface F of the rod portion 1 comes in tight contact with the suction port 42*a*, the suction port 42*a* does not protrude from the flat surface F to improve the contact between the flat surface F and the tip end face of the suction head 41. Note that the suction force can be reduced by decreasing the distance between the front end 16*a* of the heald receiving bottom surface 16 serving as a fulcrum and the suction port 42*a* of the suction head 41 according to the principle of the lever.

The flat heald separating mechanism 40 has a base portion 46 for securing the suction head 41 in a standing state. This base portion 46 is located below the base 12. A spring seating recess 47 is formed in an upper surface 46*a* of this base portion 46. Pin insertion holes 48 are formed in the base portion 46 on both sides of the recess 47 to vertically extend through the base portion 46 (see FIG. 5). The upper surface 46*a* of the base portion 46 and a bottom surface 12*b* of the base 12 are coupled through a compression spring 50 seated in the recess 47. This compression spring 50 urges the base portion 46 in the direction away from the base 12. Two pins 51 extend downward from the bottom surface 12*a* of the base 12 and are inserted into the pin insertion holes 48 of the base portion 46. Stopper portions 51*a* consisting of snap rings or the like are provided at the lower ends of the pins 51. With this structure, the base portion 46 can be moved vertically in the extending direction of the pins 51 under the elasticity of the compression spring 50.

Figure 5:
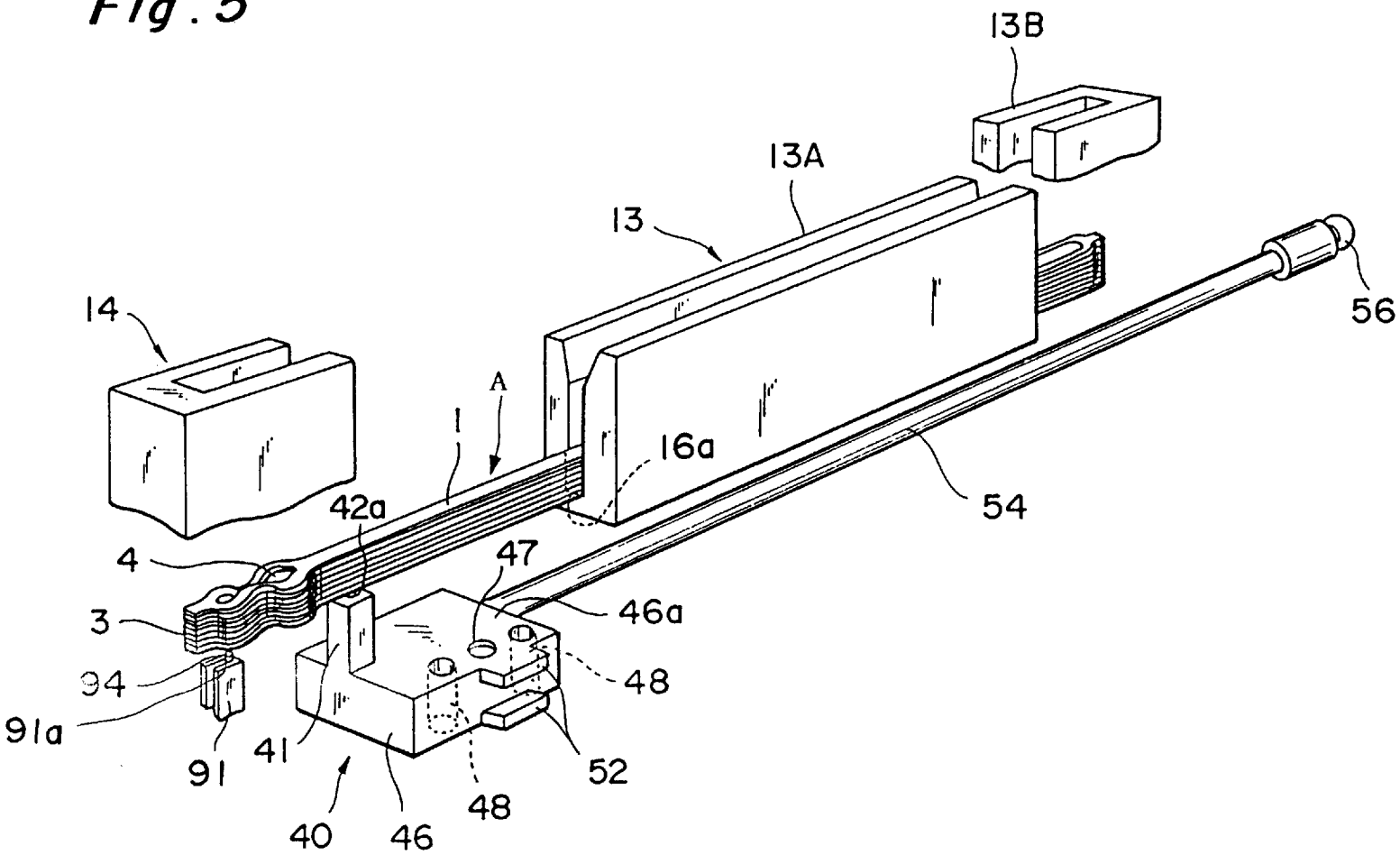
FIG. 5 is a perspective view showing a flat heald separating mechanism.

As shown in FIG. 3, a suction hole 53 is formed in the base portion 46 to extend horizontally. One end of the suction hole 53 communicates with the suction hole 42 of the suction head 41, and the other end of the suction hole 53 communicates with a suction hole 55 of a flexible suction pipe 54 fixed to an end of the base portion 46. The suction pipe 54 extends horizontally along the base 12 and moves vertically following the base portion 46. A connector portion 56 of the suction pipe 54 extends from the rear end of the base 12 and is connected to a vacuum source S as a vacuum pump. With this structure, when the vacuum source S is actuated, evacuation can be performed by the suction port 42*a* through the suction holes 42, 53, and 55. As shown in FIG. 5, a pair of upper and lower tongues 52 to be engaged with an actuator member 64 (to be described later) extend from the base portion 46. The upper tongue 52 is pushed upward by the distal end of the actuator member 64. When the base portion 46 is not smoothly moved downward by the compression spring 50, the lower tongue 52 is pushed downward by the distal end of the actuator member 64.

As shown in FIG. 3, the base portion 46 is moved vertically by a driving means 60. This driving means 60 comprises an air cylinder 62 fixed to a support stage 61 for supporting the base 12 of the housing 11, a cylinder rod 63 designed to reciprocate vertically in a predetermined stroke relative to the air cylinder 62 and be prevented from rotating, and the actuator member 64 fixed to the tip of the cylinder rod 63 and designed to engage with the upper and lower tongues 52 of the base portion 46 at the tip thereof. Accordingly, the base portion 46 can be moved vertically by a predetermined amount in accordance with the stroke amount of the cylinder rod 63. When the tip of the actuator member 64 is inserted between the upper and lower tongues 52, there is a play given to the actuator member 64 between the upper and lower tongues 52, so that the stroke amount of the cylinder rod 63 is not equal to the ascent amount of the base portion 46. If the suction head 41 is designed to be directly driven by the air cylinder 62, there is no need to use the base portion 46 and the actuator member 64, and there is no need to give the play between the upper and lower tongues 52 and the actuator member 64, either.

(Flat Heald Drawing Apparatus)

A drawing apparatus 90 for drawing the magnetic flat healds A vertically stacked in the above flat heald stocker 10 one by one from the lowermost position will be described next.

As shown in FIGS. 1 and 6 to 9, the drawing apparatus 90 comprises the heald drawing magnetic head 91 constituted by an iron core which moves vertically and is part of an electromagnet, a non-magnetic drawing pin 94 extending from a tip end face 91*a* of the magnetic head 91, a translating unit 92 serving as a first driving means for moving the magnetic head 91 horizontally, and a piston mechanism 93 serving as a second driving means for moving the magnetic head 91 vertically.

Figure 6:
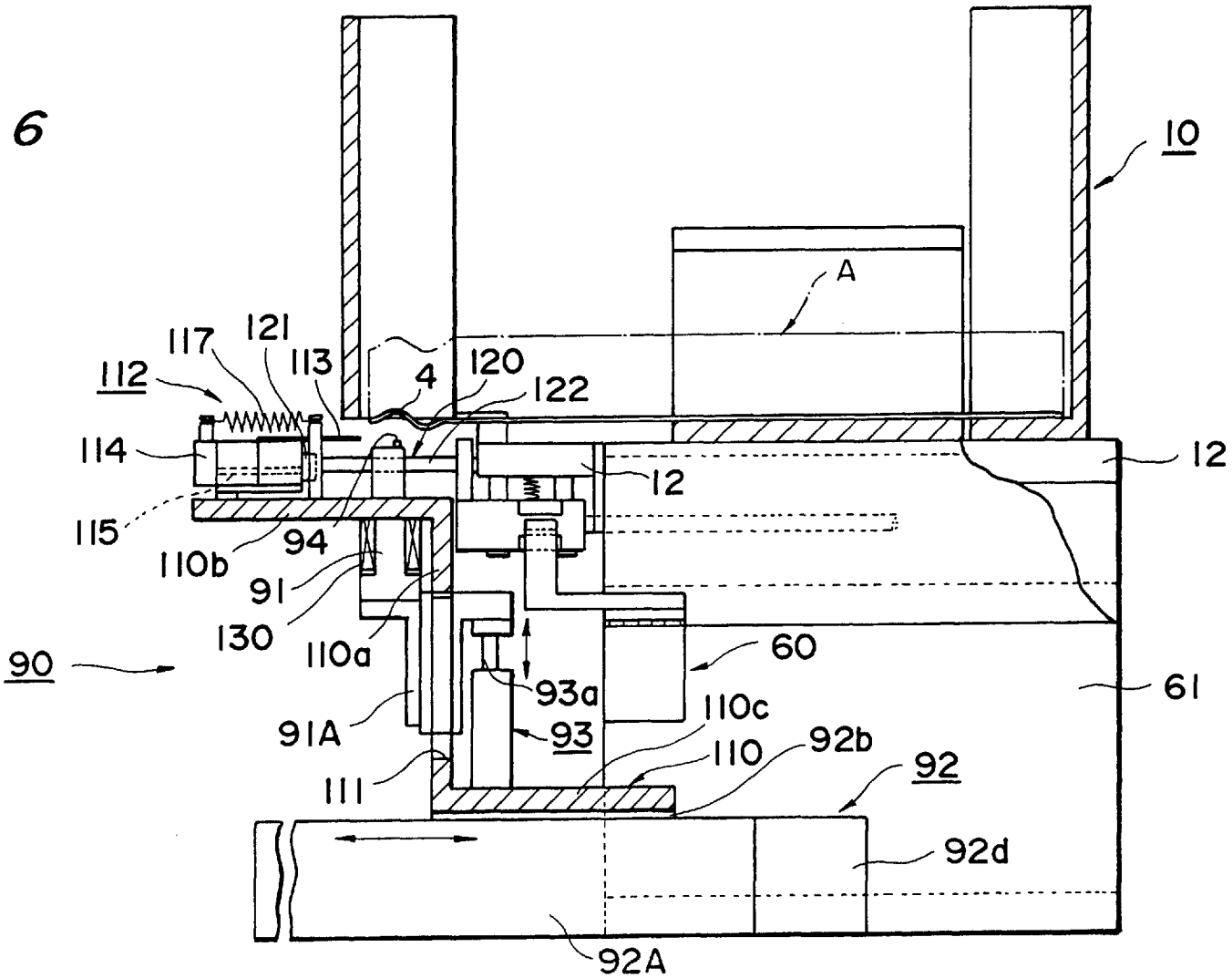
FIG. 6 is a side view showing the flat heald stocker to which the flat heald drawing apparatus according to the present invention is applied.
Figure 7:
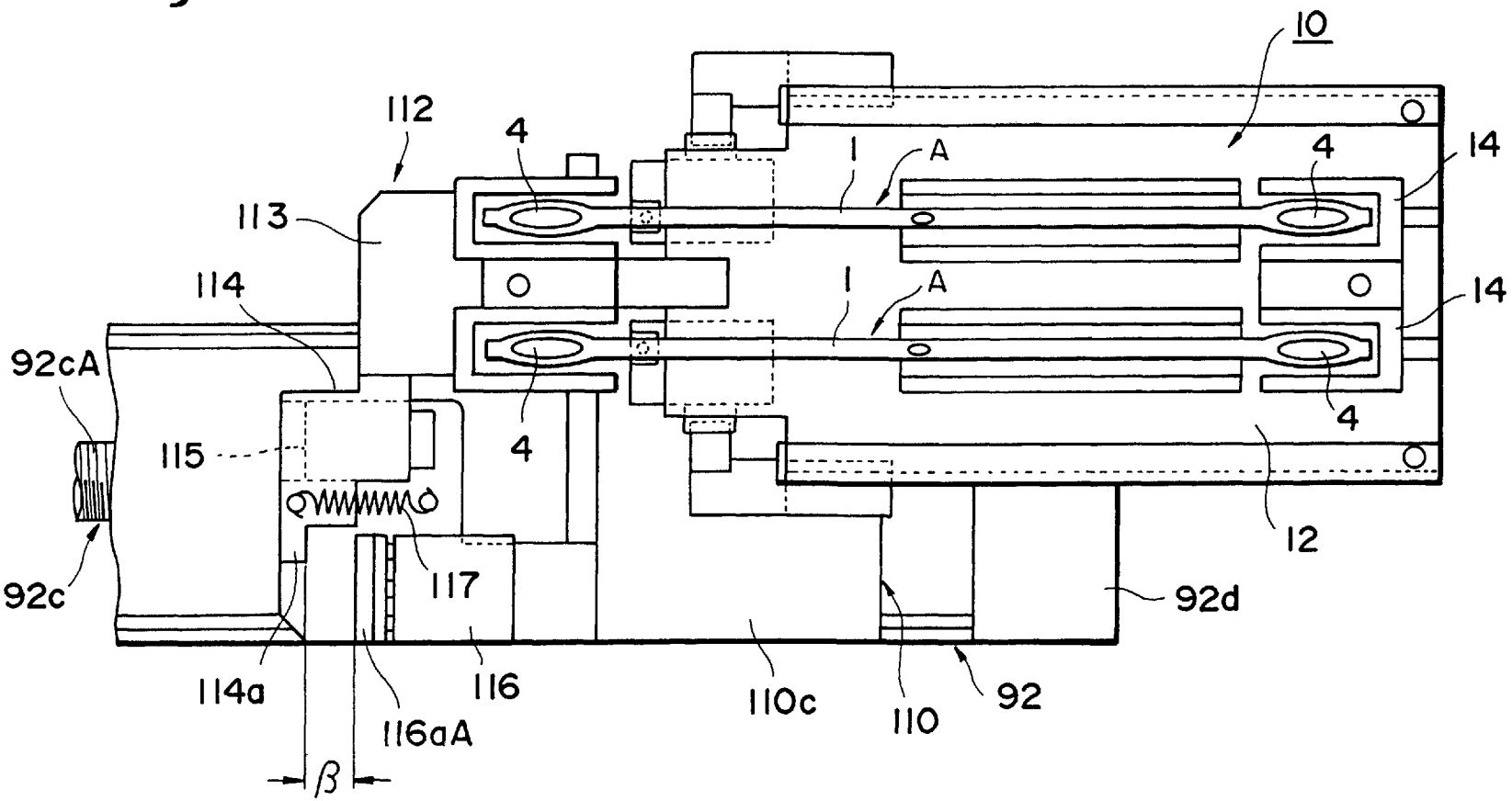
FIG. 7 is a plan view of the stocker in FIG. 6.
Figure 8:
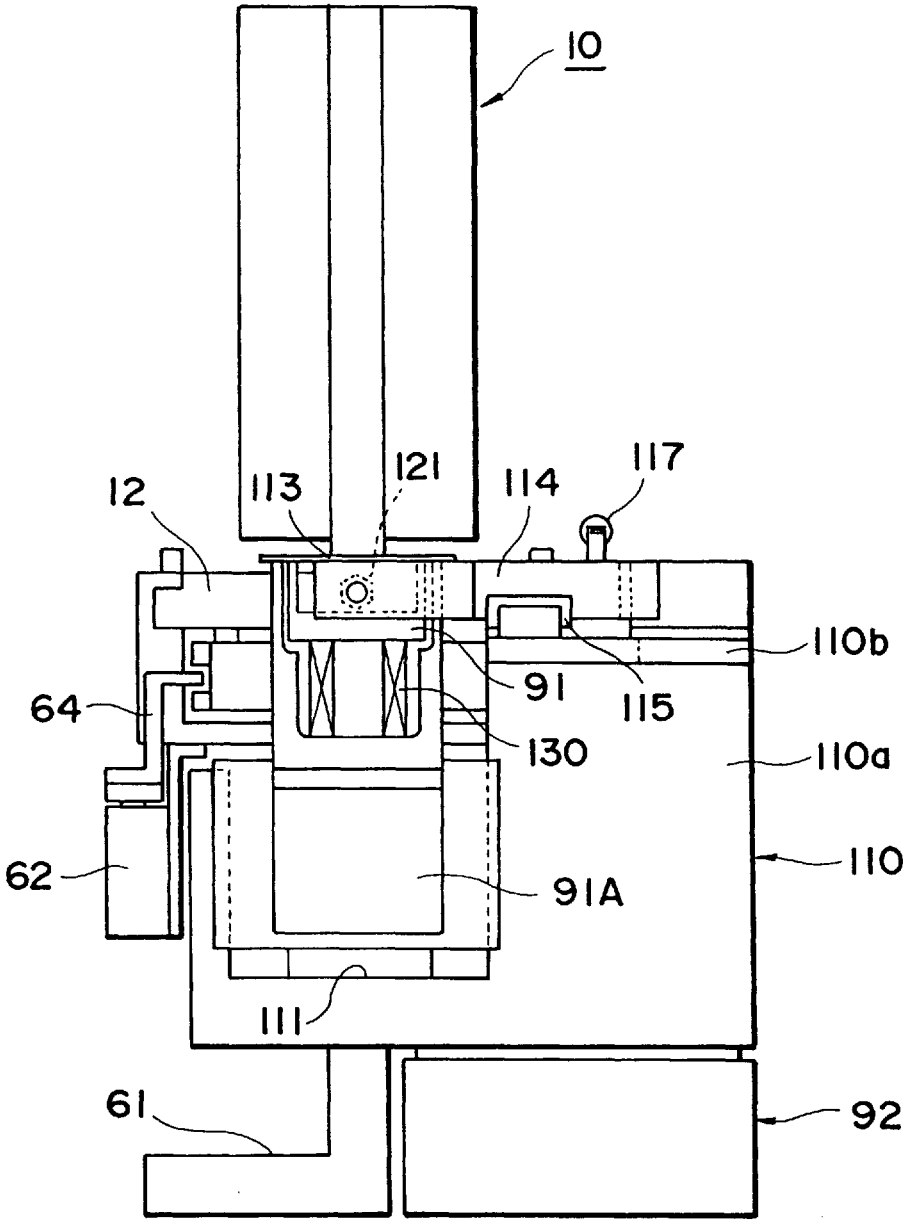
FIG. 8 is a front view of the stocker in FIG. 6.
Figure 9:
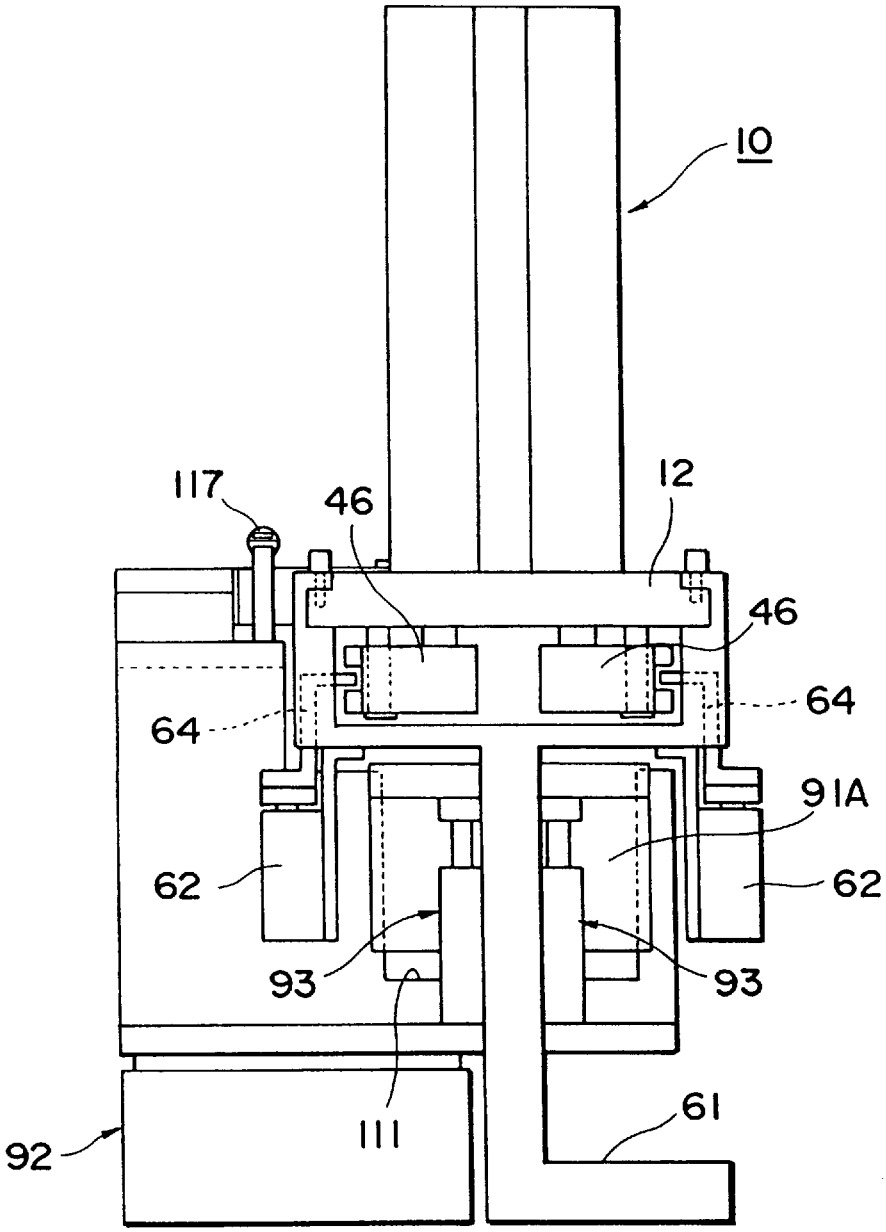
FIG. 9 is a rear view of the stocker in FIG. 6.

As shown in FIGS. 5 and 6, the magnetic head 91 is positioned below the guide hole 4 at the lowermost front-side ring portion 3 stored in the flat heald stocker 10 to draw the lowermost flat heald A. In addition, the non-magnetic drawing pin 94 is fixed to the tip end face (attracting face) 91*a* of the magnetic head 91 to protrude. This drawing pin 94 is tall enough to be inserted into the guide hole 4 and hooked on at least the ring portion 3.

As shown in FIGS. 1 and 6 to 9, the drawing apparatus 90 has the translating unit 92 as the first driving means for moving the above magnetic head 91 horizontally. This translating unit 92 is installed below the flat heald stocker 10 and located adjacent to a support stage 61 for supporting the base 12 of the housing 11. The translating unit 92 is composed of guide rails 92*a* housed in a main body 92A and set along the extending direction of the flat heald A, a table 92*b* designed to slide along the guide rails 92*a*, and a driving mechanism 92*c* housed in the main body 92A and designed to move the table 92*b*. The driving mechanism 92*c* is comprised of a screw shaft 92*c*A extending along the guide rails 92*a*, a nut portion (not shown) meshed with the screw shaft 92*c*A and fixed to the table 92*b*, and a servo motor 92*d* for driving the screw shaft 92*c*A. With this structure, when this servo motor 92*d* is driven, the table 92*b* translates along the main body 92A. Since the stop position of the table 92*b* is electrically controlled by a control system, the apparatus is ready for a wide variety of the flat healds A sufficiently. The translating unit 92 may be a linear motor guide.

A lower part 110*c* of a moving base 110 is fixed on the table 92*b*, and a support portion 91A of the magnetic head 91 is mounted on an upright portion 110*a* of the moving base 110 so that the support portion 91A slides vertically along a guide groove 111 formed in the upright portion 110*a*. The piston mechanism 93 as the second driving means is fixed in a standing state to a lower part 110*c* of the moving base 110, and a piston rod 93*a* of this piston mechanism 93 is fixed to the support portion 91A of the magnetic head 91. Therefore, the piston mechanism 93 can translate together with the moving base 110 and can move the magnetic head 91 vertically. By moving the piston rod 93*a* vertically, the drawing pin 94 can be freely inserted/removed in/from the front-side guide hole 4 at the lowermost position.

An upper part 110*b* of the moving base 110 is provided with a drop preventing mechanism 112 which is engaged with the drawing pin 94 in the process of drawing the flat heald A to hook/hold the lowermost ring portion 3 on the drawing pin 94. This drop preventing mechanism 112 comprises a plate-like drop preventing portion 113 located to face the drawing pin 94 in front thereof in the drawing direction of the flat heald A and provided in the upper part 110*b* of the moving base 110, the drop preventing portion 113 being designed to be engaged with the drawing pin 94 in the process of drawing the flat heald A so as to hook/hold the ring portion 3 on the drawing pin 94, a moving base portion 114 for holding the drop preventing portion 113 on the moving base 110, a linear guide 115 for sliding and guiding the moving base portion 114 on the upper part 110*b* of the moving base 110, a piston mechanism 116 fixed to the upper part 110*b* of the moving base 110 and designed to translationally move the moving base portion 114, and a tension spring 117 stretched between the moving base portion 114 and the upper part 110*b* of the moving base 110.

A push portion 116*a*A provided at the tip of a piston rod 116*a* in the piston mechanism 116 is opposed to an engaging projection 114*a* provided in the moving base portion 114. The push portion 116*a*A of the piston rod 116*a* is spaced by the distance β from the engaging projection 114*a* of the moving base portion 114. When the moving base 110 is moved by β, the piston mechanism 116 also moves by β following the moving base 110, but the moving base portion 114 keeps its position without following the movement of the moving base 110, because it is attached to the moving base 110 through the tension spring 117 and the guide rails.

As a result of such movement, the push portion 116*a*A of the piston mechanism 116 comes in contact with the engaging projection 114*a* of the moving base portion 114 and at the same, the drawing pin 94 of the magnetic head 91 moves by β by the moving base 110 comes in contact with the drop preventing portion 113 free from the movement of β of the moving base 110. Accordingly, the ring portion 3 can be sandwiched between the tip end face 91*a* of the magnetic head 91 and the drop preventing portion 113, and therefore, the ring portion 3 is prevented from dropping off from the drawing pin 94 while the flat heald A is further drawn. Even if an unexpected accident occurs in the magnetic head 91 to result in losing the magnetic force, the ring portion 3 will be kept from dropping off from the drawing pin 94.

When the piston rod 116*a* is projected in this state to advance the moving base portion 114 in the drawing direction, the engagement between the drop preventing portion 113 and the drawing pin 94 can be released. By retracting the piston rod 116*a*, the spring force of the tension spring 117 moves the moving base portion 114 back, thereby returning the drop preventing portion 113 to the original position.

The drop preventing mechanism 112 is provided with a positioning portion 120. The positioning portion 120 is used to keep the stop position of the drop preventing portion 113 always constant relative to the drawing pin 94 while the lowermost flat heald A is drawn out by the drawing pin 94. This positioning portion 120 comprises a stop pin 121 attached to the moving base portion 114, a projecting amount of which can be finely adjusted by a screw means, and a stopper rod 122 projecting from the front end of the base 12. Accordingly, by urging the moving base portion 114 by the tension spring 117, and causing the stopper rod 122 to collide with the stop pin 121, the distance between the drawing pin 94 and the drop preventing portion 113 can always be kept constant before the flat heald A is drawn by the magnetic head 91.

(Operation)

A flat heald drawing method will be described next in association with the flat heald separating mechanism 40.

Figure 10:
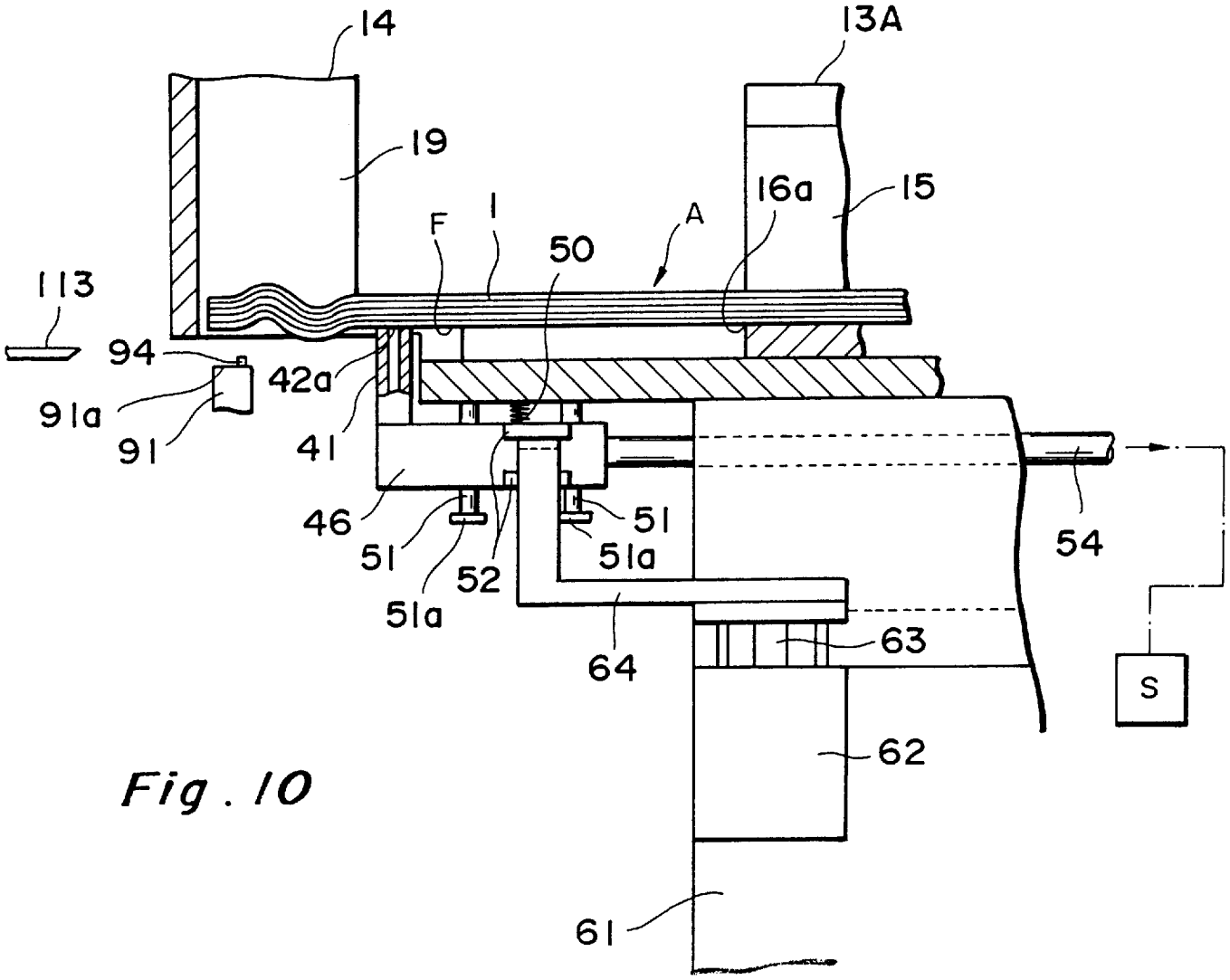
FIG. 10 is a side view showing a state in which the suction head of the flat heald separating mechanism is moved upward to bring the tip end face of the suction head close to the rod portion.

As shown in FIG. 10, when the air cylinder 62 is driven to move the actuator member 64 upward, the upper tongue 52 is pushed upward by the distal end of the actuator member 64. As a result, the base portion 46 moves upward by a predetermined amount against the spring force of the compression spring 50. At this time, the tip end face of the suction head 41 is brought very close to or into contact with the flat surface F of the rod portion 1 of the lowermost flat heald A. Thereafter, the vacuum source S is actuated to perform evacuation by the suction port 42*a* so as to cause the tip end face of the suction head 41 to vacuum-chuck the flat surface F of the rod portion 1.

Figure 11:
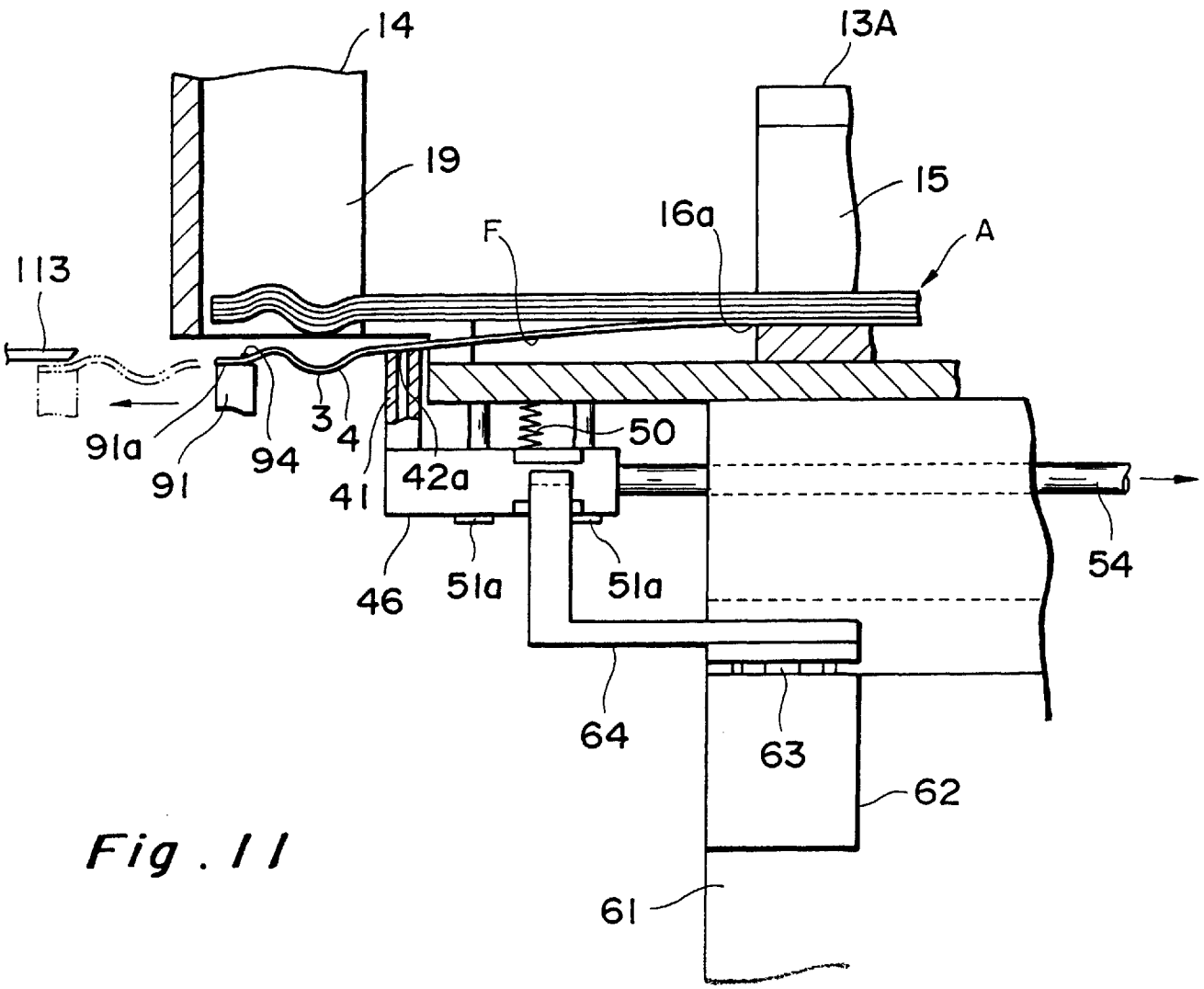
FIG. 11 is a side view showing a state in which the suction head is lowered to separate the lowermost flat heald from the remaining flat healds.

After this operation, as shown in FIG. 11, the air cylinder 62 is driven to lower the actuator member 64 so as to lower the base portion 46 to a predetermined position with the spring force of the compression spring 50. At this time, the lowermost flat heald A is separated while warping downward in a cantilevered state with the front end 16*a* of the heald receiving bottom surface (heald support surface) 16 serving as an fulcrum. The lowermost flat heald A is gradually peeled off and separated from the next flat heald A from the front end. Even if, therefore, the flat healds stick to each other with a machine oil or the like, the lowermost flat heald A is separated from the next flat heald A from the front end and can be easily separated with a slight force. In addition, the suction head 41 is kept lowered to insert the drawing pin 94 into the guide hole 4 of the ring portion 3 at the lowermost position. Thereafter, a coil 130 (see FIG. 6) wound on the magnetic head 91 is energized to magnetically attract the ring portions 3 to the tip end face 91*a* of the magnetic head 91, thus preparing for drawing of the flat heald A.

Figure 12:
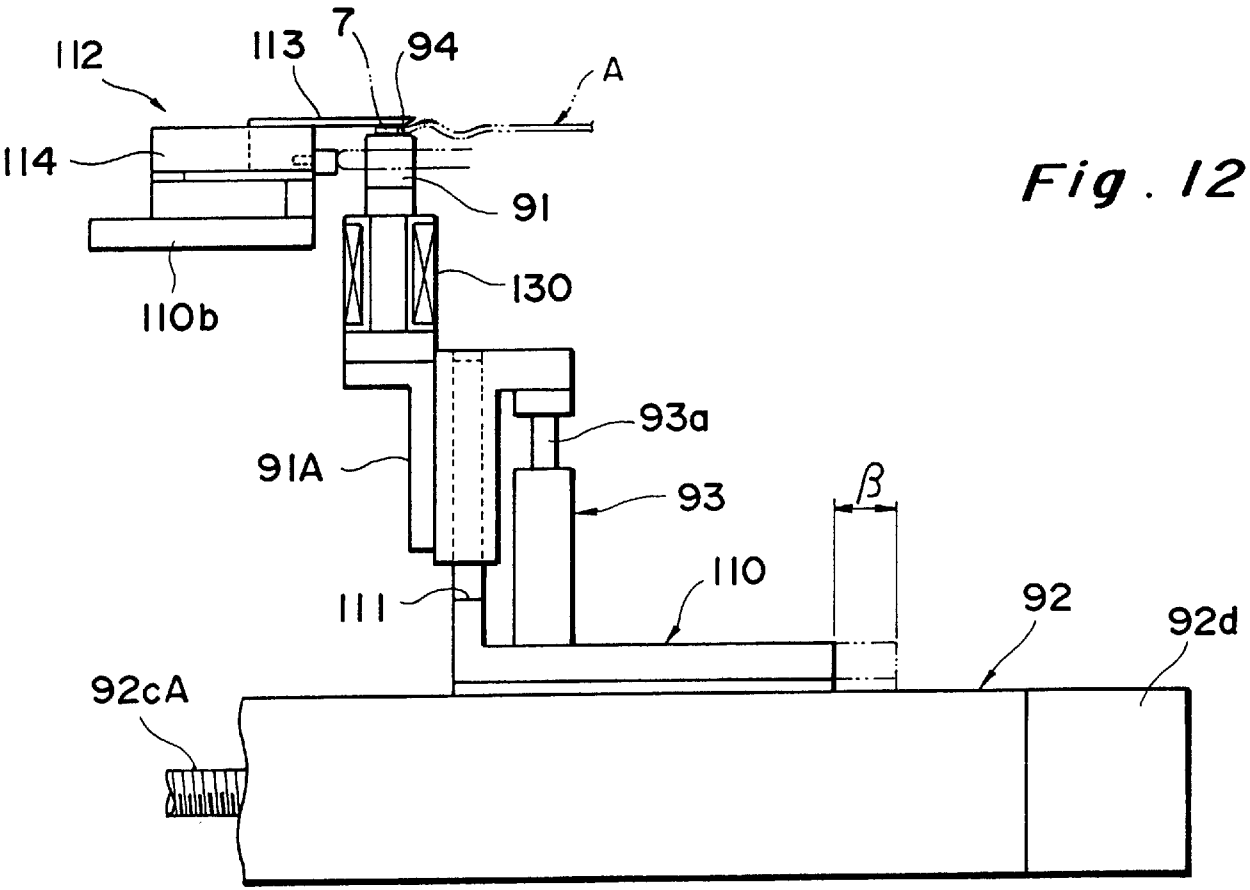
FIG. 12 is a side view showing a state in which the lowermost flat heald is drawn to a drop preventing portion.
Figure 13:
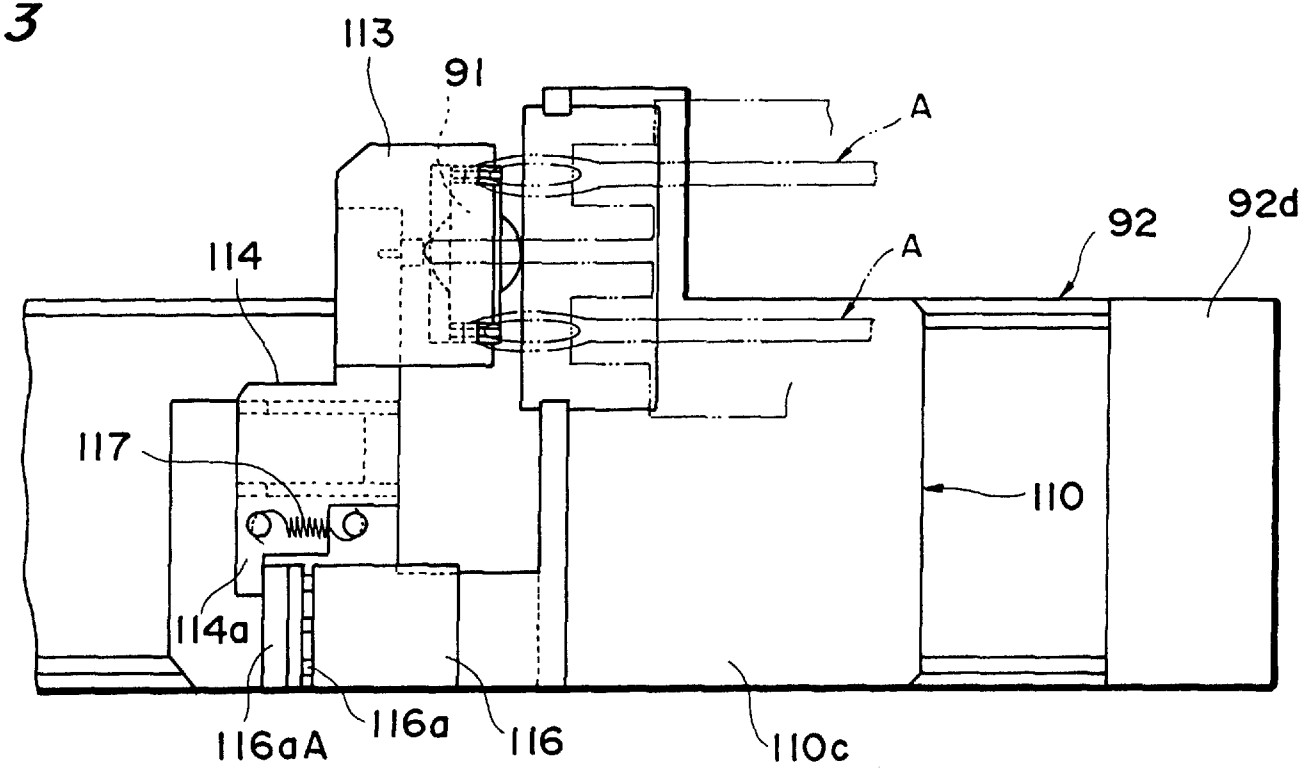
FIG. 13 is a plan view of FIG. 12.

In this state, as shown in FIGS. 12 and 13, the servo motor 92*d* of the driving mechanism 92*c* in the translating unit (first driving means) 92 is driven to rotate the screw shaft 92*c*A in a predetermined direction, thereby advancing the moving base 110 horizontally by β. As a result, the lowermost flat heald A is drawn by β by the drawing pin 94 and at the same time, the lowermost ring portion 3 is kept hooked/held on the magnetic head 91 owing to the engagement between the drawing pin 94 and the drop preventing portion 113, thereby properly preventing the lowermost ring portion 3 from dropping off from the magnetic head 91 while the flat heald A is further drawn. When the moving base 110 advances horizontally by β, the push portion 116*a*A of the piston rod 116*a* comes in contact with the engaging projection 114*a* of the moving base portion 114, thereby preparing for the movement of the drop preventing portion 113.

Figure 14:
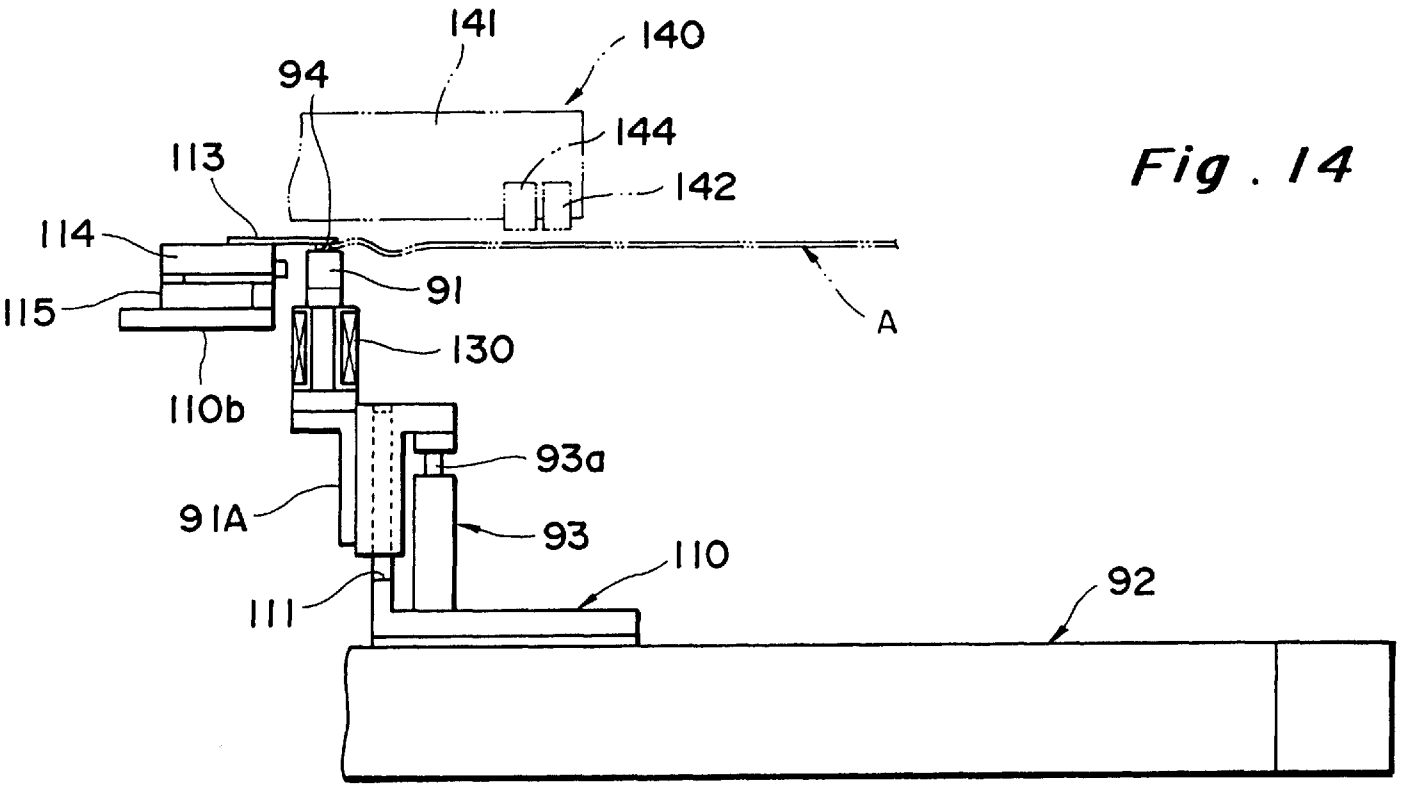
FIG. 14 is a side view showing the process of drawing a flat heald by using a magnetic head.
Figure 15:
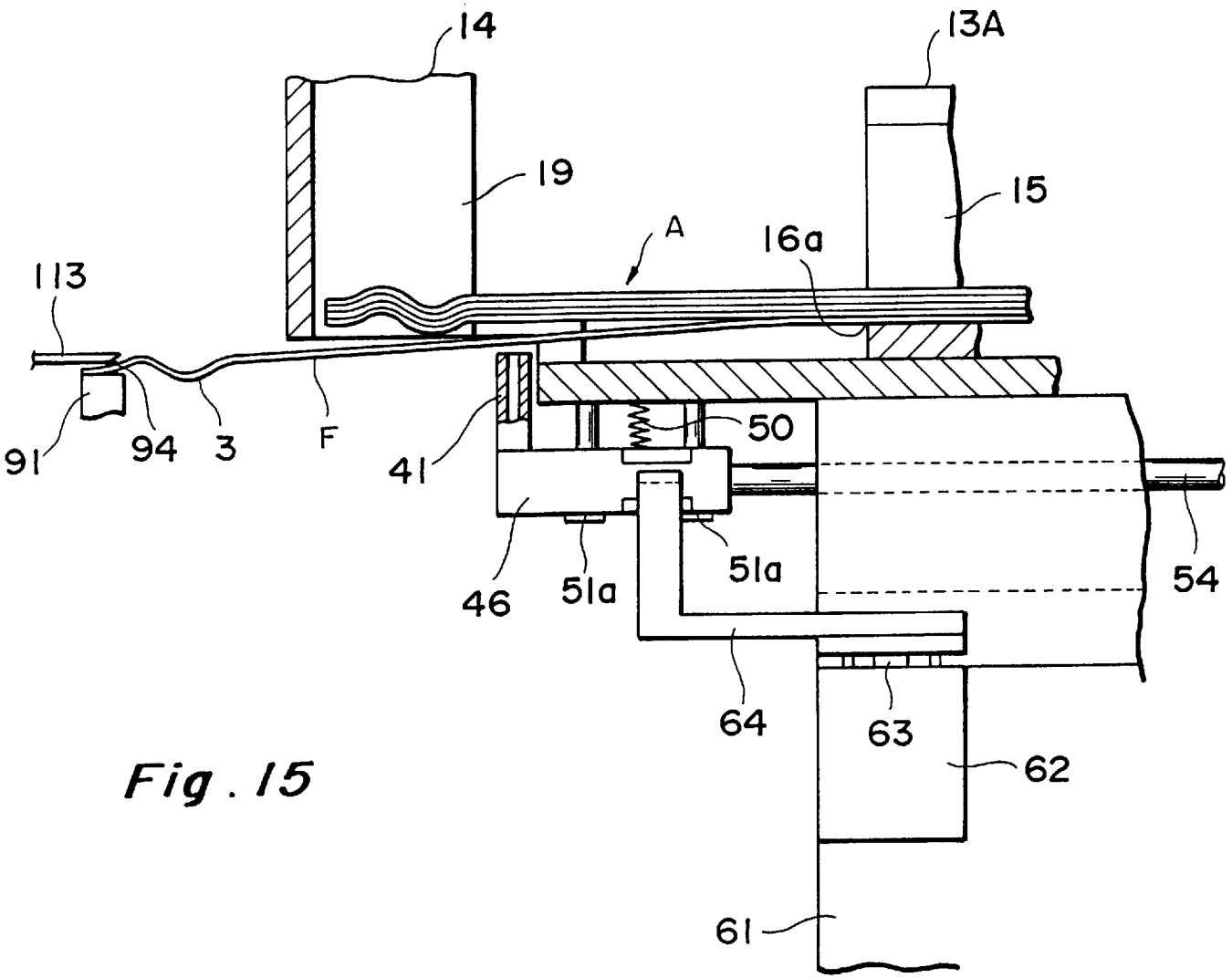
FIG. 15 is a sectional view showing a state in which the lowermost flat heald is drawn out.
Figure 16:
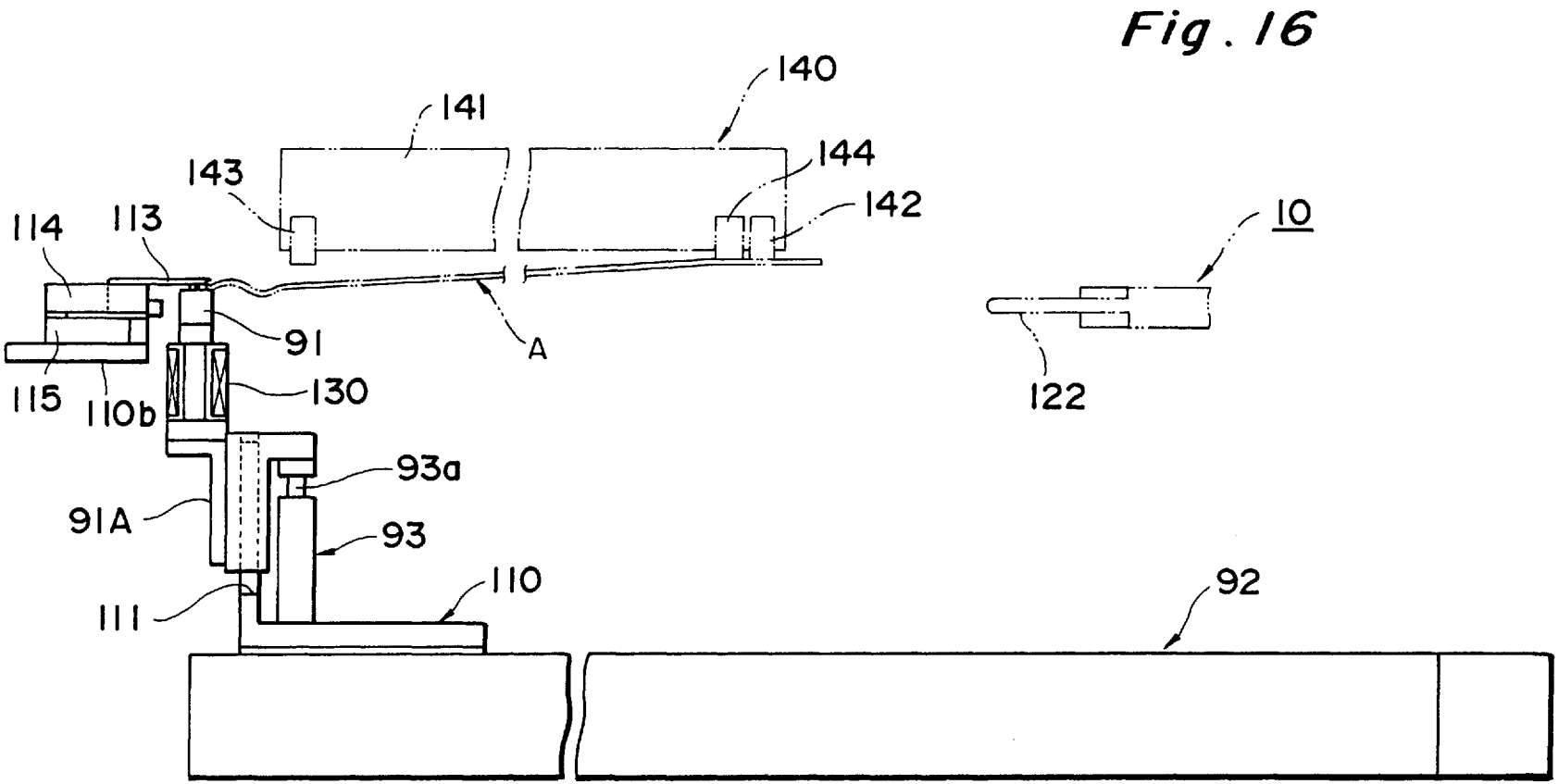
FIG. 16 is a side view showing a state in which a flat heald is completely drawn out from the stocker.
Figure 17:
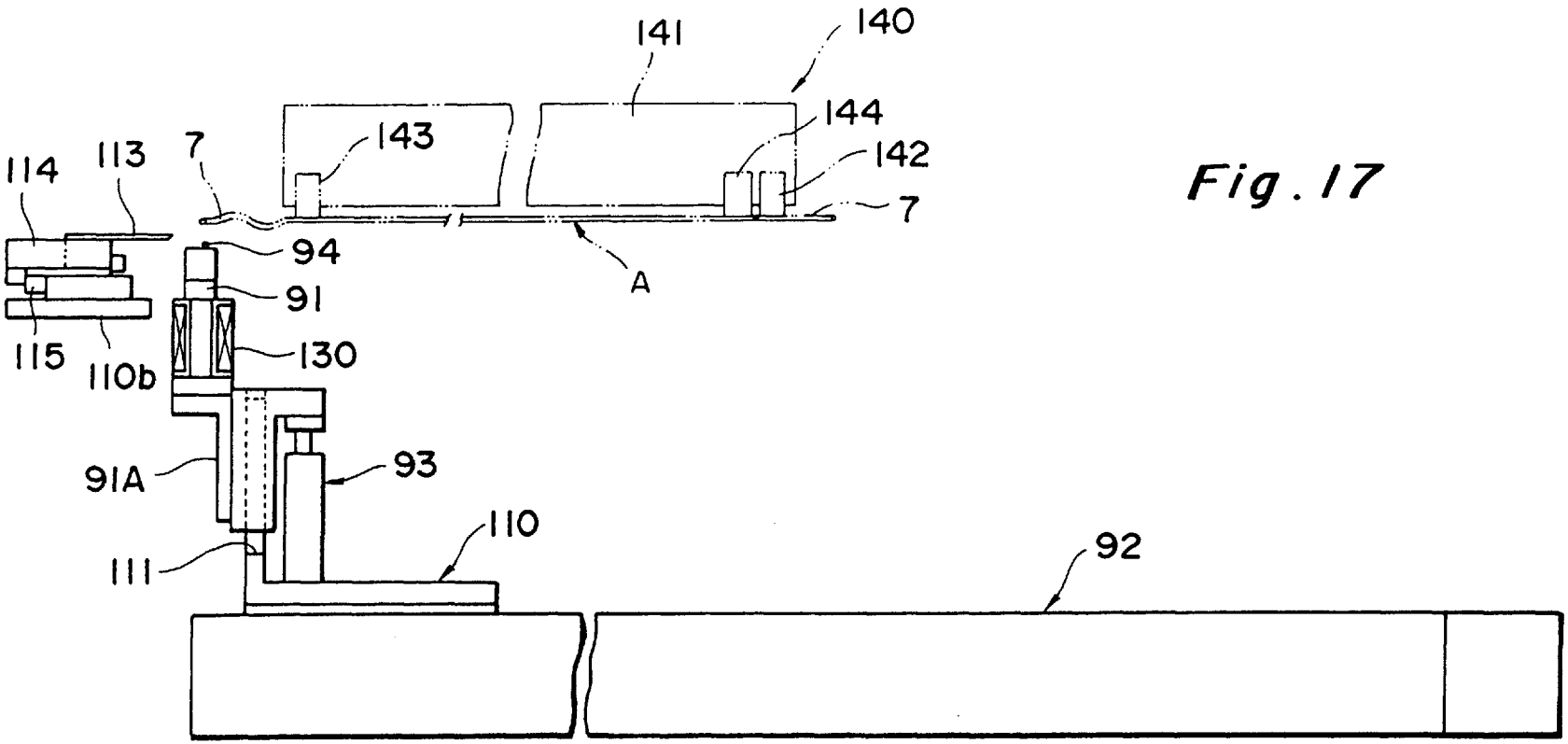
FIG. 17 is a side view showing a state in which a drawn flat heald is transferred to a standing block.
Figure 18:
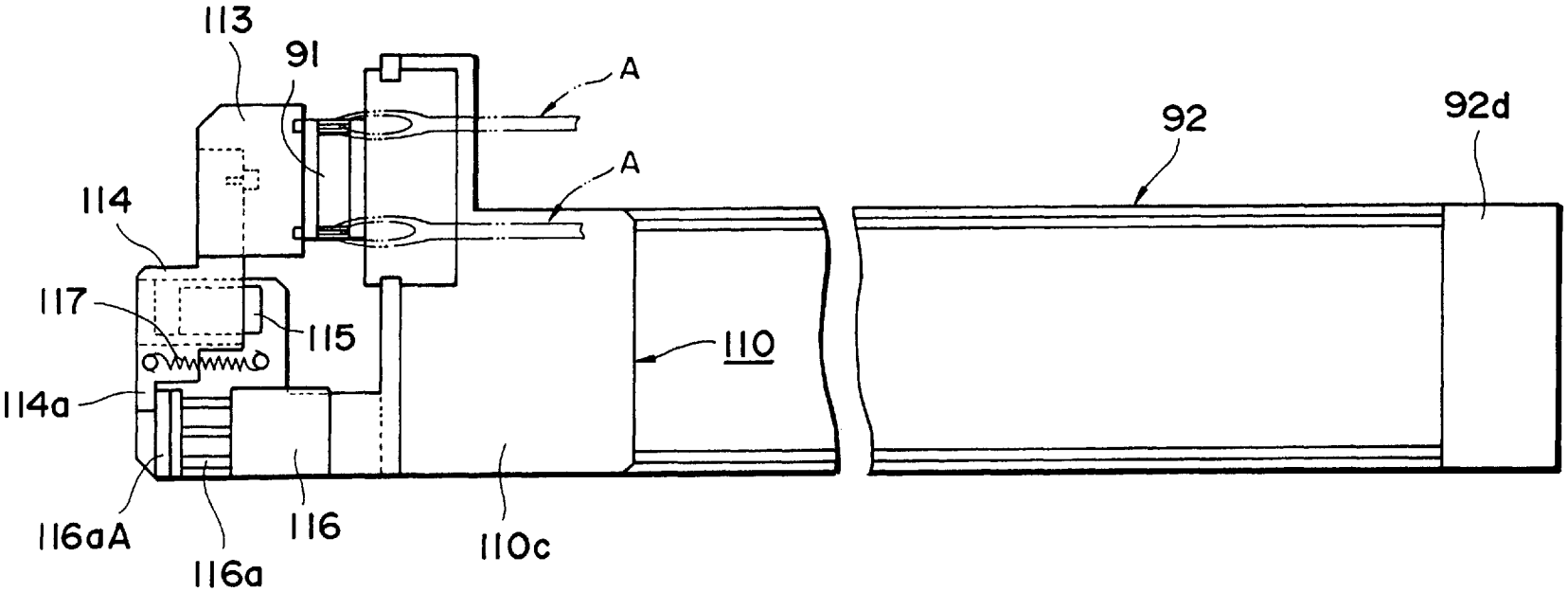
FIG. 18 is a plan view of FIG. 17.

After this operation, the driving mechanism 92*c* shown in FIG. 1 is actuated to advance the moving base 110 as shown in FIGS. 14 and 15 while the lowermost ring portion 3 is hooked/held on the magnetic head 91 by cooperation of the drawing pin 94 with the drop preventing portion 113 and by the magnetic attracting force of the magnetic head 91. After the lowermost flat heald A is drawn out completely from the flat heald stocker 10 as shown in FIG. 16, the piston rod 116*a* is projected to advance the moving base portion 114 in the drawing direction against the spring force of the tension spring 117, as shown in FIGS. 17 and 18, thereby releasing the engagement between the drop preventing portion 113 and the drawing pin 94. At this time, the electric current to the coil 130 disposed around the magnetic head 91 is switched to the damped alternating current for degaussing, whereby the ring portion 3 of the flat heald A can be released from the magnetic head 91 while the remanent magnetization of the flat heald A magnetized by the magnetic head 91 is erased when magnetically attracted thereto.

Figure 19:
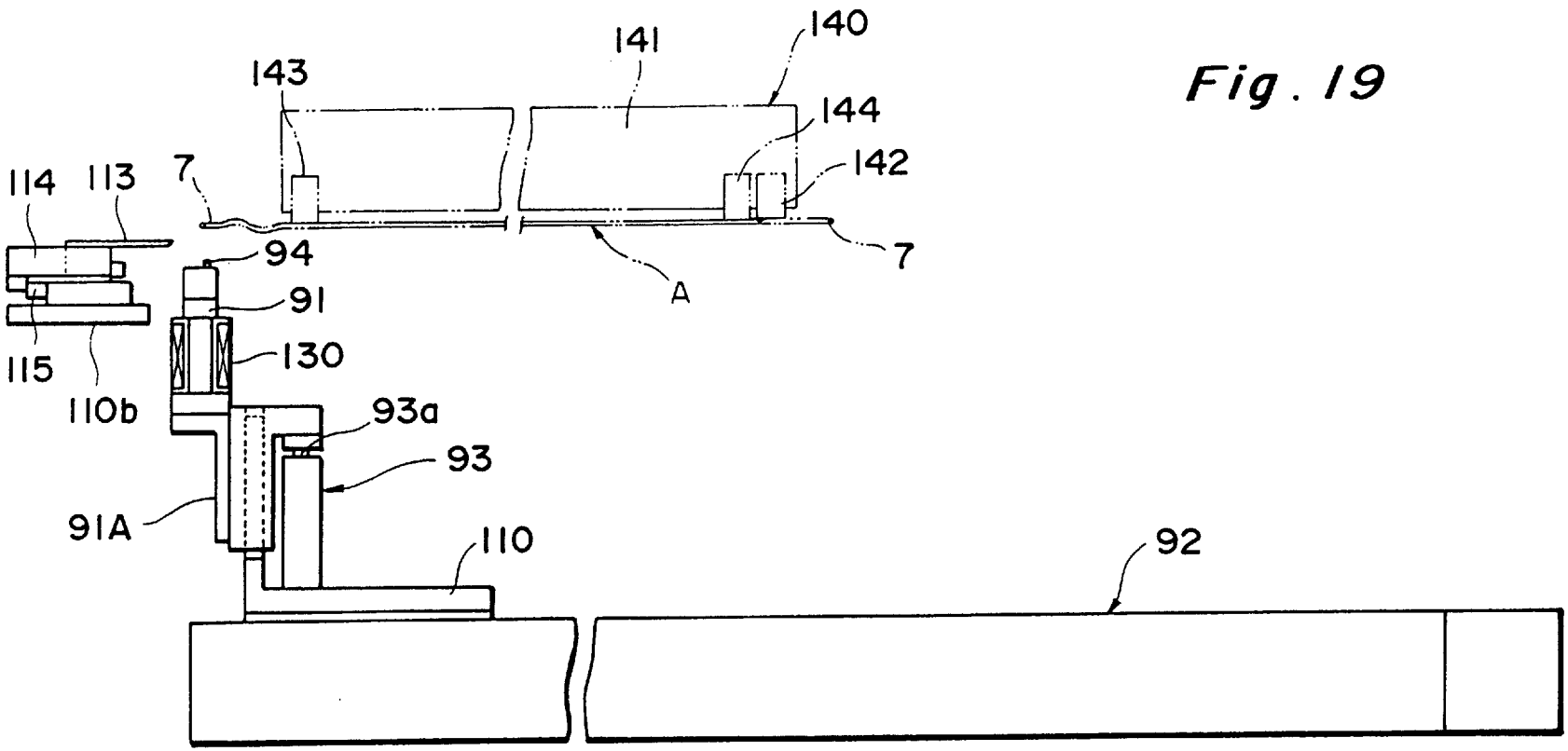
FIG. 19 is a side view showing a state in which the magnetic head is lowered to be returned.

After this operation, as shown in FIG. 19, the lowermost flat heald A is transferred to a standing block 141 of a heald transferring mechanism 140 to be described later. The piston mechanism (second driving means) 93 is then actuated to move the piston rod 93*a* down and to retract the moving base 110 along the guide rails 92*a* as shown in FIG. 6, thereby returning the drawing pin 94 of the magnetic head 91 to immediately below the guide hole 4 in the front portion of the lowermost flat heald A stored in the flat heald stocker 10.

As shown in FIG. 16, the heald transferring mechanism 140 is disposed ahead of the flat heald stocker 10. This heald transferring mechanism 140 has the standing block 141 designed to rotate 90° about the support shaft (not shown) located nearly in the center. First and second heald fixing magnetic heads 142 and 143 constituting respective electromagnets are provided at the both ends of the standing block 141. These magnetic heads 142 and 143 are exposed to the conveyance path of the flat heald A and are spaced from each other by a distance corresponding to the total length of the flat heald A. A degaussing head 144 is disposed between the first magnetic head 142 and the second magnetic head 143 so as to be adjacent to the first magnetic head 142 on the heald entrance side.

When the flat heald A is drawn out of the flat heald stocker 10 using the drawing pin 94, the flat heald A is magnetically attracted to the first magnetic head 142 of the standing block 141 while the rear portion of the flat heald A is inside the flat heald stocker 10, as shown in FIG. 16, thereby drawing the flat heald A. At this time, remanent magnetization occurs in the flat heald A by the magnetic force of the first magnetic head 142. Thus, the degaussing alternating current is supplied to the coil (not shown) disposed around the degaussing head 144, whereby the flat heald A can be drawn out while the remanent magnetization caused in the flat heald A is erased by the first magnetic head 142. When the flat heald A is drawn out completely and when the both ring portions 3 of the flat heald A are located below the first and second magnetic heads 142 and 143, drawing of the flat heald A is stopped.

After this operation, as shown in FIG. 17, the engagement between the drop preventing portion 113 and the drawing pin 94 is released and the current to the coil 130 is switched to the damped alternating current for degaussing to degauss the ring portion 3 magnetized by the magnetic head 91, thereby releasing the ring portion 3 from the magnetic head 91. Then, in the standing block 141, the coil (not shown) disposed around the second magnetic head 143 is energized, so that the ring portion 3 of the flat heald A is magnetically attracted to the second magnetic head 143 as the lowermost flat heald A is transferred to the standing block 141. After this operation, the flat heald A transferred to the standing block 141 is made upright by rotating the standing block 141 90° and it is conveyed to the warp passing mechanism (not shown) by a predetermined conveying means. At this time, the damped alternating current for degaussing is supplied to each coil of the degaussing head 144, the first magnetic head 142, and the second magnetic head 143, thereby eliminating the remanent magnetization of the flat heald A. Such elimination of the remanent magnetization can suppress a phenomenon of mutual gathering of the flat healds A in a weaving process using an automatic weaving machine.

The present invention is not limited to the above embodiment.

The present invention is not limited to the above embodiment. For example, as shown in FIG. 2, the ring receiving frame 14 and the frame 13 are separately formed on the base 12. However, the frame 13 and the ring receiving frame 14 may be integrally formed. In this case, as shown in FIG. 2, a heald drawing aperture may be formed in the front end of the lower portion of the housing 11 at a portion denoted by reference symbol P. In addition, a plurality of frames 13 may be arranged side by side on the base 12. In this structure, the flat healds A may be sequentially separated one by one from the ends of the frames 13 arranged side by side, or the flat healds A may be separated at once from all the frames 13 arranged side by side.

Figure 20:
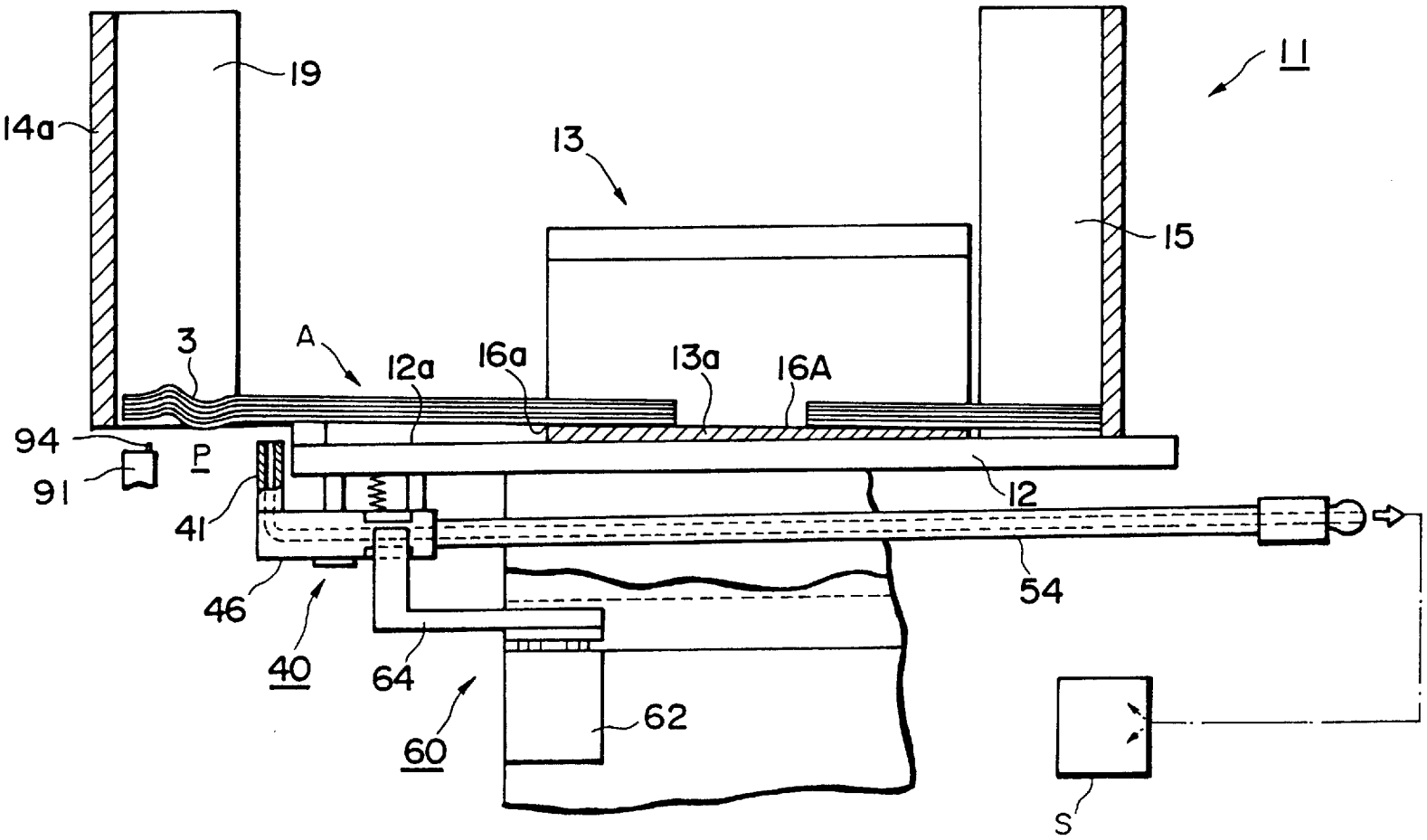
FIG. 20 is a sectional view showing another embodiment of the stocker to which the flat heald drawing apparatus according to the present invention is applied.
Figure 21:
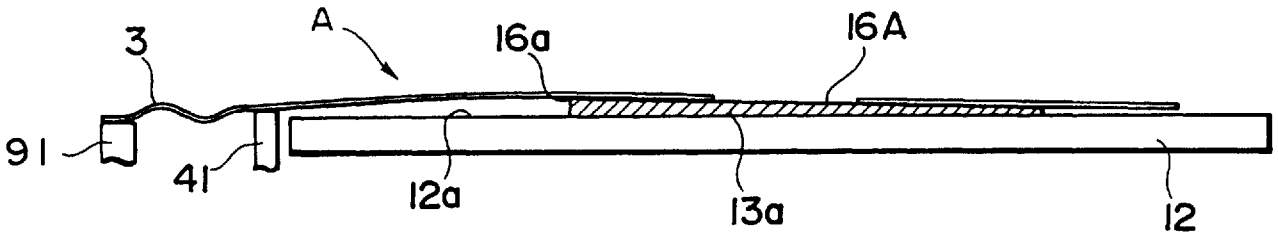
FIG. 21 is a side view showing a state in which the lowermost flat heald shown in FIG. 20 is separated by the suction head.

For example, the heald receiving bottom surface 16 is not limited to the horizontal state described above, and may be inclined backward so as to be kept in an almost (i.e., substantially) horizontal position. For example, as shown in FIG. 20, a heald receiving bottom surface 16A inclined backward is formed on the upper surface of the bottom surface 13*a* of the frame 13, and the front end 16*a* of the heald receiving bottom surface 16A is located above to be separated from the upper surface 12*a* of the base 12. With this structure, a flat heald group seated on the heald receiving bottom surface 16A can be stabilized in the housing 11 so that when the front portion of the lowermost flat heald A is drawn downward by the suction head 41, the front portion of the flat heald A can be set to be close to the horizontal state, as shown in FIG. 21. As a result, the lowermost ring portion 3 can be reliably seated on the upper surface of the magnetic head 91.

Figure 22:
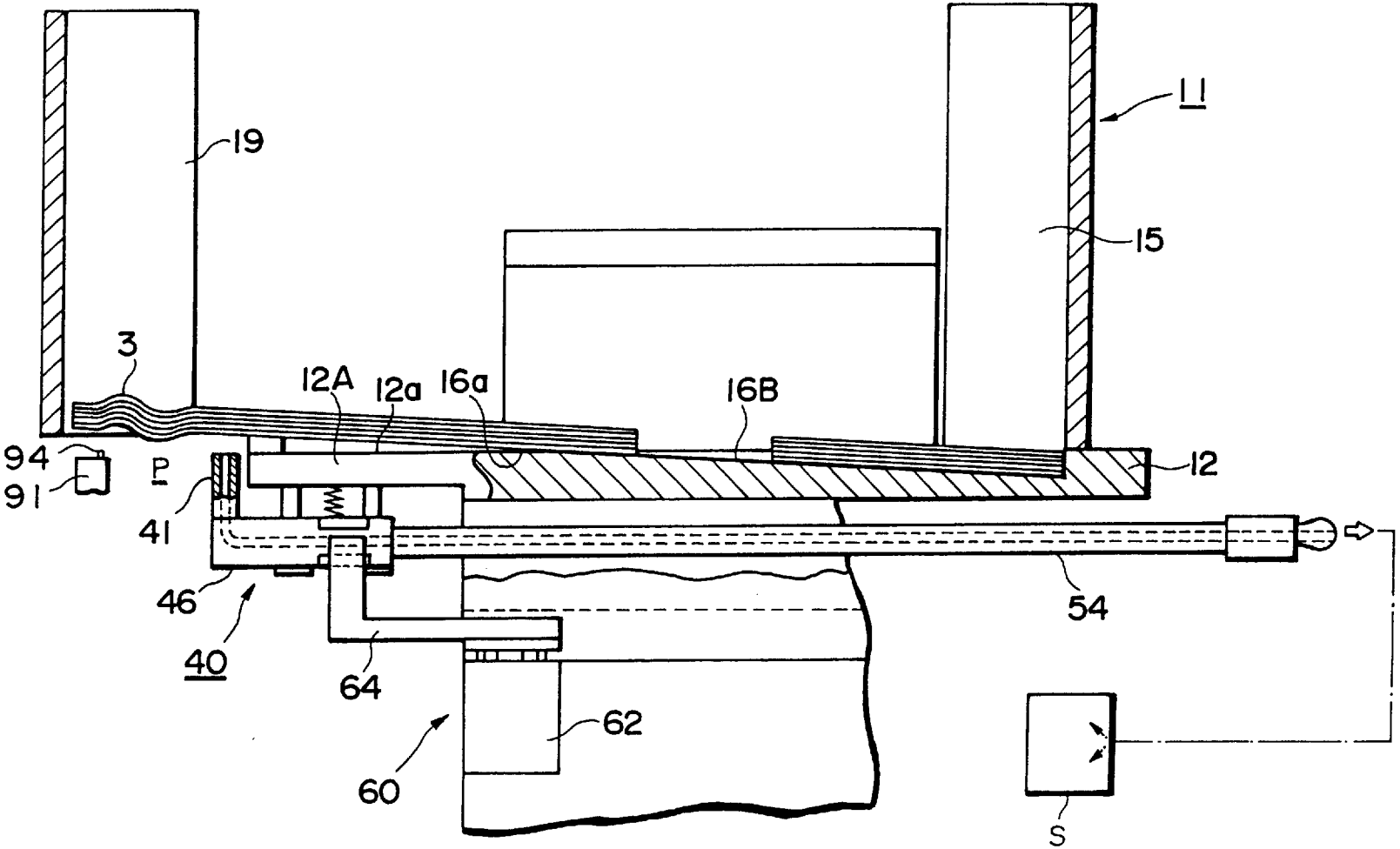
FIG. 22 is a sectional view showing still another embodiment of the stocker to which the flat heald drawing apparatus according to the present invention is applied.
Figure 23:
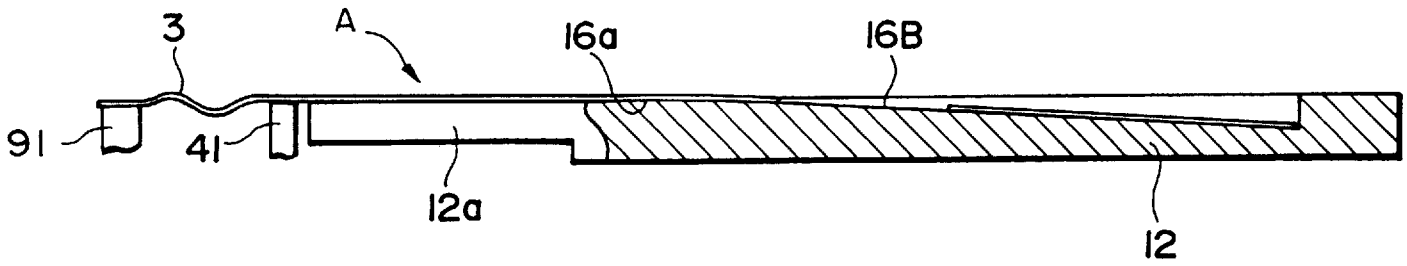
FIG. 23 is a side view showing a state in which the lowermost flat heald shown in FIG. 22 is separated by the suction head.

As shown in FIG. 22, a heald receiving bottom surface 16B inclined backward is formed in the upper surface of the base 12 in the form of a recess, and a front end 16*a* of the heald receiving bottom surface 16B is aligned with the upper surface of a horizontal front portion 12A of the base 12. With this structure, a flat heald group seated on the heald receiving bottom surface 16B can be stabilized in the housing 11. As shown in FIG. 23, when the front portion of the lowermost flat heald A is drawn downward by the suction head 41, the front portion of the flat heald A can be aligned with the flat upper surface of the front portion 12A, and hence the front portion of the flat heald A can be set to be very close to the horizontal state. As a result, the seating property of the lowermost ring portion 3 with respect to the upper surface of the magnetic head 91 can be greatly improved.

Although not shown, the drawing pin 94 may be inserted into the front-side guide hole 4 of the lowermost flat heald A, immediately before the flat heald A is drawn, by lifting the magnetic head 91 using the piston mechanism 93 as the second driving means and bringing the tip portion of the magnetic head 91 close to the front-side ring portion 3 of the lowermost flat heald A. Note that the second driving means 93 is used when the tip portion of the magnetic head 91 needs to be separated from the front-side ring portion 3 at the lowermost position before/after the flat heald A is drawn.

Figure 44:
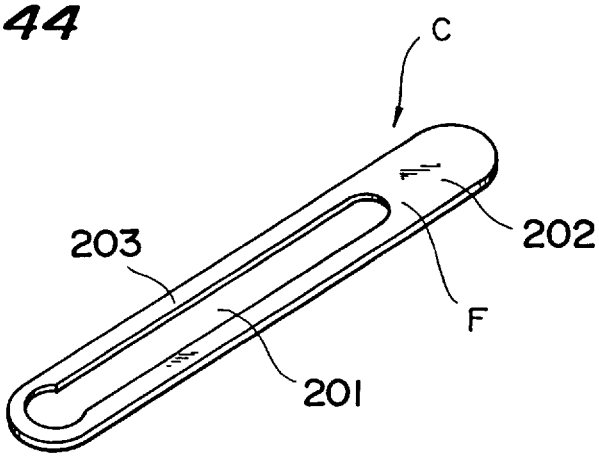
FIG. 44 is a perspective view showing an example of the dropper.

After the ring portion 3 is magnetically attracted to the magnetic head 91 by actuating the suction head 41, the drop preventing portion 113 is moved to a position above the drawing pin 94. Thereafter, the magnetic head 91 may be translated together with the drop preventing portion 113. With this operation, the flat heald A can be horizontally drawn out with very high stability. The preferred embodiments of the dropper drawing mechanism and method according to the present invention will be described in detail below with reference to the accompanying drawings. A dropper C for which the present invention is to be used is integrally made of an SK5 magnetic member having a spring property. As shown in FIG. 44, the dropper C has an elongated guide hole 201 used for passing a warp thread and for suspending the dropper C after warp passing. This guide hole 201 is formed in a dropper main body 202 in the form of a thin plate, and defined by a guide hole peripheral portion 203. Note that droppers C vary in length, shape, material, and the like.

Figure 25:
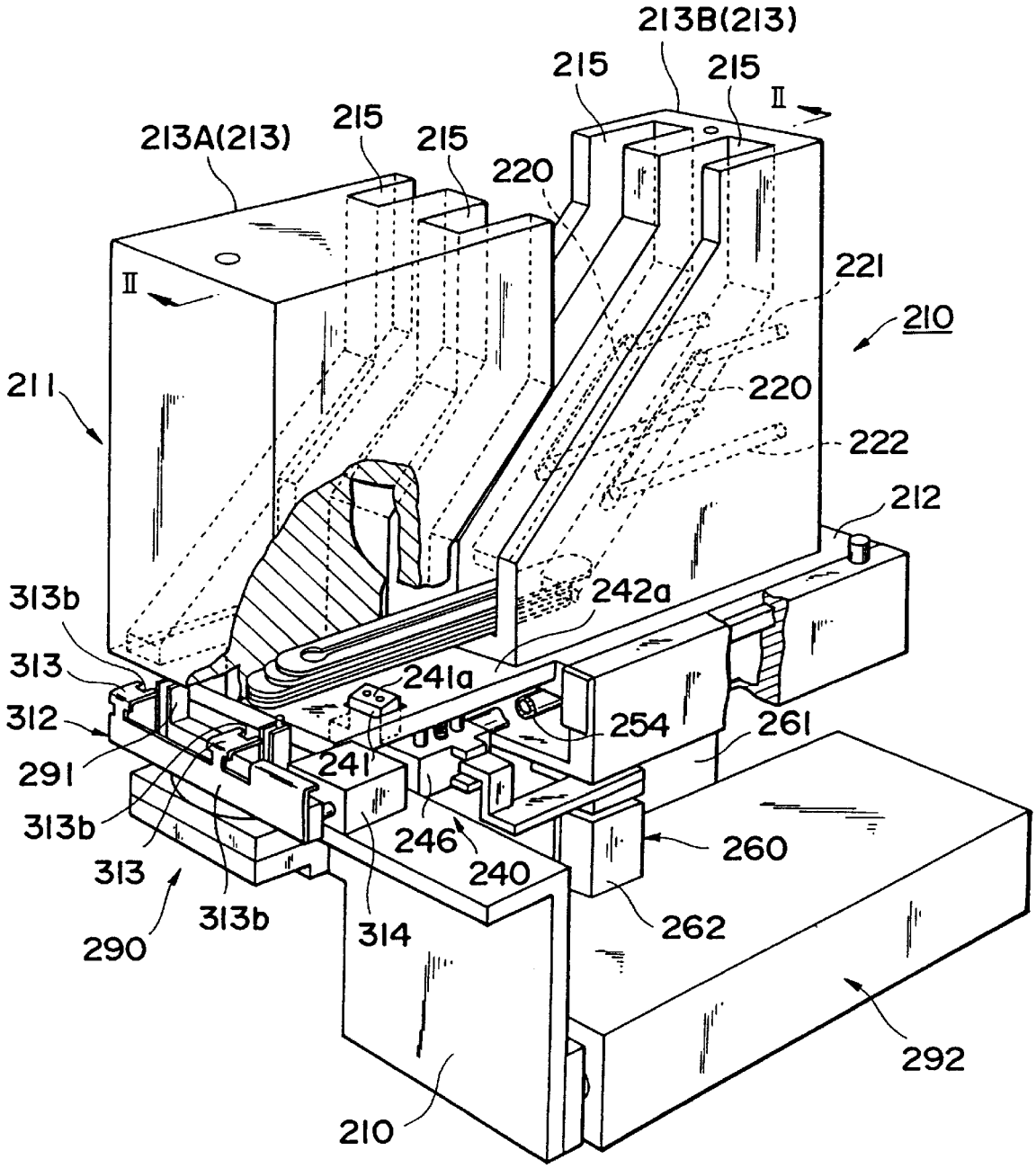
FIG. 25 is a perspective view showing a stocker to which the dropper drawing apparatus according to the present invention is applied.
Figure 26:
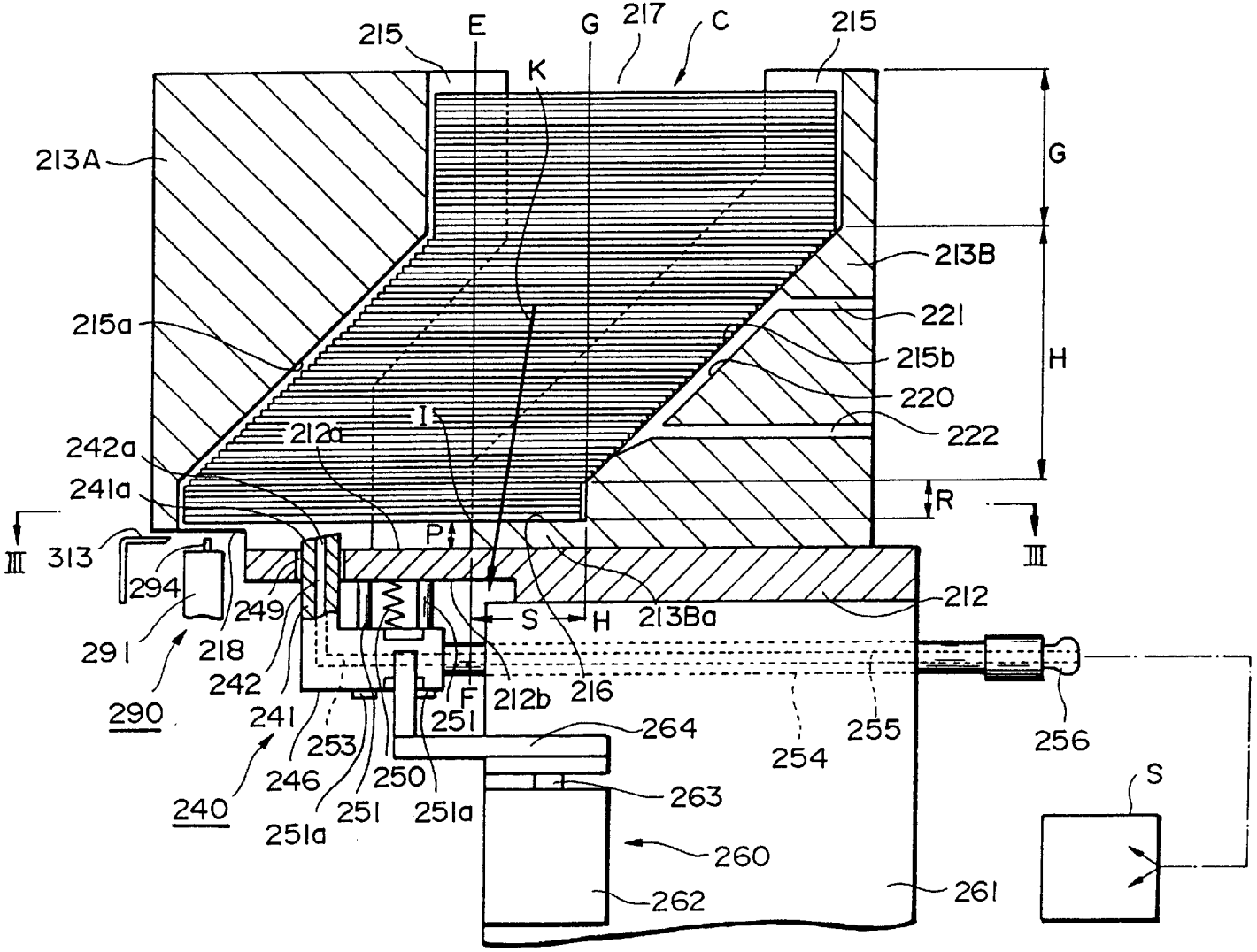
FIG. 26 is a sectional view taken along a line II—II of the stocker in FIG. 1.
Figure 27:
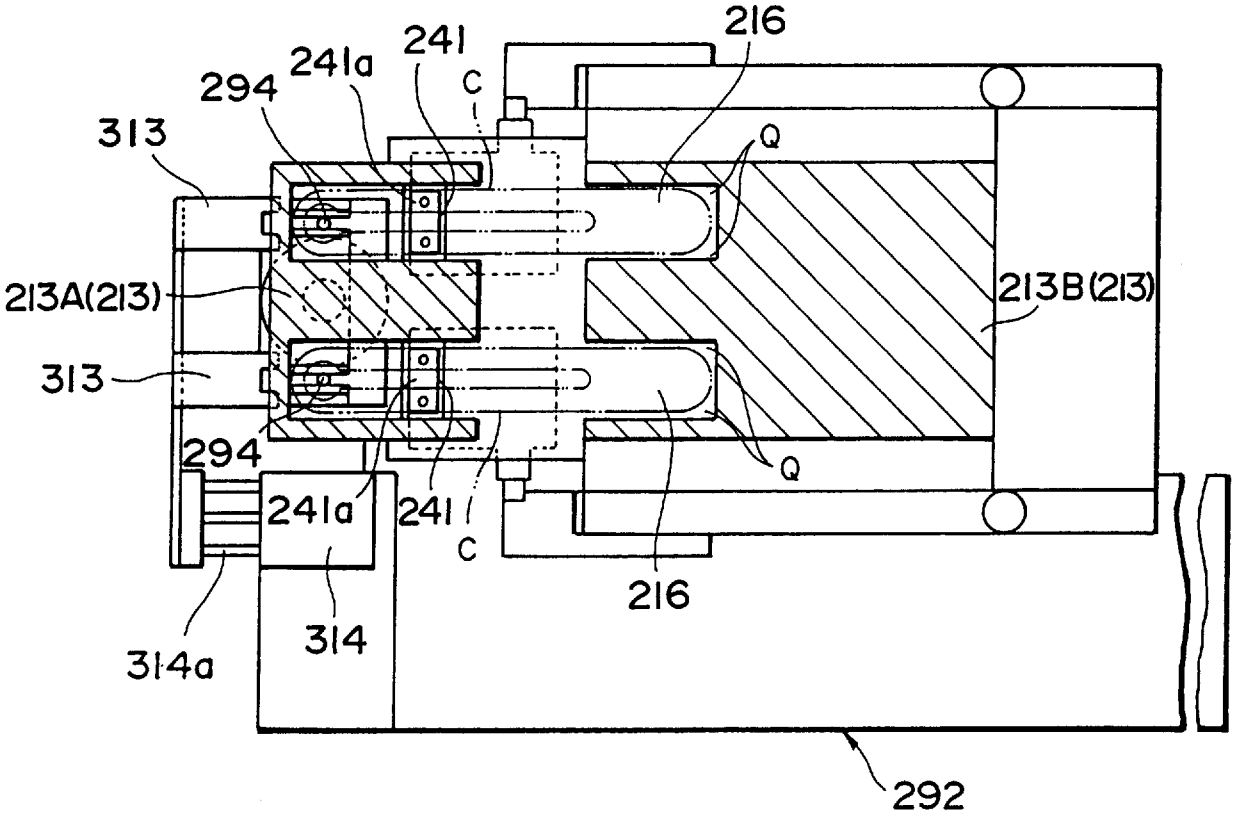
FIG. 27 is a sectional view taken along a line III—III in FIG. 2.

FIG. 25 is a perspective view showing a flat placement type twin-dropper stocker to which the dropper drawing apparatus of the present invention is applied. FIG. 26 is a sectional view taken along a line II—II in FIG. 25. FIG. 27 is a sectional view taken along a line III—III in FIG. 25.

As shown in FIGS. 25 to 27, a dropper stocker 210 has a housing 211 in which the droppers C in a horizontal state are stacked vertically. The housing 11 comprises a flat base 212 formed in an elongated shape matching with the elongated shape of the dropper C, and a frame 213 standing/fixed on the base 212 and designed to store the droppers C in a stacked state. The frame 213 has a two-division structure constituted by a front frame portion 213A for storing the front portion of the dropper C, and a rear frame portion 213B for storing the rear portion of the dropper C.

The frame 213 has two dropper receiving slits 215 in which the droppers C are stacked vertically. Each dropper receiving slit 215 is formed to extend vertically. In an intermediate area H in the direction of height of each dropper receiving slit 215, a front wall surface 215*a* and rear wall surface 215*b* of the dropper receiving slit 215 are formed as inclined surfaces which are inclined backward. The front and rear wall surfaces 215*a* and 215*b* are parallel to each other and are inclined at the same angle (e.g., 45°). In upper and lower areas G and R other than the intermediate area H, the front and rear wall surfaces 215*a* and 215*b* extend vertically. With this structure, when the droppers C are loaded in each dropper receiving slit 215, the droppers C are stacked and aligned along the vertical direction in the upper and lower areas G and R. In the intermediate area H, the droppers C are stacked and shifted backward in the form of steps.

The rear frame portion 213B of the frame 213 has a bottom plate 213Ba extending horizontally on the base 212. The upper surface of the bottom plate 213Ba serves as a dropper support surface (to be referred to as a "dropper receiving bottom surface" hereinafter) 216 extending horizontally. The lower end of the dropper receiving slit 215 on the rear side extends to the dropper receiving bottom surface 216. The front frame portion 213A has no dropper receiving bottom surface 216. The lower end of the front frame portion 213A is directly fixed to the base 212, and the lower end of the dropper receiving slit 215 on the front side extends to the base 212. The lower portion of the front end of the dropper receiving slit 215 is open to form a dropper drawing aperture 218. A dropper refilling aperture 217 is formed in the tip end of the dropper receiving slit 215 of the frame 213 to allow the dropper C to be easily inserted through the aperture 217 while being kept in a horizontal state.

Many droppers C loaded through this aperture 217 are stored in the dropper receiving slit 215, and only the lowermost dropper C comes in contact with the dropper receiving bottom surface 216. This dropper receiving bottom surface 216 supports all the droppers C in the housing 211 from below, and also support the rear portion of the lowermost dropper C. The front portion of the lowermost dropper C supported by the dropper receiving bottom surface 216 need be bent downward by using a dropper separating mechanism 240. By decreasing a protrusion length S of the bottom plate 213Ba and reducing the size of the portion of the dropper receiving bottom surface 216 which is used to cantilever the lowermost dropper C, the length of the front portion (free portion) extending forward from a front end I of the dropper receiving bottom surface 216 can be maximized. By increasing the length of this portion, the short dropper C having a length of about 8 cm (see FIG. 28) can be easily bent. Therefore, the lowermost dropper C can be reliably bent downward. In addition, since the loads of the stacked droppers C are also exerted on the inclined surface of the rear wall surface 215*b*, all the loads of the droppers C in the dropper stocker 210 are not exerted on the lowermost dropper C. As a result, the lowermost dropper C can be drawn with a small force.

As a means for reliably bending the lowermost dropper C, a predetermined step height is provided between the dropper receiving bottom surface 216 of the dropper receiving slit 215 and an upper surface 212*a* of the base 212. With this structure, the lowermost dropper C can be properly made to protrude from the bottom plate 213Ba. In addition, the front portion of the lowermost dropper C does not come in contact with the base 212 and can float relative to the base 212. This step height is realized by a thickness P of the bottom plate 213Ba of the frame 213. The floating amount of the dropper C can be adjusted by increasing/decreasing the thickness P of the bottom plate 213Ba. By floating the front portion of the lowermost dropper C relative to the base 212 in this manner, the front end portion of the lowermost dropper C can be forcibly drawn downward by a vacuum suction means or the like. Therefore, the dropper C can be gradually peeled off and separated from the remaining droppers from the front end portion.

In this case, in order to reliably bend the lowermost dropper C downward, the protrusion length S of the bottom plate 213Ba is set much smaller than the total length of the dropper C. Therefore, the dropper C supported by the bottom plate 213Ba becomes unstable, and its horizontal state is difficult to maintain. In order to maintain the horizontal position of the dropper C in the dropper receiving slit 215, the front and rear wall surfaces 215*a* and 215*b* of the dropper receiving slit 215 are inclined to form the inclined surfaces in the intermediate area H of the dropper receiving slit 215, as described above. Since the dropper receiving slit 215 is bent backward in this manner, the centers of gravity of all the droppers C stored in the housing 211 can be positioned sufficiently backward from a line E–F (a line extending vertically through the front end I of the dropper receiving bottom surface 216) in FIG. 26.

While the mass of the left portion (front portion) of the dropper group in FIG. 26 relative to the line E–F is sufficiently larger than that of the right portion (rear portion) of the dropper group relative to the line E–F, the center of gravity of the dropper group is positioned sufficiently backward from the line E–F. Assume that in the state shown in FIG. 26, an action line K of the resultant force of the force with which the dropper group slips down on the inclined surface of the rear wall surface 215*b* owing to the load of the right portion of the dropper group relative to a line G–H and the force based on the load of the left portion of the dropper group relative to the line G–H crosses the dropper receiving bottom surface 216 on the right side of the I point (the front end of the dropper receiving bottom surface 216). In this case, since a force acts on each dropper C to rotate it clockwise about the front end I of the dropper receiving bottom surface 216 as a fulcrum, the horizontal position of each dropper C can be maintained in the dropper receiving slit 215.

As the number of droppers C stocked in the dropper receiving slit 215 decreases, the position of the center of gravity of the dropper group keeps moving forward, and the action line K of the resultant force crosses the extended line of the dropper receiving bottom surface 216 on the left side of the I point. As a result, the horizontal position of each dropper C may not be maintained owing to the counter-clockwise moment about the I point as a fulcrum. However, the droppers C are properly refilled through the dropper refilling aperture 217 before such a situation occurs.

As shown in FIGS. 25 and 26, a concave, slit-like air passage 220 is entirely or partly formed in the inclined rear wall surface 215*b* to extend vertically along the inclined surface. The upper end of the air passage 220 communicates with an air inlet 221 horizontally extending through the rear frame portion 213B. The lower end of the air passage 220 communicates with an air suction hole 222 horizontally extending through the rear frame portion 213B. The air suction hole 222 is connected to a vacuum source (not shown). When air is sucked by the vacuum source through the air suction hole 222, negatively pressurized air flows downward in the air passage 220. By causing negatively pressurized air to flow downward in the air passage 220, a descending force can always be applied to the droppers C along the inclined rear wall surface 215*b*, following the flow of this air, while tight contact in the dropper group at this portion is maintained.

Note that the air passage 220 may be formed throughout the total width of the rear wall surface 215*b* without being formed into a slit. In this case, as shown in FIG. 27, since the air passage 220 has square corner portions Q, the round end portions of the droppers C do not fill the air passage 220 to allow air to flow in the corner portions Q. In addition, the air passage 220 may be formed in the upper or lower area G or R.

(Dropper Separating Mechanism)

Figure 28:
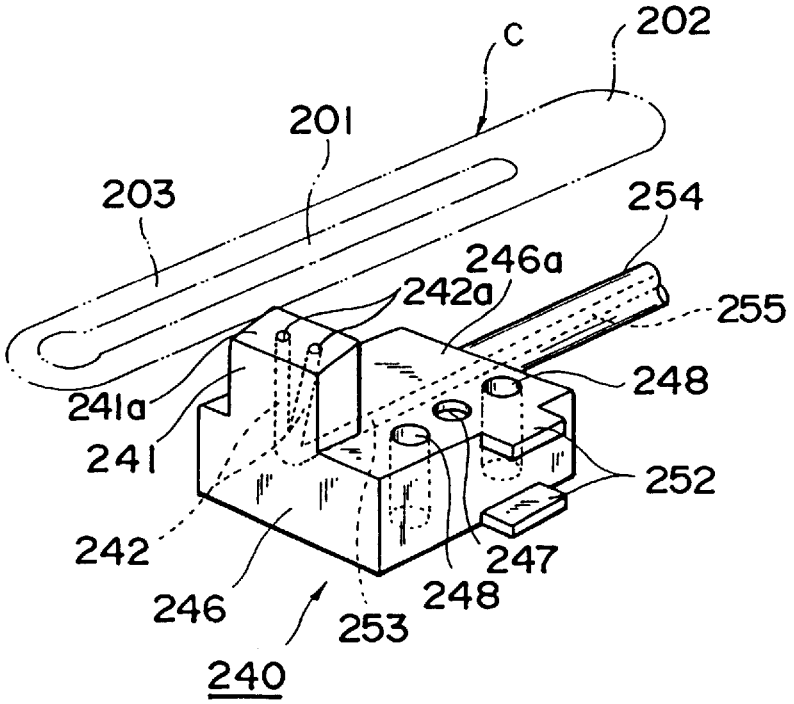
FIG. 28 is a perspective view showing the main part of a dropper separating mechanism.

As shown in FIGS. 25, 26, and 28, the dropper stocker 210 has the dropper separating mechanism 240 for drawing the lowermost dropper C more reliably. The dropper separating mechanism 240 has a suction head 241 which is provided at the front portion of the housing 211 and is used to vacuum-chuck, from below, the guide hole peripheral portion 203 which is a portion of the flat surface F of the dropper main body 202 of the lowermost dropper C. The suction head 241 is positioned before the I point of the dropper receiving bottom surface (dropper support surface) 216, and disposed below the lowermost dropper main body 202 to oppose the front portion of the lowermost dropper main body 202.

The suction head 241 moves vertically to forcibly attract the front portion of the lowermost dropper C to a magnetic head 231, and is inserted into a rectangular aperture 249 formed in the base 212 to protrude therefrom. A tip end face 241*a* of the suction head 241 is inclined at the angle at which when the front end of the dropper C comes in contact with a suction surface 291*a* of a magnetic head 291, the guide hole peripheral portion 203 of the dropper C comes in tight contact with the tip end face 241*a* of the suction head 241 (see FIG. 32). In addition, the tip end face 241*a* of the suction head 241 is provided immediately below the lowermost dropper C at a position behind the magnetic head 291. A suction hole 242 is also formed in the suction head 241 to extend vertically. Two circular suction ports 242*a* exposed to the guide hole peripheral portion 203 are formed at the upper end of the suction hole 242.

As shown in FIG. 28, the suction ports 242*a* formed as openings at positions on both sides of the guide hole 201, and oppose the guide hole peripheral portion 203 as part of the flat surface F of the dropper main body 202. After the dropper C is attached to the inclined tip end face 241*a* of the suction head 241, the suction head 241 is lowered. With this operation, the dropper C can be properly bent while the guide hole 201 is sandwiched between the suction ports 242*a*. Note that the suction force can be reduced by increasing the distance between the front end I of the dropper receiving bottom surface 216 serving as a fulcrum and the suction port 242*a* of the suction head 241 according to the principle of the lever.

As shown in FIGS. 25, 26, and 28, the dropper separating mechanism 240 has a base portion 246 on which the suction head 241 stands and is fixed. This base portion 246 is disposed below the base 212. A spring seating recess 247 is formed in an upper surface 246*a* of the base portion 246, and a pin insertion hole 248 vertically extending through the base portion 246 so as to interpose the recess 247 is formed in the base portion 246 (see FIG. 28). The upper surface 246*a* of the base portion 246 is coupled to a bottom surface 212*b* of the base 212 through a compression spring 250 seated in the recess 247. The compression spring 250 biases the base 212 and the base portion 246 in the direction in which they are separated from each other. Two guide pins 251 extend downward from the upper surface 212*a* of the base 212. The guide pins 251 are inserted into the pin insertion holes 248 of the base portion 246. Stopper portions 251*a* consisting of snap rings or the like are mounted on the lower ends of the guide pins 251. With this structure, the base portion 246 can be moved vertically in the extending direction of the guide pins 251 under the elasticity of the compression spring 50.

As shown in FIG. 26, a suction hole 253 is formed in the base portion 246 to extend horizontally. One end of the suction hole 253 communicates with the suction hole 242 of the suction head 241. The other end of the suction hole 253 communicates with a suction hole 255 of a flexible suction pipe 254 fixed to an end of the base portion 246. The suction pipe 254 extends horizontally along the base 212 and moves vertically following the base portion 246. A connector portion 256 of the suction pipe 254 protrudes from the rear end of the base 212 and is connected to the vacuum source S. With this structure, by actuating the vacuum source S, evacuation can be performed by the suction port 242*a* through the suction holes 242, 253, and 255. Note that a pair of upper and lower tongues 252 to be engaged with an actuator member 264 (to be described later) extend from the base portion 246. The upper tongue 252 is pushed upward by the distal end of the actuator member 264. When the base portion 246 is not smoothly lowered by the compression spring 250, the lower tongue 252 is pushed downward by the distal end of the actuator member 264.

As shown in FIG. 28, the base portion 246 is moved vertically by a driving means 260. This driving means 260 comprises an air cylinder 262 fixed to a support stage 261 for supporting the base 212 of the housing 211, a cylinder rod 263 designed to reciprocate vertically in a predetermined stroke relative to the air cylinder 262 and be prevented from rotating, and the actuator member 264 fixed to the tip of the cylinder rod 263 and designed to engage with the upper and lower tongues 252 of the base portion 246 at the tip thereof. Accordingly, the base portion 246 can be moved vertically by a predetermined amount in accordance with the stroke amount of the cylinder rod 263. When the tip of the actuator member 264 is inserted between the upper and lower tongues 252, there is a play given to the actuator member 264 between the upper and lower tongues 252, so that the stroke amount of the cylinder rod 263 is not equal to the ascent amount of the base portion 46. If the suction head 41 is designed to be directly driven by the air cylinder 262, there is no need to use the base portion 246 and the actuator member 264, and there is no need to give the play between the upper and lower tongues 252 and the actuator member 264, either.

(Dropper Drawing Apparatus)

A drawing apparatus 290 for drawing the magnetic droppers C vertically stacked in the above dropper stocker 210 one by one from the lowermost position will be described next.

Figure 29:
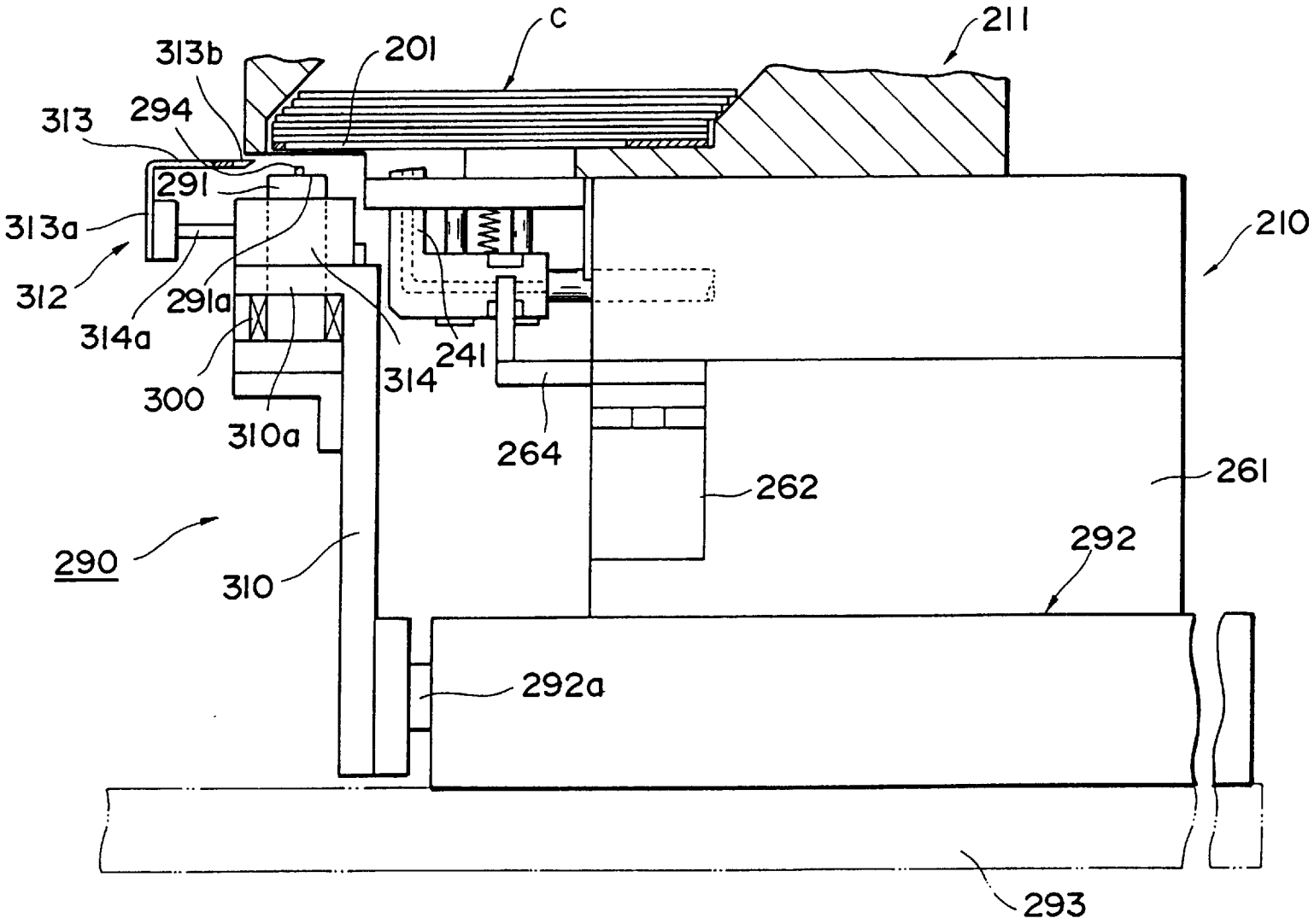
FIG. 29 is a side view showing the dropper drawing apparatus.
Figure 30:
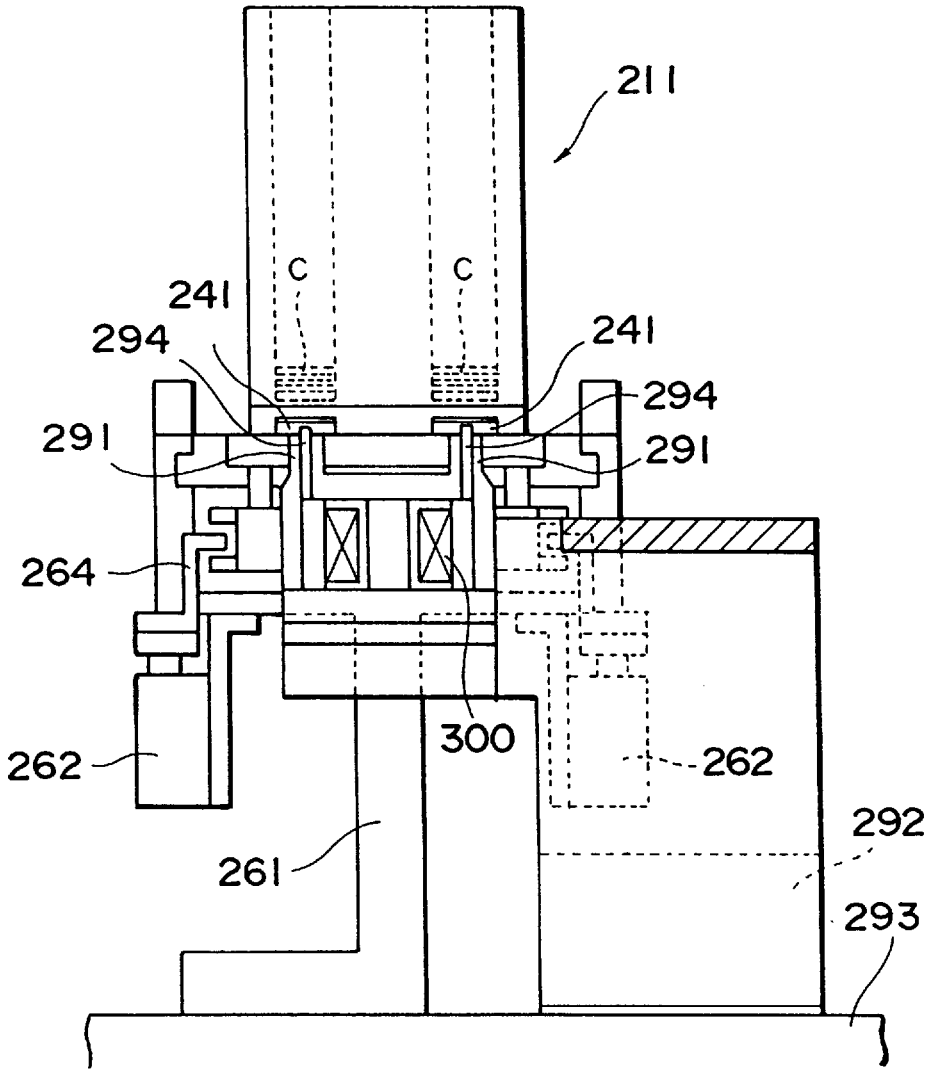
FIG. 30 is a front view showing a stocker to which the dropper drawing apparatus is applied.

As shown in FIGS. 25, 29, and 30, the drawing apparatus 290 comprises the dropper drawing magnetic head 291 constituted by an iron core which moves vertically and is part of an electromagnet, a non-magnetic drawing pin 294 extending from a tip end face (attraction face) 291*a* of the magnetic head 291, and a translating unit 292 serving as a driving means for moving the magnetic head 291 horizontally.

As shown in FIGS. 29 and 30, the magnetic head 91 is positioned below the guide hole 201 of the lowermost dropper C stored in the housing 211 to draw the lowermost dropper C. In addition, the non-magnetic drawing pin 294 is fixed to the tip end face 291*a* of the magnetic head 291 to protrude. This drawing pin 294 is tall enough to be inserted into the guide hole 201 and hooked on the guide hole peripheral portion 203.

The drawing apparatus 290 has the translating unit 292 as the driving means for moving the above magnetic head 291 horizontally. This translating unit 292 is installed below the dropper stocker 210 and fixed on a horizontal base 293 at a position adjacent to a support stage 261 for supporting the base 212 of the housing 211. This translating unit 292 is designed as an air cylinder with a guide mechanism. A piston rod 292*a* of this air cylinder 292 moves back and forth by a predetermined amount in the extending direction of the dropper C in cooperation with a moving amount adjustment stopper (not shown). Note that other examples of the translating unit 292 include a translating means using a ball screw or a linear motor and the like.

The lower end of a moving base 310 is fixed to the distal end of the piston rod 292*a*. The lower end of the magnetic head 291 is fixed to the upper end of the moving base 310. Wit this structure, the magnetic head 291 can be moved horizontally by a predetermined amount in accordance with the projecting amount of the piston rod 292*a*. In addition, a drop prevention mechanism 312 is disposed on an upper portion 310*a* of the moving base 310. The drop prevention mechanism 312 is engaged with the drawing pin 294 to prevent the lowermost dropper C from dropping off from the drawing pin 294.

This drop prevention mechanism 312 includes a plate-like drop prevention mechanism 313 which is placed in front of the lowermost dropper C in the drawing direction to oppose the drawing pin 29, and engaged with the drawing pin 294 to hook/hold the guide hole peripheral portion 203 on the drawing pin 294, and an air cylinder 314 serving as a driving source which is fixed to the upper portion 310*a* of the moving base 310, and drives a base portion 313*a* of the drop prevention mechanism 313 horizontally to engage/disengage the drop prevention mechanism 313 with/from the drawing pin 294. A recess 313*b* in which the drawing pin 294 is to be inserted is formed in the plate-like drop prevention mechanism 313.

With this structure, when a piston rod 314*a* of the air cylinder 314 is retracted toward the magnetic head 291, the drawing pin 294 is inserted into the recess 313*b* of the drop prevention mechanism 313. As a result, the guide hole peripheral portion 203 can be sandwiched between the suction surface 291*a* of the magnetic head 291 and the drop prevention mechanism 313. Even if an unexpected accident occurs in the magnetic head 291 to result in losing the magnetic force, the guide hole peripheral portion 203 will be kept from slipping off from the drawing pin 294 in the process of further drawing the dropper C. In addition, the engagement between the drawing pin 294 and the drop prevention mechanism 313 is released by moving the piston rod 314*a* forward in the direction away from the magnetic head 291. Such an operation is performed to release the lowermost dropper C from the magnetic head 291 when the lowermost dropper C is completely drawn out from the housing 211.

(Operation)

A dropper drawing method will be described next in associated with the dropper separating mechanism 240.

Figure 31:
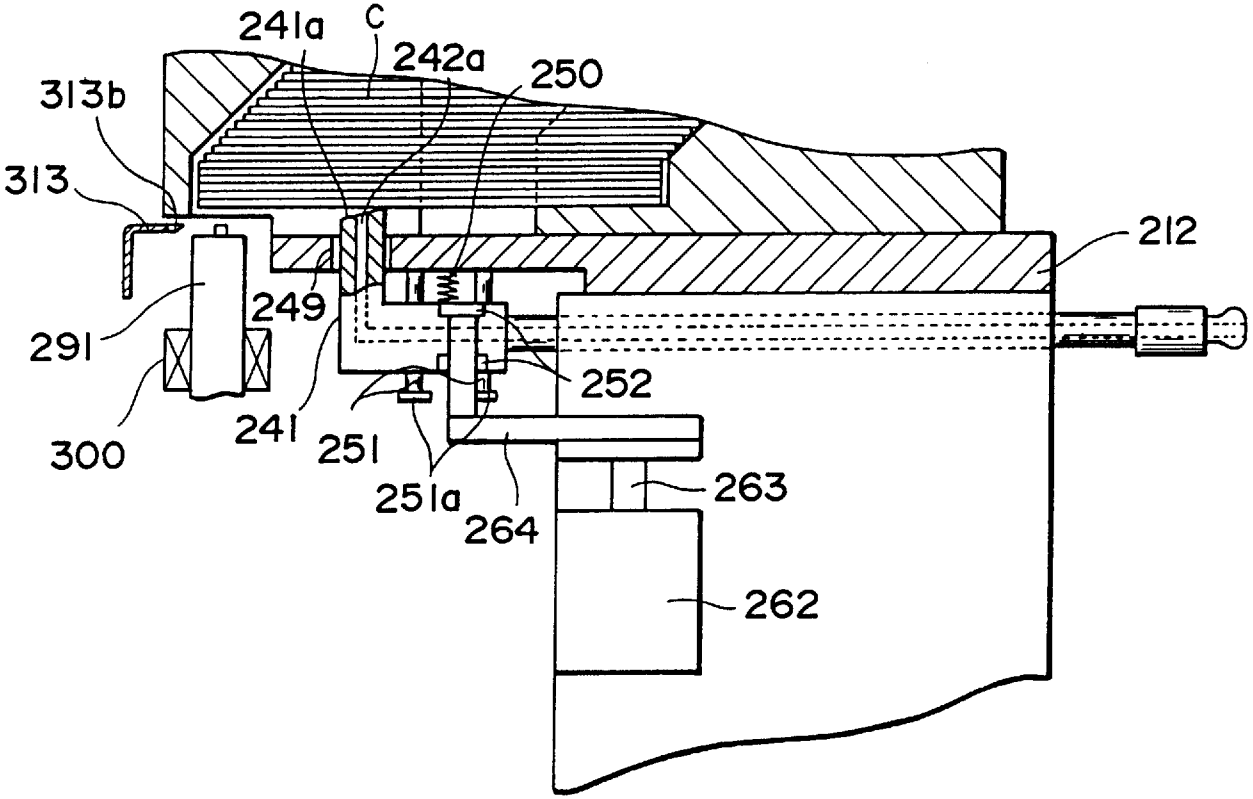
FIG. 31 is a sectional view showing a state in which the suction head of the dropper separating mechanism is raised to bring the tip end face of the suction head close to a dropper.

As shown in FIG. 31, when the air cylinder 262 is driven to move the actuator member 264 upward, the upper tongue 252 is pushed upward by the distal end of the actuator member 264. As a result, the base portion 246 moves upward by a predetermined amount against the spring force of the compression spring 250. At this time, the tip end of the suction head 241 is brought very close to or into contact with the guide hole peripheral portion 203 of the lowermost dropper C while being caused to protrude from the aperture 249. Thereafter, the vacuum source S is actuated to perform evacuation by the suction port 242*a* so as to cause the tip end face 241*a* of the suction head 241 to vacuum-chuck the guide hole peripheral portion 203 of the dropper C. In this case, since the tip end face 241*a* of the suction head 241 is inclined, a slight clearance is initially formed between the tip end face 241*a* of the suction head 241 and the dropper C. However, the influences of this clearance can be neglected at the start of bending of the dropper C. This is because the suction force required at the start of bending of the dropper C having a spring property need not be very large.

Figure 32:
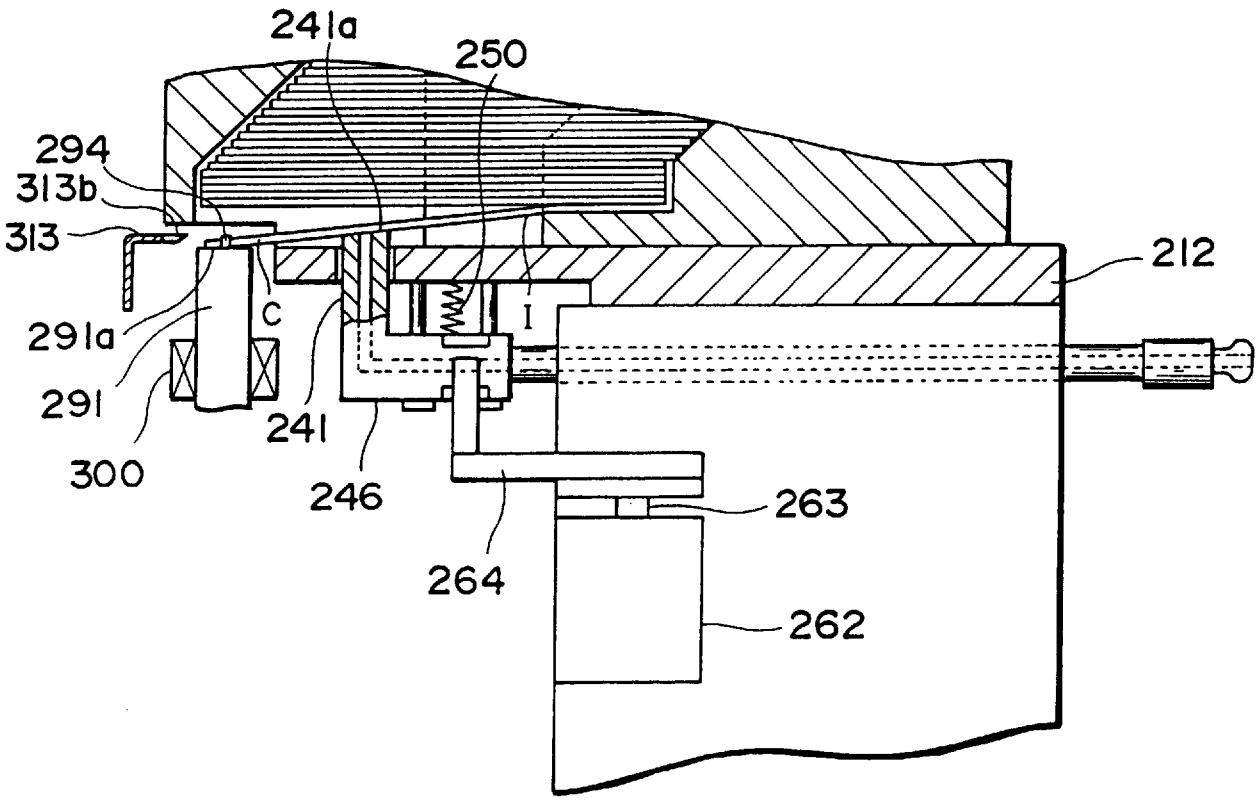
FIG. 32 is a sectional view showing a state in which the suction head is lowered to separate the lowermost dropper from a dropper group.

Subsequently, as shown in FIG. 32, when the air cylinder 262 is driven to lower the actuator member 264, the dropper C follows the tip end face 241*a*, and the base portion 246 moves downward to a predetermined position with the spring force of the compression spring 250. Note that the tip end face 241*a* of the suction head 241 may be brought close to or into contact with the lowermost dropper C after the vacuum source S is actuated, and the suction head 241 may be lowered afterward.

At this time, the lowermost dropper C is separated while warping downward in a cantilevered state with the I point of the dropper receiving bottom surface (dropper support surface) 216 serving as an fulcrum. The lowermost dropper C is gradually peeled off and separated from the next dropper C from the front end. Even if, therefore, the droppers C stick to each other with a machine oil or the like, the lowermost dropper C is separated from the next dropper from the front end and can be easily separated with a slight force. In addition, the drawing pin 294 is inserted into the guide hole 201 at the lowermost position, and an excitation current is supplied to a coil 300 wound on the magnetic head 291 to magnetically attract the dropper C to the magnetic head 291. At this time, the magnetically attracting force is set so as not to attract the second lowest dropper C.

Figure 33:
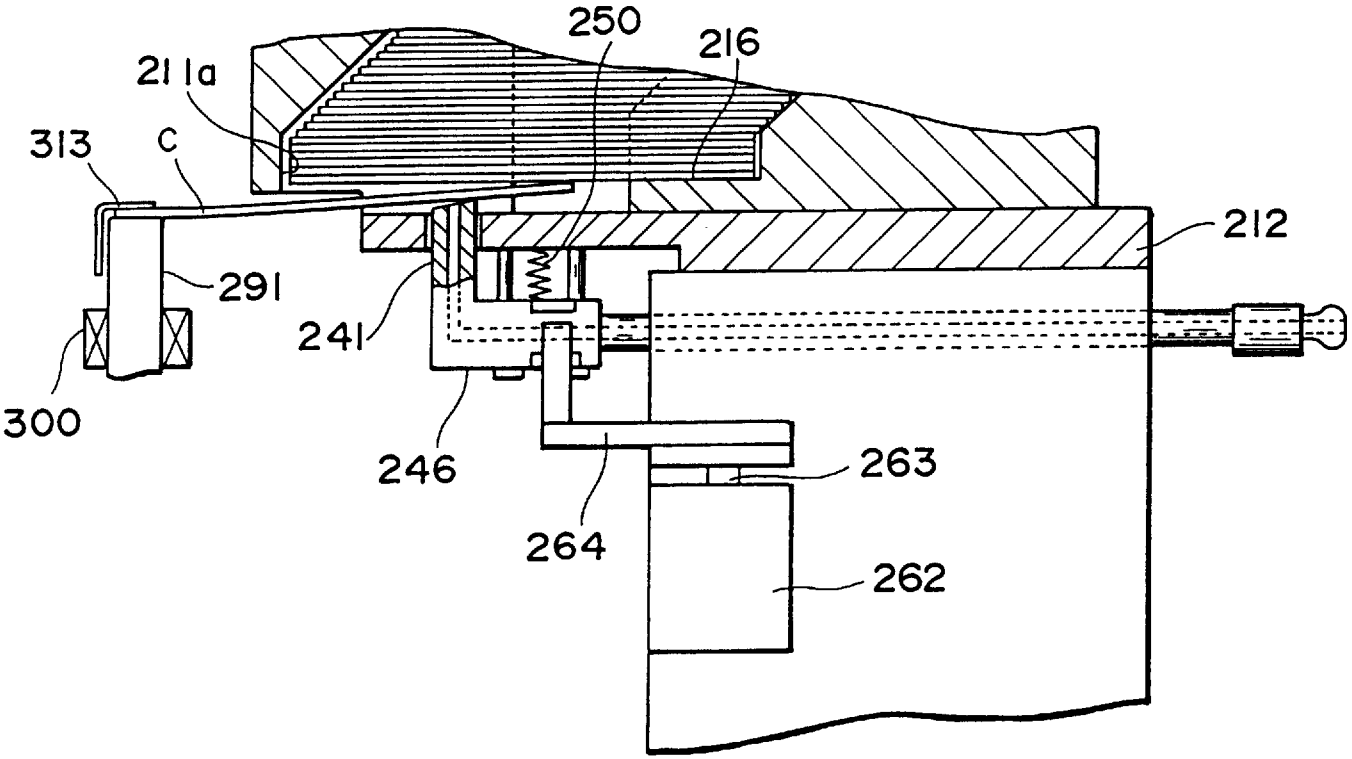
FIG. 33 is a sectional view showing a state in which the lowermost dropper is drawn out.

Subsequently, the piston rod 314*a* (see FIG. 29) of the air cylinder 314 is retracted toward the magnetic head 291 to insert the drawing pin 294 into the recess 313*b* of the drop prevention mechanism 313. As a result, the guide hole peripheral portion 203 is sandwiched between the suction surface 291*a* of the magnetic head 291 and the drop prevention mechanism 313 to prevent the guide hole peripheral portion 203 of the lowermost dropper C from slipping off from the drawing pin 294. At this time, the suction head 241 is stopped from vacuum-chucking the dropper C. Thereafter, the piston rod 292*a* (see FIG. 29) of the air cylinder 292 is projected horizontally with a predetermined air pressure to advance the moving base 310 horizontally. As a result, as shown in FIG. 33, the drop prevention mechanism 313 and the magnetic head 291 on the moving base 310 move horizontally. With this operation, the drop prevention mechanism 313 and the magnetic head 291 cooperate with each other to reliably hook the drawing pin 294 on the distal end portion of the guide hole 201 of the lowermost dropper C and horizontally draw the dropper C directed to the dropper transferring mechanism 340 (to be described later). At this time, as shown in FIG. 33, as the lowermost dropper C is drawn out, the second lowest dropper C also tends to be drawn owing to the frictional force. However, the leading end of the second lowest dropper C collides with a wall surface 211*a* of the housing 211, and hence this drawing action is stopped.

When the trailing end of the lowermost dropper C leaves the distal end of the dropper receiving bottom surface 216, the suction head 241 may be stopped from vacuum-chucking the dropper C. Alternatively, the drop prevention mechanism 313 may be omitted if the magnetically attracting force of the magnetic head 291 is large. In addition, since the suction force acts on only the lowermost dropper C, only the lowermost dropper C is bent by this suction, and the dropper C located immediately above the lowermost dropper C is kept in the horizontal position. If the magnetically attracting force of the magnetic head 291 may act on the second dropper C after the lowermost dropper C is separated, a nonmagnetic pin or the like may be inserted between the lowermost dropper C and the second dropper C before the magnetic head 291 is magnetized. When the magnetic attraction is to be canceled, the excitation current supplied to the coil 300 is preferably switched to the damped alternating current for degaussing to eliminate the remanent magnetization in the dropper C.

(Dropper Transferring Mechanism)

Figure 34:
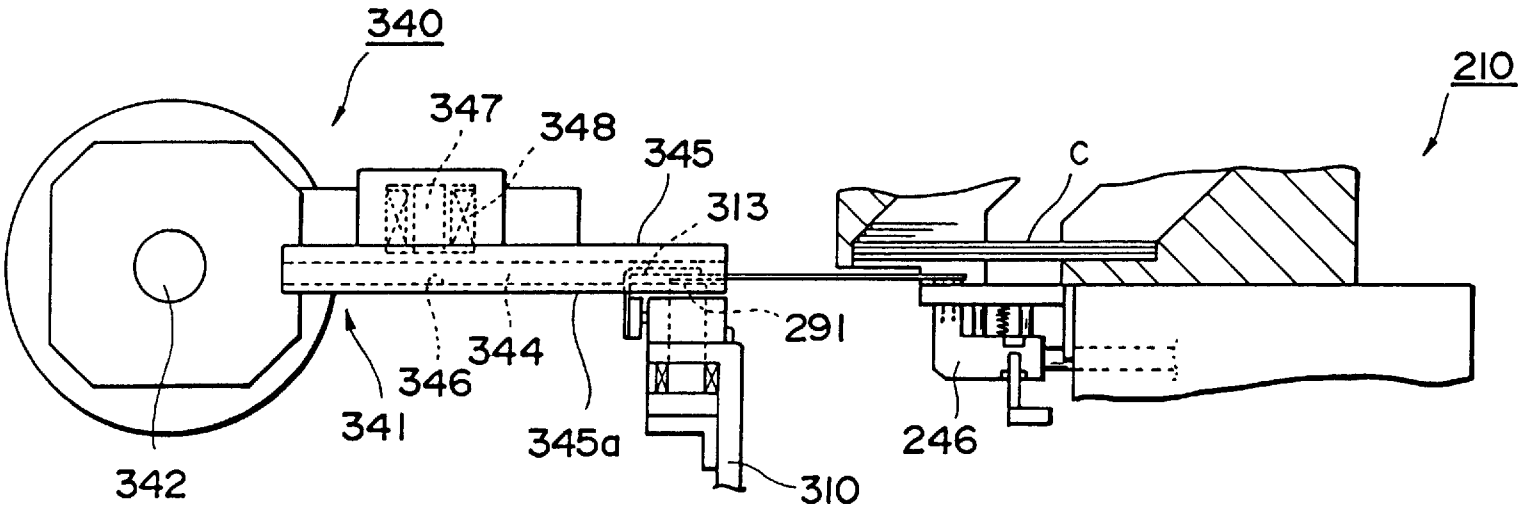
FIG. 34 is a side view showing the positional relationship between a dropper transferring mechanism and a dropper stocker.
Figure 35:
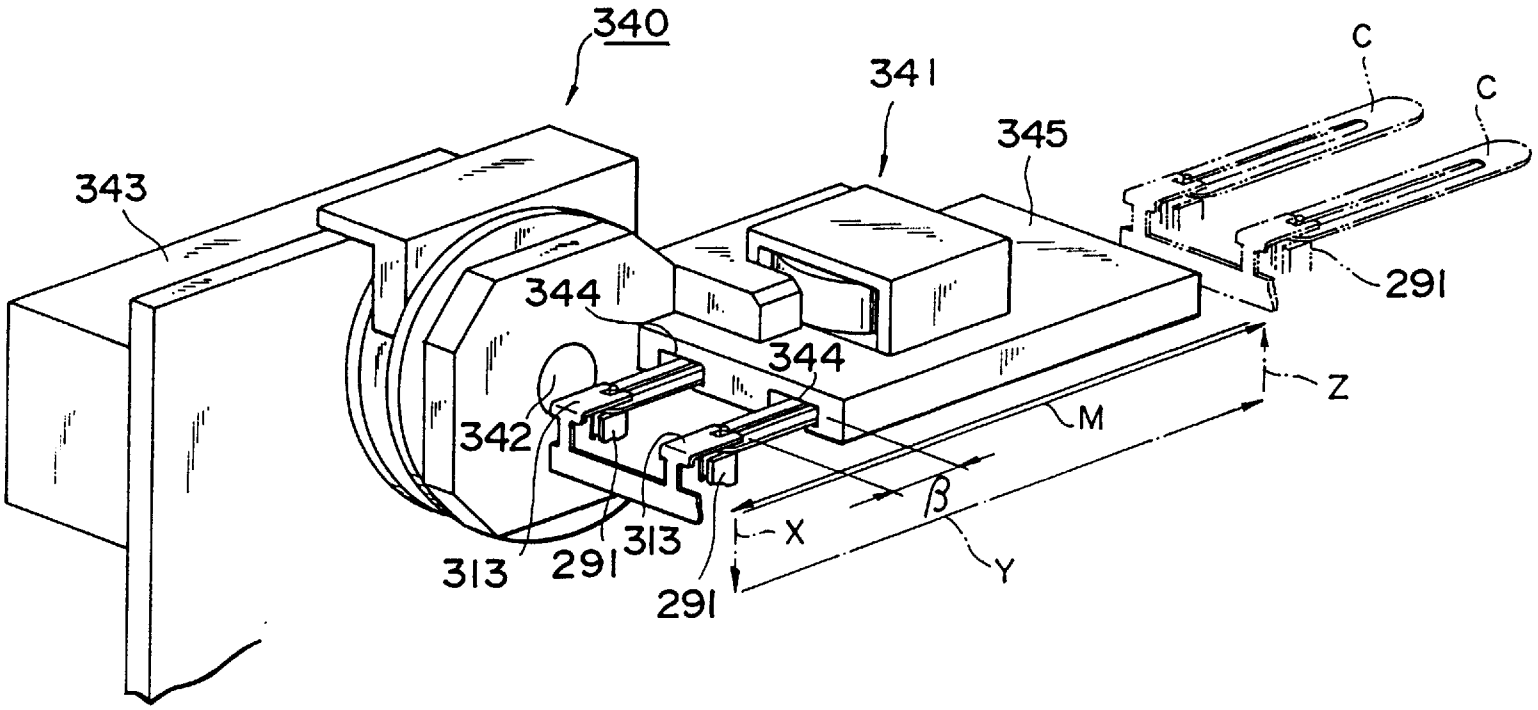
FIG. 35 is a perspective view showing the dropper transferring mechanism.

As shown in FIGS. 34 and 35, a dropper transferring mechanism 340 is disposed in front of the stocker 210. The dropper transferring mechanism 340 has a work rotating member 341 serving as an inverted block which rotates 90° about a support shaft 342 provided at a rotary actuator 343. The work rotating member 341 has a plate-like dropper receiving portion 345 in which the drawn dropper C is temporarily stored to be inverted. The dropper receiving portion 345 has a straight dropper insertion hole 344 for receiving the lowermost dropper C horizontally drawn out from the stocker 210 with the horizontal state of the dropper C being maintained. A magnetic head guide slit 346 in which the magnetic head 291 is to be inserted is formed in a bottom surface 345*a* of the dropper receiving portion 345 throughout the total length of the dropper insertion hole 344. In addition, a magnetic head 347 for holding a dropper in an inverted state is fixed to the dropper receiving portion 345. This magnetic head 347 is placed at a position where the dropper insertion hole 344 is influenced by the magnetic force. A coil 348 is wound on the magnetic head 347. Note that two dropper insertion holes 344 are formed in the dropper receiving portion 345 because two droppers C are drawn out from the stocker 210.

Figure 36:
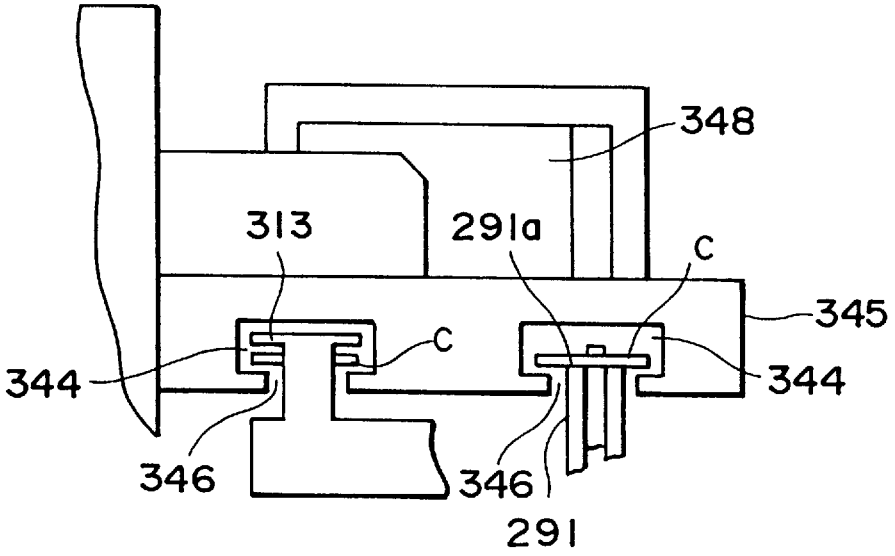
FIG. 36 is a front view showing a state in which the dropper drawn by a magnetic head passes through a dropper receiving portion.

As shown in FIG. 34, the moving base 310 is advanced horizontally by the air cylinder 292 while the dropper C is magnetically attracted to the magnetic head 291 and the drop prevention mechanism 313 prevents the dropper C from dropping off from the magnetic head 291. At this time, as shown in FIG. 36, the magnetic head 291 passes through the magnetic head guide slit 346 of the dropper receiving portion 345, and the drop prevention mechanism 313 passes through the dropper insertion hole 344 of the dropper receiving portion 345. The dropper C sandwiched between the suction surface 291*a* of the magnetic head 291 and the drop prevention mechanism 313 is therefore guided along the dropper insertion hole 344.

Figure 37:
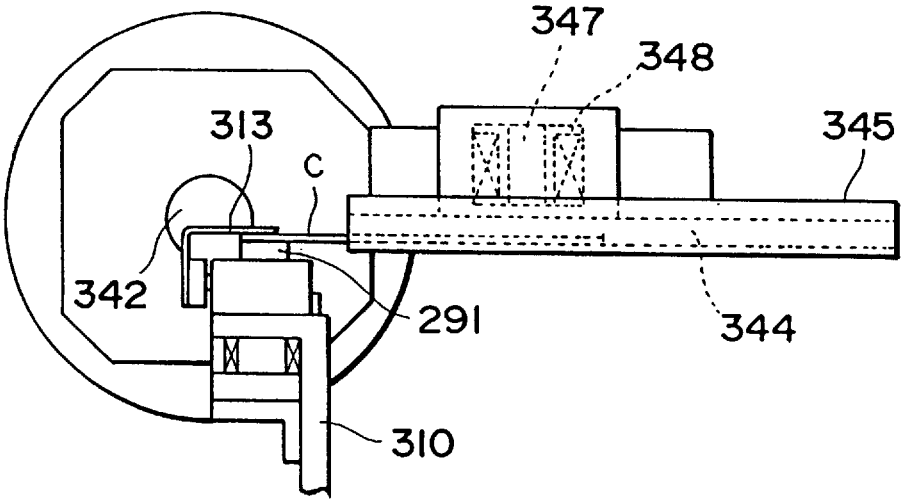
FIG. 37 is a side view showing a state in which droppers are housed in the dropper receiving portion of the dropper transferring mechanism.

As shown in FIGS. 35 and 37, when the dropper C is moved out of the dropper receiving portion 345 by the predetermined amount β, and is located immediately below the magnetic head 347, the air cylinder 292 is stopped. At this time, when the coil 348 of the inverting magnetic head 347 is energized, the rear portion of the dropper C is magnetically attracted to the magnetic head 347 while the dropper C sticks to the upper surface of the dropper insertion hole 344.

Figure 38:
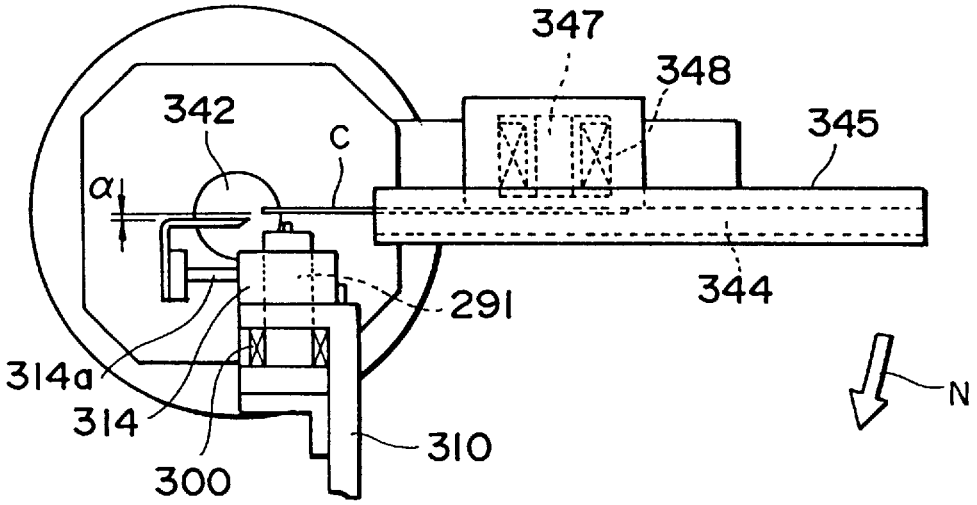
FIG. 38 is a side view showing a state in which a drawn dropper is attached to the upper surface of a dropper insertion hole.
Figure 39:
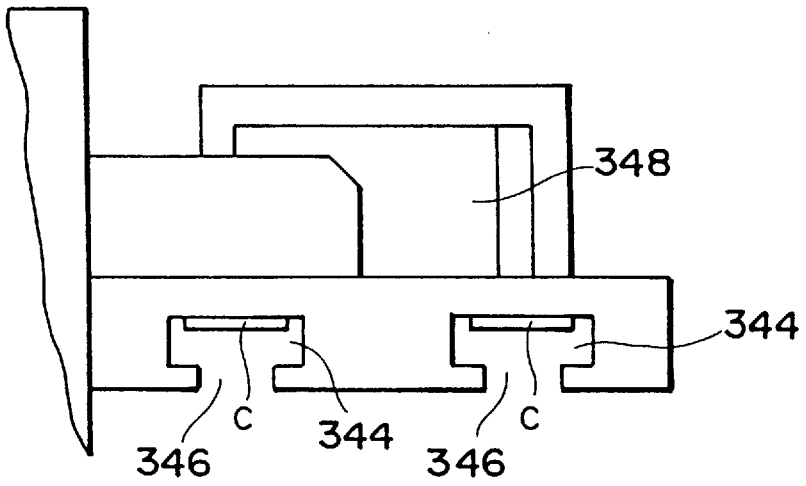
FIG. 39 is a front view showing a state in which the drawn dropper is attached to the upper surface of the dropper insertion hole.

After this operation, as shown in FIG. 38, the piston rod 314*a* is advanced in the direction away from the magnetic head 291 to release the engagement between the drawing pin 294 and the drop prevention mechanism 313. The excitation current supplied to the coil 300 wound on the magnetic head 291 is switched to the damped alternating current for degaussing to degauss the dropper C magnetized by the magnetic head 291, thereby releasing the dropper C from the magnetic head 291. As a result, the dropper C is held by only the dropper receiving portion 345 under the influence of the magnetic head 347. The dropper C completely drawn out from the stocker 210 in this manner is temporarily fixed to the dropper receiving portion 345. Note that a spacing α is ensured between the drop prevention mechanism 313 and the dropper C fixed to the dropper receiving portion 345 to prepare for retraction of the drop prevention mechanism 313 (see FIG. 38).

After this operation, the moving base 310 is moved backward in the direction of an arrow M in FIG. 35 by the air cylinder 292. With this operation, the moving base 310 is returned to a predetermined position in the stocker 210 while the magnetic head 291 passes through the magnetic head guide slit 346 of the dropper receiving portion 345, and the drop prevention mechanism 313 passes through the dropper insertion hole 344. If the magnetic head 291 and the drop prevention mechanism 313 have a mechanism for moving them vertically, these components can be returned to the stocker 210 by sequentially moving them as indicated by arrows X, Y, and Z.

After the dropper C is completely drawn out, the rotary actuator 343 is actuated to rotate the dropper receiving portion 345 through 90° in the direction of an arrow N in FIG. 38. As a result, the dropper C is fixed to the dropper receiving portion 345 and inverted under the influence of the magnetizing force of the magnetic head 347. Thereafter, the excitation current flowing in the coil 348 of the magnetic head 347 is switched to the damped alternating current for degaussing to degauss the dropper C. The dropper C then drops to be fed to a warp passing mechanism (not shown). Such elimination of the remanent magnetization can suppress a phenomenon of mutual gathering of the droppers C in a weaving process using an automatic weaving machine.

Figure 40:
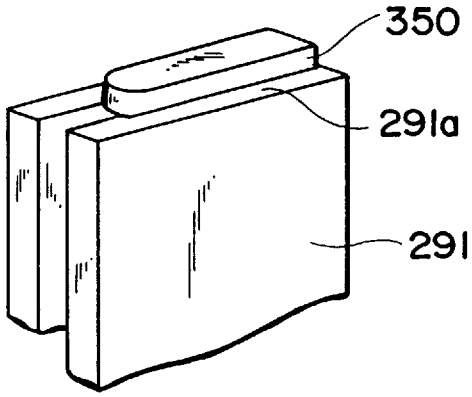
FIG. 40 is a perspective view showing another embodiment of a magnetic head.
Figure 41:
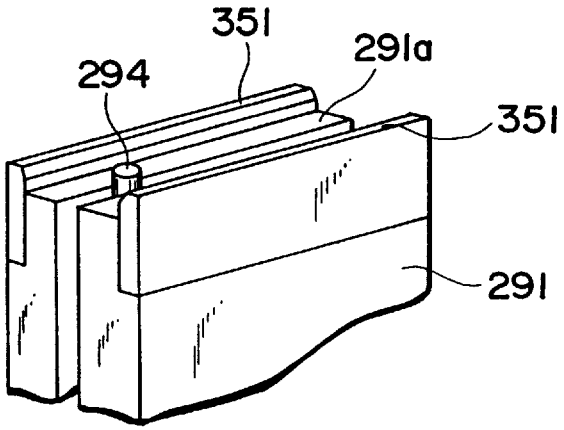
FIG. 41 is a perspective view showing still another embodiment of the magnetic head.

The present invention is not limited to the above embodiment. For example, as shown in FIG. 40, an elongated drawing pint 350 is mounted on the tip end face 291*a* of the magnetic head 291. This elongated drawing pint 350 extends in the direction of matching with the guide hole 201 of the lowermost dropper C. With the use of this drawing pint 350, the dropper C can be stably drawn out without any skid, and the tip end face (attraction surface) 291*a* of the magnetic head 291 can be expanded to allow the omission of the drop prevention mechanism 313. In addition, as shown in FIG. 41, a pair of right and left guide projections 351 are provided at the expanded attraction surface 291*a* of the magnetic head 291. These guide projections 351 are located to sandwich the drawing pin 294. The spacing between the guide projections 351 is slightly larger than the width of the dropper C. With this structure, since the dropper C can be clamped between the pair of guide projections 351, the lowermost dropper C can be prevented from skidding when it is drawn out. Therefore, the dropper C can be stably drawn out. In addition, since the drop prevention mechanism 313 can be omitted, the structure can be simplified.

Figure 42:
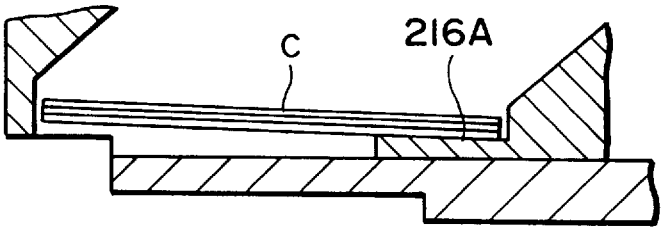
FIG. 42 is a sectional view showing another embodiment of the stocker to which the dropper drawing apparatus of the present invention is applied.
Figure 43:
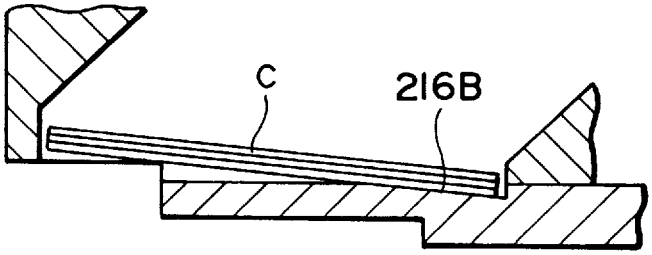
FIG. 43 is a sectional view showing still another embodiment of the stocker to which the dropper drawing apparatus of the present invention is applied.

The dropper receiving bottom surface (dropper support surface) 216 is not limited to the above horizontal state, and can be inclined backward while being kept in a substantially horizontal state. In this case, since the front portion of each dropper C in the stocker 210 is slightly lifted, the dropper group seated on the dropper receiving bottom surface 216 can be further stabilized. If, for example, dropper receiving bottom surfaces 216A and 216B are inclined as shown in FIGS. 42 and 43, the lowermost dropper C can be brought close to the horizontal state when the dropper C is magnetically attracted to the tip end face 291*a* of the magnetic head 291.

Figure 45:
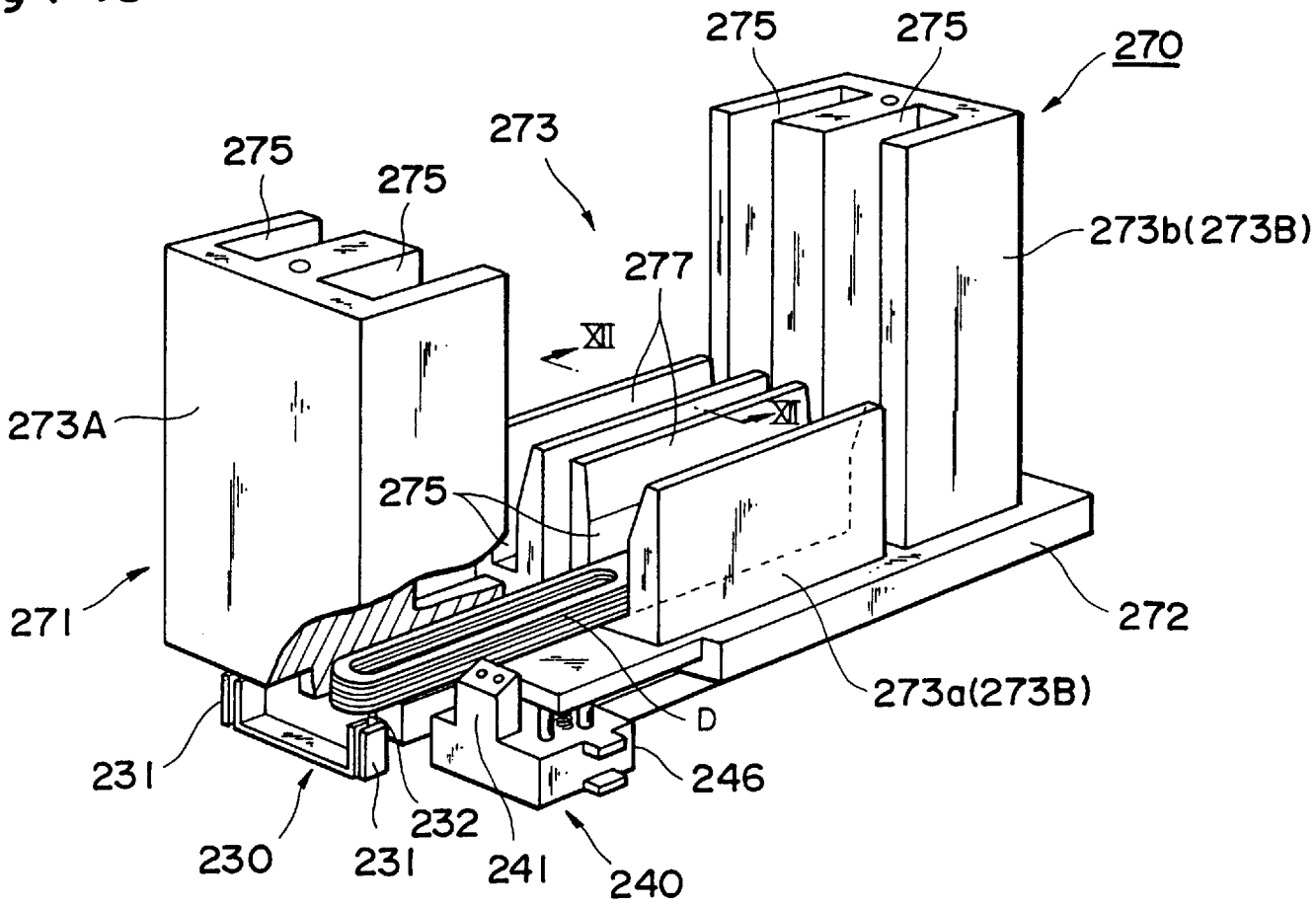
FIG. 45 is a perspective view showing the second embodiment of the stocker to which the dropper separating mechanism according to the present invention is applied.
Figure 46:
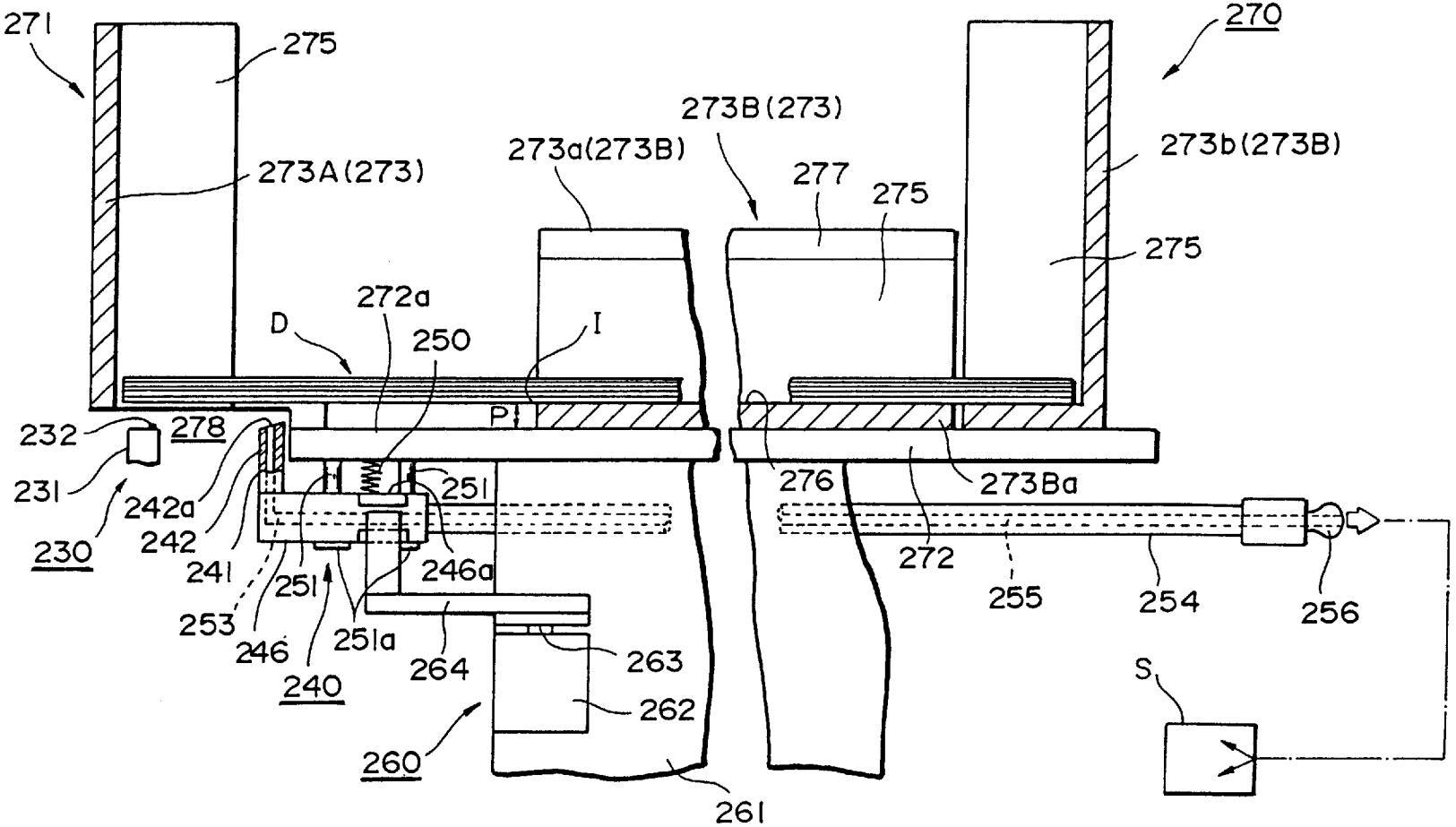
FIG. 46 is a longitudinal sectional view of the stocker shown in FIG. 10.
Figure 47:
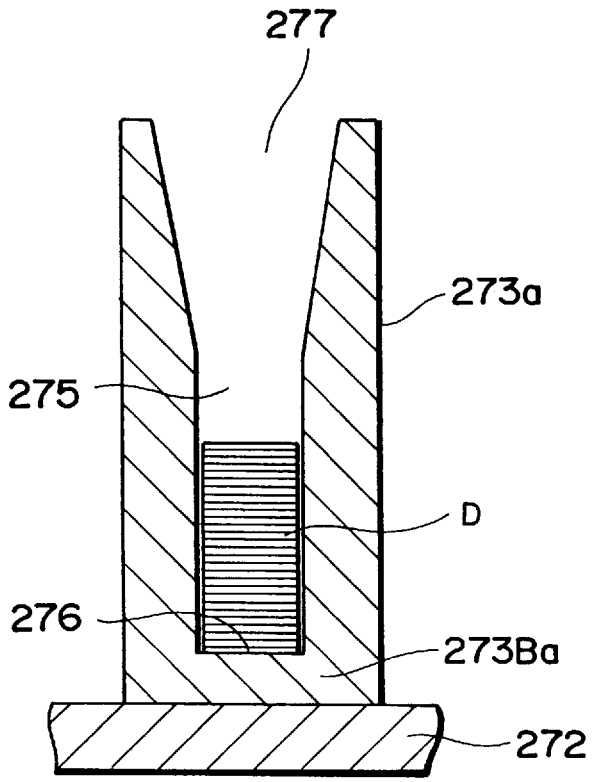
FIG. 47 is a sectional view taken along a line XII—XII in FIG. 34.
Figure 48:
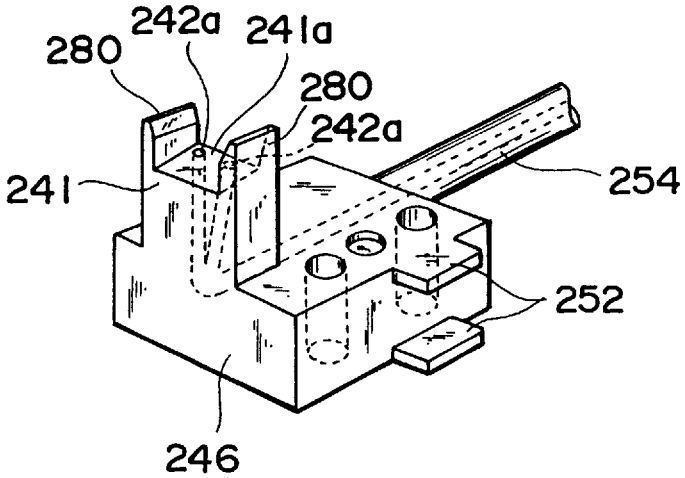
FIG. 48 is a perspective view showing another embodiment of the dropper separating mechanism.

As shown in FIGS. 45 and 46, a dropper stocker 270 has a housing 271 in which droppers D in the horizontal position are stacked vertically. This housing 271 includes a flat base 272 formed in an elongated shape matching with the elongated shape of the dropper D, and a frame 273 standing/fixed on the base 272 and designed to store the droppers D in a stacked state. The frame 273 has a front frame portion 273A for storing the front end portion of the dropper D, and a rear frame portion 273B for storing the rear portion of the dropper D which corresponds to ½ or more of the total length of the dropper D. The rear frame portion 273B comprises a first rear frame portion 273*a* on the front side which supports the load of the dropper D, and a second rear frame portion 273*b* on the rear side which supports the rear end portion of the dropper D.

The frame 273 has two dropper receiving slits 275 for stacking the droppers D vertically. Each dropper receiving slit 275 is formed to extend vertically. The rear frame portion 273B has a dropper support surface (to be referred to as a "dropper receiving bottom surface" hereinafter) 276 extending horizontally and designed to support the dropper D from below. The frame 273 is designed such that the portion of the dropper D which corresponds to ½ or more of the total length of the dropper D is supported by the rear frame portion 273B, but the front portion of the dropper D is not supported. When, therefore, the center of gravity of each dropper D is located within the dropper receiving bottom surface 276, the rear frame portion 273B allows the droppers D to be stacked vertically while cantilevering them. Note that stacking of the droppers D is not influenced by the absence of the dropper receiving bottom surface 276 in the second rear frame portion 273*b*.

The upper portion of the first rear frame portion 273*a* is expanded in a funnel shape to form a dropper refilling aperture 277 at this tip end, thereby allowing the dropper D to be easily inserted through the aperture 277 while being kept in a horizontal position. The lower portion of the front end of a dropper receiving slit 275 is open to form a dropper drawing aperture 278.

As shown in FIG. 46, a predetermined step height is provided between the dropper receiving bottom surface 276 of the dropper receiving slit 275 and an upper surface 272*a* of the base 272. With this structure, the lowermost dropper D can be properly projected from a bottom plate 273Ba. In addition, the front end portion of the lowermost dropper D does not come in contact with the base 272 and can float relative to the base 272. In this embodiment, such a step height is realized by a thickness P of the bottom plate 273Ba of the frame 273. The floating amount of the dropper D can be adjusted by increasing/decreasing the thickness P of the bottom plate 273Ba. Since the front end portion of the lowermost dropper D floats relative to the base 272 in this manner, when the front end portion of the lowermost dropper D is forcibly lowered by a vacuum suction means or the like, the lowermost dropper D can be reliably drawn out from the dropper drawing aperture 278 without causing the front end portion of the lowermost dropper D to come in contact with the base 272.

Note that the frame 273 may not have a division structure and may be integrally formed. In addition, the front frame portion 273A and the second rear frame portion 273*b* are positioned to hold a mirror-image relationship. Even if, therefore, the first rear portion 273*a* is shorter than the front frame portion 273A and the second rear frame portion 273*b*, the droppers D stacked in the housing 271 do not drop off from the frame 273.

In this case, the stocker 270 in FIG. 45 has a dropper separating mechanism 240 having the same arrangement as that of the stocker 210 in FIG. 25. For this reason, the same reference numerals in FIG. 45 denote the same parts as in FIG. 25, and a description thereof will be omitted. Note that the dropper separating mechanism 240 of the stocker 270 in FIG. 45 differs from the stocker 210 in FIG. 25 only in that a suction head 241 is positioned in front of the base 272. Since the operations of the dropper separating mechanism 240 and a dropper drawing mechanism 230 are the same as those described above, a description thereof will be omitted.

The present invention is not limited to the above embodiments. For example, the frame 213 need not have the two-division structure constituted by the front frame portion 213A and the rear frame portion 213B, and may be integrally formed. In addition, as shown in FIG. 37, a pair of right and left guide projections 280 are provided at the tip end face 241*a* of the suction head 241. These guide projections 280 are positioned to sandwich the suction port 242*a*. The spacing between the guide projections 280 is slightly larger than the width of the droppers C and D. Since the dropper C or D can be clamped between the pair of guide projections 280, the lowermost dropper C or D can be stably separated or drawn without causing any skid.

Figure 49:
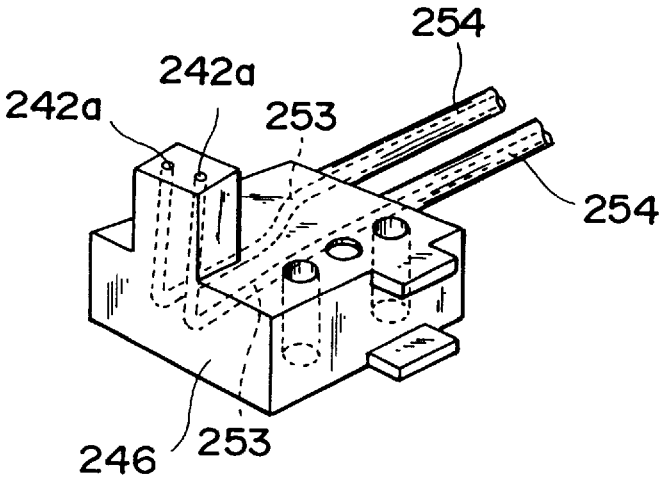
FIG. 49 is a perspective view showing still another embodiment of the dropper separating mechanism.
Figure 50:
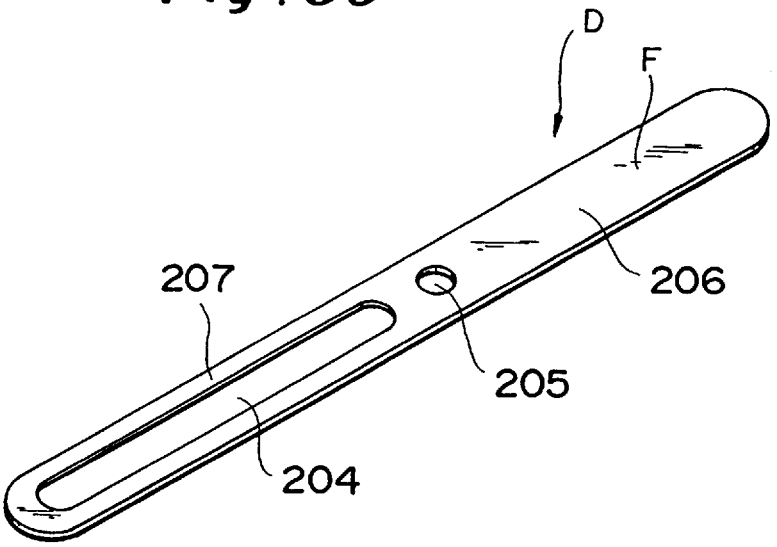
FIG. 50 is a perspective view showing a general elongated dropper.

As shown in FIG. 49, if two suction pipes 254 are arranged side by side in a base portion 246 and connected to two suction ports 242*a*, the suction ports 242*a* can be independently used. With this structure, even if the degree of vacuum of the vacuum source is low, the droppers C and D can be stably separated.

In addition, the dropper receiving bottom surface (dropper support surface) 216 is not limited to the above horizontal state, and may be inclined backward while being kept in a substantially horizontal position. In this case, since the front portion of each dropper C in the stocker 210 is slightly lifted, the dropper group seated on the dropper receiving bottom surface 216 can be stabilized. If, for example, dropper receiving bottom surfaces 216A and 216B are inclined, when the lowermost dropper C is magnetically attracted to the magnetic head 231, the dropper C can be brought close to the horizontal state. Note that the same applies to the dropper receiving bottom surface 276 of the stocker 270.

Since the flat heald drawing apparatus and method according to the present invention have the above arrangements, the following effects can be obtained.

The flat heald drawing apparatus comprises the magnetic head consisting of the iron core of the electromagnet and located below the guide hole of the front-side ring portion of the lowermost flat heald, the drawing pin to be inserted into the front-side guide hole at the lowermost position, and the driving means which holds the magnetic head thereon to move the magnetic head horizontally. With this structure, the apparatus can reliably draw a group of vertically stacked flat healds one by one from the lowermost flat heald.

In the flat heald drawing method, the drawing pin of the magnetic head is inserted into the guide hole of the front-side ring portion of the lowermost flat heald while flat healds are vertically stacked and maintained, the front-side ring portion at the lowermost position is then magnetically attracted to the tip end face of the magnetic head. Thereafter, the magnetic head is moved horizontally to draw the lowermost flat heald while it is hooked on the drawing pin, thereby reliably drawing a group of vertically stacked flat healds one by one from the lowermost flat heald.

The flat heald separating mechanism according to the present invention comprises the suction head which is located below the front end of the rod portion of the lowermost flat heald positioned in front of the front end of the heald support surface, and moves vertically while flat healds in a substantially horizontal state are stacked vertically on the heald support surface, the suction port provided as an aperture at the tip end face of the suction head and opposed to the flat surface of the rod portion at the lowermost position, and the vacuum source for sucking air through the suction port. With this structure, the lowermost flat heald can be reliably separated from a group of flat healds in consideration of the flat shape of the rod portion of each flat heald.

In the flat heald separating method according to the present invention, the front end of the rod portion of the lowermost flat heald located in front of the front end of the heald support surface is vacuum-chucked downward while flat healds in a substantially horizontal state are stacked vertically on the heald support surface. The lowermost flat heald is then warped downward in a cantilevered state to be separated from the next flat heald, with the front end of the heald support surface serving as a fulcrum. With this operation, the lowermost flat heald can be reliably separated from a group of flat healds.

In addition, the flat heald separating mechanism according to the present invention comprises the suction head which is located below the front end of the rod portion of the lowermost flat heald positioned in front of the front end of the heald support surface, and moves vertically while flat healds in a substantially horizontal state are stacked vertically on the heald support surface, the suction port provided as an aperture at the tip end face of the suction head and opposed to the flat surface of the rod portion at the lowermost position, and the vacuum source for sucking air through the suction port. With this structure, the lowermost flat heald can be reliably separated from a group of flat healds in consideration of the flat shape of the rod portion of each flat heald.

That is, the flat heald separating mechanism according to the present invention comprises the suction head which is located below the front end of the rod portion of the lowermost flat heald positioned in front of the front end of the heald support surface, and moves vertically while flat healds in a substantially horizontal state are stacked vertically on the heald support surface, the suction port provided as an aperture at the tip end face of the suction head and opposed to the flat surface of the rod portion at the lowermost position, and the vacuum source for sucking air through the suction port. With this structure, the lowermost flat heald can be reliably separated from a group of flat healds in consideration of the flat shape of the rod portion of each flat heald.

In addition, in the flat heald separating method according to the present invention, the front end of the rod portion of the lowermost flat heald located in front of the front end of the heald support surface is vacuum-chucked downward while flat healds in a substantially horizontal state are stacked vertically on the heald support surface. The lowermost flat heald is then warped downward in a cantilevered state to be separated from the next flat heald, with the front end of the heald support surface serving as a fulcrum. With this operation, the lowermost flat heald can be reliably separated from a group of flat healds.

Furthermore, in the flat heald separating method according to the present invention, the front end of the rod portion of the lowermost flat heald located in front of the front end of the heald support surface is vacuum-chucked downward while flat healds in a substantially horizontal state are stacked vertically on the heald support surface. The lowermost flat heald is then warped downward in a cantilevered state to be separated from the next flat heald, with the front end of the heald support surface serving as a fulcrum. With this operation, the lowermost flat heald can be reliably separated from a group of flat healds.

Since the dropper drawing apparatus and method according to the present invention have the above arrangements, the following effects can be obtained.

The dropper drawing apparatus according to the present invention comprises the magnetic head located below the guide hole of the lowermost dropper and constituted by the iron core of the electromagnet, the drawing pin to be inserted into the guide hole at the lowermost position, and the driving means which holds the magnetic head thereon to move the magnetic head horizontally. With this structure, the apparatus can reliably draw a group of vertically stacked droppers one by one from the lowermost dropper.

In the dropper drawing method according to the present invention, the drawing pin of the magnetic head is inserted into the guide hole of the lowermost dropper while droppers are stacked vertically, and the guide hole peripheral portion at the lowermost position is magnetically attracted to the tip end face of the magnetic head. Thereafter, the magnetic head is moved horizontally to draw the lowermost dropper while the dropper is hooked on the drawing pin, thereby reliably drawing a group of vertically stacked dropper one by one from the lowermost dropper. Since the dropper separating mechanism and method according to the present invention have the above arrangements, the following effects can be obtained.

That is, the dropper separating mechanism according to the present invention comprises the suction head which is located below the front portion of the main body of the lowermost dropper positioned in front of the front end of the dropper support surface, and moves vertically while droppers in a substantially horizontal state are stacked vertically on the dropper support surface, the suction port provided as an aperture at the tip end face of the suction head and opposed to the flat surface of the lowermost dropper main body, and the vacuum source for sucking air through the suction port. With this structure, the lowermost dropper can be reliably separated from a group of droppers in consideration of the flat shape of the dropper main body.

In the dropper separating method according to the present invention, the front portion of the main body of the lowermost dropper positioned in front of the front end of the dropper support surface is vacuum-chucked downward while droppers in the horizontal state are stacked vertically on the dropper support surface. With this operation, the lowermost dropper is warped downward in a cantilevered state and separated from the next dropper, whereby the lowermost dropper can be reliably separated from the group of droppers.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A flat heald drawing method of drawing an arbitrary flat heald out of a plurality of juxtaposed magnetic flat healds, each having two guide holes, comprising the steps of:

inserting a drawing pin of a magnetic head into the guide hole of a front-side ring portion of a lowermost flat heald while the flat healds are stacked vertically;

magnetically attracting the front-side ring portion of the lowermost flat heald to a tip end portion of said magnetic head;

moving said magnetic head horizontally: and drawing the lowermost flat heald while hooking the flat heald on said drawing pin.

2. A method according to claim 1, further comprising the step of;

supplying a damped alternating current to a coil wound on said magnetic head to degauss the front-side ring portion magnetized by said magnetic head after the lowermost flat heald is completely drawn out, thereby releasing the front-side ring portion from said magnetic head.

3. A flat heald drawing apparatus for drawing an arbitrary flat heald out of a plurality of juxtaposed magnetic flat healds, each having two guide holes, comprising:

a magnetic head located below the guide hole of a front-side ring portion of a lowermost flat heald and made up of an iron core of an electromagnet;

a drawing pin which extends from a tip end face of said magnetic head and is to be inserted into the guide hole of the front-side ring portion of the lowermost flat heald; and driving means which holds said magnetic head thereon and moves said magnetic head horizontally.

4. An apparatus according to claim 3, further including a housing for vertically stacking the flat healds in a substantially horizontal state.

5. A flat heald separating method of separating an arbitrary flat heald out of a plurality of juxtaposed flat healds, each having two guide holes, comprising the steps of:

vacuum-chucking a front end of a rod portion of a lowermost flat heald downward while other flat healds in a substantially horizontal state are stacked vertically on a heald support surface, thereby warping the lowermost flat heald in a cantilevered state downward and separating the lowermost flat heald from the other flat healds, with the front end of the heald support surface serving as a fulcrum.

6. A method according to claim 5, wherein the flat healds are stacked vertically in a housing having a substantially horizontal heald support surface.

7. A flat heald separating mechanism for separating an arbitrary flat heald out of a plurality of juxtaposed flat healds, each having two guide holes, comprising the steps of:

a suction head which is located below a front end of a rod portion of a lowermost flat heald positioned in front of a front end of a heald support surface, while the flat healds in a substantially horizontal state are stacked vertically on the heald support surface;

a suction port provided as an aperture at a tip end face of said suction head and located opposite to a flat surface of the rod portion of the lowermost flat heald; and a vacuum source for sucking air through said suction portion.

8. A mechanism according to claim 7, further including a housing for vertically stacking the flat healds in a substantially horizontal on the heald support surface.

9. A dropper drawing method of drawing an arbitrary dropper out of a plurality of juxtaposed magnetic droppers, each having one guide hole, comprising the steps of:

inserting a drawing pin of a magnetic head into a guide hole of a lowermost dropper while the droppers are stacked vertically, magnetically attracting the guide hole of the lowermost dropper to an attracting surface of said magnetic head; and moving said magnetic head horizontally, thereby drawing the lowermost dropper while hooking the dropper on said drawing pin.

10. A method according to claim 9, further comprising the step of; switching an excitation current flowing in a coil wound on said magnetic head to a damped alternating current to degauss a guide hole peripheral portion magnetized by said magnetic head after the lowermost dropper is completely drawn out, thereby releasing the guide hole peripheral portion from said magnetic head.

11. A dropper drawing apparatus for drawing an arbitrary dropper out of a plurality of juxtaposed magnetic droppers, each having one guide hole, comprising the steps of:

a magnetic head located below a guide hole of a lowermost dropper and made up of an iron core of an electromagnet;

a drawing pin which extends from a tip end face of said magnetic head and is to be inserted into the guide hole of the lowermost dropper; and driving means which holds said magnetic head thereon and moves said magnetic head horizontally.

12. An apparatus according to claim 11, wherein said drawing pin is elongated in a direction of matching with the guide hole of the dropper.

13. An apparatus according to claim 11, further comprising a pair of guide projections formed on a tip end face of said magnetic head at positions where said guide projections sandwich said drawing pin.

14. An apparatus according to claim 11, further including a housing for vertically stacking the droppers in a substantially horizontal state.

15. A dropper separating method of separating an arbitrary dropper out of a plurality of juxtaposed droppers, each having one guide hole, comprising the steps of:

vacuum-chucking a front portion of a dropper main body of the lowermost dropper downward while other droppers in a substantially horizontal state are stacked vertically on a dropper support surface, thereby warping the lowermost dropper in a cantilevered state downward and separating the lowermost dropper from the other droppers, with the front end of the dropper support surface serving as a fulcrum.

16. A method according to claim 15, wherein the droppers are stacked vertically in a housing having a substantially horizontal dropper support surface.

17. A dropper separating mechanism for separating an arbitrary dropper out of a plurality of juxtaposed droppers, each having one guide hole, comprising the steps of:

a suction head which is located below a front portion of a dropper main body a lowermost dropper positioned in front of a front end of a dropper support surface, while the droppers in a substantially horizontal state are stacked vertically on the dropper support surface, and moves vertically;

a suction port provided as an aperture at a tip end face of said suction head and located opposite to a flat surface of the dropper main body the lowermost dropper; and a vacuum source for sucking air through said suction portion.

18. A mechanism according to claim 17, wherein the tip end face of said suction head is inclined forward.

19. A mechanism according to claim 18, further comprising a pair of right and left guide projections formed on the tip end face of said suction head at positions where said guide projections sandwich said suction port.

20. A mechanism according to claim 17, further including a housing for vertically stacking the droppers on a horizontal dropper surface.

* * * * *